US008082938B2

(12) United States Patent
Prusmack

(10) Patent No.: US 8,082,938 B2
(45) Date of Patent: Dec. 27, 2011

(54) COLLAPSIBLE SHELTERS WITH AND WITHOUT A FLOATING HUB

(75) Inventor: A. Jon Prusmack, Valley Cottage, NY (US)

(73) Assignee: DHS Systems LLC, Orangeburg, NY (US)

( * ) Notice: Subject to any disclaimer, the term of this patent is extended or adjusted under 35 U.S.C. 154(b) by 497 days.

(21) Appl. No.: 12/322,062

(22) Filed: Jan. 27, 2009

(65) Prior Publication Data

US 2011/0168220 A1 Jul. 14, 2011

Related U.S. Application Data

(63) Continuation-in-part of application No. 11/250,340, filed on Oct. 14, 2005, now Pat. No. 7,481,235.

(51) Int. Cl.
*E04H 15/44* (2006.01)
*E04B 7/10* (2006.01)

(52) U.S. Cl. ..... 135/135; 135/122; 135/131; 135/147; 52/81.3; 52/83; 52/646

(58) Field of Classification Search ..... 135/12–123, 135/124, 131, 135, 145–147, 120.32; 52/81.1–81.3, 52/83, 648.1, 646, 653.1; 403/171–173
See application file for complete search history.

(56) References Cited

U.S. PATENT DOCUMENTS

| | | | | |
|---|---|---|---|---|
| 563,376 | A | 7/1896 | Herman | |
| 927,738 | A | 7/1909 | Malaby | |
| 1,773,847 | A | 8/1930 | Nickles | |
| 2,781,766 | A | 2/1957 | Krieger | |
| 3,063,521 | A | 11/1962 | Fuller | |
| 3,185,164 | A | 5/1965 | Pinero | |
| 3,710,806 | A | 1/1973 | Kelly et al. | |
| 3,968,808 | A | 7/1976 | Zeigler | |
| 4,026,313 | A | 5/1977 | Zeigler | |
| 4,280,521 | A | 7/1981 | Zeigler | |
| 4,290,244 | A | 9/1981 | Zeigler | |
| 4,373,305 | A * | 2/1983 | Russell | 52/86 |
| 4,437,275 | A | 3/1984 | Zeigler | |
| 4,473,986 | A | 10/1984 | Zeigler | |
| 4,512,097 | A | 4/1985 | Zeigler | |
| 4,522,008 | A | 6/1985 | Zeigler | |
| 4,561,618 | A | 12/1985 | Zeigler | |
| 4,579,066 | A | 4/1986 | Zeigler | |
| 4,607,656 | A | 8/1986 | Carter | |
| 4,641,676 | A | 2/1987 | Lynch | |
| 4,689,932 | A | 9/1987 | Zeigler | |
| 4,761,929 | A | 8/1988 | Zeigler | |
| 4,779,635 | A | 10/1988 | Lynch | |
| 4,838,003 | A | 6/1989 | Zeigler | |

(Continued)

*Primary Examiner* — Winnie Yip
(74) *Attorney, Agent, or Firm* — Thomas A. Beck

(57) ABSTRACT

Collapsible portable self-supporting shelter structures having from at least two component quad sections to seven or more component quad sections, which joined end to end form the width of the structure; and, said entire component sections optionally being joined side to side form a desired depth of the portable shelter. The resulting structure is a collapsible self-supporting prefabricated deployable shelter having a clear span interior without supporting columns.
Some versions of the collapsible portable self-supporting shelter structure due to its configuration may optionally contain a floating hub which is a top element extending above the structure's standard exterior matrix frame. The floating hub forms a high pitch atop the shelter, which high pitch causes the fabric, which covers the matrix frame, to be maintained in a taut downward-sloping condition over the shelter top surface so no rain or snow collects in the fabric at the top of the shelter.

50 Claims, 42 Drawing Sheets

U.S. PATENT DOCUMENTS 5,444,946 A * 8/1995 Zeigler ..... 52/86
5,797,695 A 8/1998 Prusmack
6,141,934 A * 11/2000 Zeigler ..... 52/646
7,131,236 B2 * 11/2006 Sample et al. ..... 52/79.5
7,533,498 B2 * 5/2009 Zeigler ..... 52/79.5
2005/0155637 A1 * 7/2005 Kim ..... 135/131

* cited by examiner

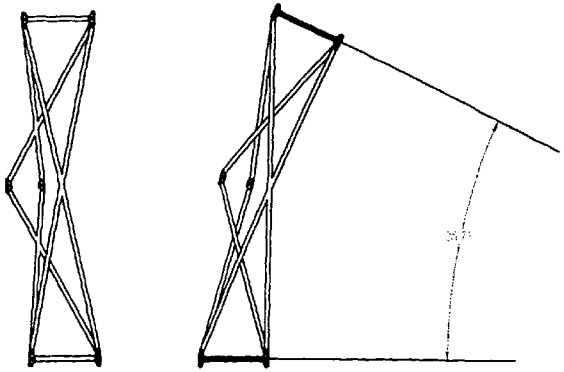
FIG. 3A
FIG. 3B1
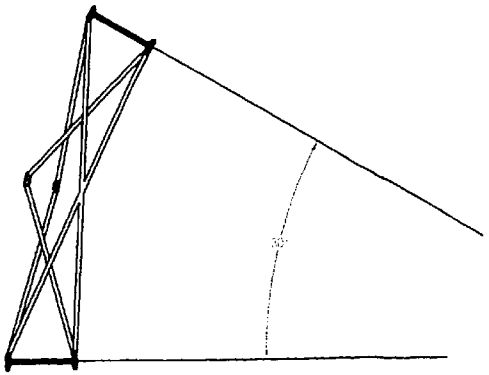
FIG. 3B2
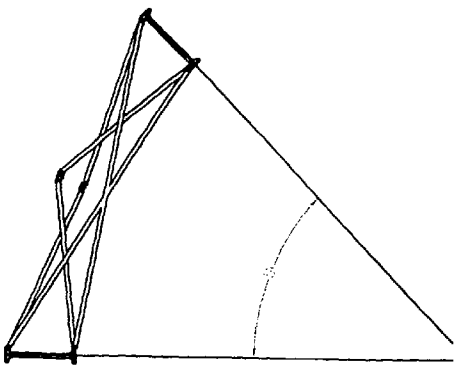
FIG. 3B3
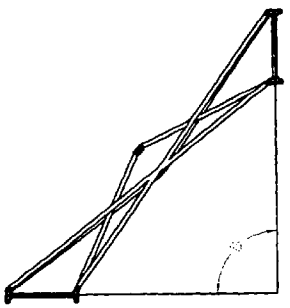
FIG. 3B4

COLLAPSIBLE SHELTERS WITH AND WITHOUT A FLOATING HUB

The present invention is a continuation-in-part of U.S. application Ser. No. 11/250,340 filed Oct. 14, 2005, now U.S. Pat. No. 7,481,235.

FIELD OF THE INVENTION

The present invention relates to a collapsible portable self-supporting shelter structure having at least two component sections forming the walls of said shelter.

The present invention also relates to collapsible, self supporting structures that utilize an improved articulating hub assembly as a connector among tubular rod elements (referred to interchangeably hereinafter as "tubes," "struts" or "rods") that in combination, form components designated herein as "quads." These rod elements, which form the top, bottom and the sides of the quad, are connected to form the structure. The resulting structure is a collapsible self-supporting prefabricated deployable shelter having a clear span interior without supporting columns.

The present invention further relates to a larger version of the collapsible portable self-supporting shelter structure having a plurality of quad sections which, due to the configuration of the shelter framework and cover thereover contains a floating hub.

A first significant feature of the present invention is to allow the tubes to articulate or move freely when either upward, (i.e., vertical) or opposing side, (i.e., horizontal) forces are applied. These forces cause a 180° (i.e., a semi-circular) rotation of the tube components which comprise up to eight tubes per hub.

The shelters, in accordance with the present invention, are formed from two or more quads range in utility and dimension from the two man type "pup tent" to a spacious collapsible portable self-supporting structure which is a multi-quad shelter that is used for as many persons or functions as desired.

The novel floating hub noted above is a four part moveable extension means used to improve the efficiency of the collapsible portable self-supporting structure. The self-supporting structure of the present invention comprises a prefabricated deployable structure formed from the quads noted above. The quads comprise rectangular or square sections comprising tubular rod elements connected at four corners and center which when initially assembled and later erected provide the matrix frame. The result is a clear span interior shelter structure without supporting columns. The floating hub provides a top element above the structure's standard exterior matrix frame and forms a high pitch atop thereof when the structure is erected the fabric, which covers the matrix frame, to form the shelter, is maintained in a taut condition over its top surface.

BACKGROUND OF THE INVENTION

To be efficient, portable deployable building assemblies should have a foldable capability so that they may be erected where desired and, when necessary, folded up to a compact form for storage and/or transportation. These types of portable building assemblies now generally utilize struts, which are some type of tubular rods, as the basic construction unit, that form the skeleton structure and thus the configuration of the portable building assembly. The tubular rods noted above are interconnected with one another by some type of linking joints, so that the completed structure is collapsible. A plastic, canvas or some other type of durable fabric covering is secured to the outside and, in many instances, to the inside of the erected structure to envelope the outside surface of the assembly and provide an insulating air space between the covers to form a wall type interior in the covered shelter.

The simplest version of a portable shelter assembly is the "pup tent" noted above which contains two sides configured to form an inverted "V" wherein the vertex at the top can range between 30° and 60° depending upon the desires of the user as to the amount of space present within the interior of the shelter, as shown in FIG. 18.

An example of a large collapsible structure is shown in U.S. Pat. No. 3,185,164, which discloses a portable structure having a plurality of rods joined by coupling means into groups of three which are inter-related to form a generally hexagonal structural system.

Another example of such a collapsible structure is shown in U.S. Pat. No. 3,710,806. Portable structures that utilize elements which maintain the rigidity of the structure are disclosed in U.S. Pat. No. 3,063,521.

For example, U.S. Pat. No. 3,968,808 discloses a collapsible self-supporting dome-like structure with a network of pivotal rods interconnected with linking joints. The linking joint holds six rods, each connected to a six-sided metal ring. Each rod is connected onto the ring and is capable of rotating. The rod is a permanent attachment and thus cannot be disconnected nor replaced. There does not appear any way to attach a cover to the dome-like structure such as is found in the "keeper" component in the articulating hub assembly of the present invention.

U.S. Pat. No. 4,026,313 also discloses a collapsible self-supporting dome-like structure with a network of pivotal rods interconnected with linking joints. The pivotal device linking the rods together forming the structure is a circular joint. Each joint has only four rods. Each rod contains a plug ending with a small cylinder. This small cylinder is nested inside the joint and allows the rod to rotate. It appears that none of the components is easily interchanged. The top and bottom sections of the hubs in the reference appear to be permanently joined by all adhesive so that none of the rods or plugs can be replaced.

U.S. Pat. No. 4,512,097 discloses a display panel mounting clip. The clip body is used to connect display panels together. The clip assembly disclosed requires a spring mechanism to create tension and hold the panels together. The present invention requires no springs. The clip disclosed in the reference must be snapped into an opening joining the rods in a circular joint. In the present invention, the circular hub is screwed into the hub section so it is threadedly secured.

U.S. Pat. No. 4,280,521 discloses a hub assembly for collapsible structures. The hub assembly disclosed in the reference requires a circular retaining ring to hold the "column like elements" or tubes in place. Each tube must be threaded onto a circular retaining ring prior to insertion into the hub section. In the present invention no circular ring is present or required to hold the rods together inside the hub to allow rotation. The present invention as explained in detail hereinafter requires that each tube have its own tang, each with its own roll pin to independently nest inside the hub body. Thus no ring is present. The hub sections are secured in place by use of an adhesive to fuse the two hub sections together permanently. The tube members within the structure, therefore, are not easily replaceable since the hub sections cannot be replaced without destroying them. It is an object of the present invention to provide a hub assembly that has the capability of quickly and easily removing the strut which is contained within the hub.

The '521 reference design described above, uses a three piece clamping device to hold or attach a skin or cover to the structure. One piece is a plug that is incorporated inside the hub section and is fused into the hub sections. The second piece is a flat disc. The third piece is an element which is a screw. The screw is threaded into the plug and holds the clamp down. A screw driver would obviously be required to remove the clamp if or when the cover, the skin or the tubes have to be replaced.

Soviet Patent No. 1,392,220 discloses a joint between rods which possesses two pressure plates whose surfaces face each other and have spherical loons with slits from each loon to the outer outline of the pressure component plate. Screws appear to join the upper plate with the lower plate to hold the ball joints in place. The reference does not disclose a hub assembly such as described and claimed herein.

Collapsible frame structures for supporting tents or other outdoor shelters are disclosed in U.S. Pat. Nos. 563,376; 927,738; 1,773,847, 2,781,766, 3,968,808; 4,026,313; 4,290,244; 4,437,275; 4,473,986; 4,512,097; 4,522,008; 4,561,618; 4,579,066; 4,607,656 4,641,676, 4,689,932, 4,761,929, 4,779,635 and 4,838,003.

The prior art large structures disclosed in the references cited above in the past have suffered from a variety of problems. Some of them are not portable, and some are not collapsible. Due to the immense size which is needed in many present military and civilian applications, it is often difficult to erect or collapse (i.e., to raise or to lower) the structure network formed from the connecting struts. The inherent difficulties are that to erect or to collapse a large volume portable structure requires many workers, takes a significant amount of time, and requires special tools and equipment. The structures are bulky and heavy and have a complicated construction. Deployable portable building assemblies must be capable of being collapsed quickly and easily folded up into a compact structure.

The type of building assemblies using the central hub disclosed in U.S. Pat. No. 5,797,695 ('695) to A. Jon Prusmack, the contents of which are hereby incorporated by reference herein, conveniently collapse to a bundle having a cylindrical configuration along its longitudinal axis when stored.

A front view cross-sectional representation of the shelter structure disclosed in the '695 patent is depicted in FIG. 1A which shows the shelter with five "sections" or "quads" (denoted 1-5). The quads (also referred to herein as sections or modules) are square and have side and diagonal elements formed from tubular strut elements connected at each end and in the center to a hub. The diameter of the tubular strut elements contemplated by the '695 patent is about ⅝" (0.0625" in). Each of the five sections found in the '695 prior art structure is 5 feet square. The structure in the embodiment depicted in FIG. 1A has a horizontal interior distance at ground level between quad 1 and quad 5 of a bit greater than 11 feet. Using the 5 $ft^2$ quad dimensions and the tubular strut of ⅝", when the structure is erected, the distance from the ground to the center point of quad 3 of FIG. 1A is in excess of about 8 feet.

However, when attempting to construct a portable building assembly having greater height, width and length dimensions compared with those dimensions disclosed above with respect to the '695 assembly, it was determined that serious problems were encountered with respect to the structural integrity of the shelter.

When forming a larger interior volume deployable structure than that disclosed in the '695 patent, a tubular strut having greater structural integrity is required than the structural integrity of struts having a diameter of ⅝". Using a larger diameter strut with the same size hub as disclosed in the '695 patent will not produce a shelter possessing the required features necessary for prompt tactical deployments. An increased diameter strut (i.e., greater than ⅝") used in combination with the prior art hub will not allow the struts to compress when collapsing the structure. Accordingly, the structure cannot be folded to possess the required "low racking volume" wherein $V=\frac{1}{3}\pi r^2 h$ where the smaller the V value, the more efficient the system.

A front cross-sectional view of a larger shelter unit is depicted in FIG. 1B. It possesses quads I-VII. This shelter has widths ranging generally from about 18 feet up to about 32 feet. There is accordingly a wider horizontal space at the base of same between the interior sides I and VII than the eleven plus feet of the shelter disclosed in FIG. 1A. The increased building dimensions require a commensurate increase the diameter of the tubular struts comprising the quads in the construction of a larger deployable shelter. The increase in the diameter of the struts is required as a result of an increase in the stress on the struts. The larger struts result in added structure weight. In addition to the heavier weight of the structure, there are some substantial construction problems. If the larger diameter tubular strut is increased to a length of, for example, 7 feet, the complementary angles between quads I and II, II and III and III and IV, etc. will be changed, so the symmetry which is inherent in the '695 prior art shelter is lost and the structure is totally different.

In copending application Ser. No. 11/228,651 certain basic features of a different style articulating hub assembly with a double tang is also disclosed. As noted, that application is incorporated by reference herein.

In all of the dome or cylinder framework structures of the above prior art patents, movement from the collapsed condition to the expanded condition involves expansion of the base of the structure from a bundled condition outwardly toward and finally to the fully expanded position of the base. Conversely, when the structure is collapsed, the base retreats inwardly from the fully expanded position to the bundled condition. Expansion is effected by pushing upwardly on the center of the structure allowing the sides to slide inward, and the base of the outermost quad to be parallel to the ground. Collapsing is effected by pulling outward on the outermost quad to make it perpendicular to the ground.

In many of the aforesaid prior art patents, as in the present invention, the skeletal framework is covered with flexible waterproof covering material to provide a covering enveloping the structure to result in the shelter function. The covering material may be made of any suitable coated fabric, such as polyester, nylon or even an appropriately treated canvas, and can be one piece and may include flaps with zipper or similar edge connections means for covering any openings or the like. Preferably, the covering material is attached to the framework at the hub means in the manner disclosed in any one of the prior patents. In order to allow the arch portions of the framework to separate for expansion or collapsing, the covering is also provided for such separation, even through it may be zipped up to effect the proper covering function when the framework is expanded.

Because the covering is a fabric, it has a given modulus of elasticity. This elastic property of the fabric presents a problem when a shelter of large area is erected because at the top of the shelter when the fabric cover is under tension, rain or snow falling on the top surface of the covering fabric (which is initially taut) will tend eventually to weigh down the fabric to the point where it will sag and then will collect the rain or snow in pockets formed as a result. As more of the rain or snow collects in these pockets, the greater the added weight to the shelter and ultimately, the overall integrity of the shelter is compromised. The floating hub of the present invention addresses this problem and provides a continuously smooth contour to the top of the shelter so as to eliminate the problem associated with the pockets of water or ice on the upper surface (top) of the shelter. None of the references cited above disclose the use of a floating hub to eliminate the problem stated.

For reasons stated above, and for other reasons stated below which will become apparent to those skilled in the art upon reading and understanding the present specification, there is a need in the art for an improved portable shelter without the disadvantages inherent in the prior art.

BRIEF SUMMARY OF THE INVENTION

The present invention relates to portable shelters that comprise two types of quads which are connected together in various combinations to create a raised arch. The number and type of quads used depends upon the interior space desired in the resulting shelter. The two types of quads are designated and referred to hereinafter as "A" and "B." The A and B quads differ from each other depending upon the length of certain struts used therein, the ratio of these lengths to one another and the positioning of the scissor points where these struts are connected to each other, allowing the struts to articulate.

The present invention encompasses a plurality of from 2 to 7 or more A and B quad arrangements to form the shelter structure. The A quad is a square quad having scissor points joined mid-way along the length of the contiguous struts. The A quad provides only height in the vertical axis and width in the horizontal axis when installed in combination with the B quads in a shelter. The B quad is a square quad having scissor points joined off-center along the length of the contiguous struts. The B quads provide the arcuate form to the shelter when used alone or in combination with the A quads.

If for example, one desires to construct a large volume shelter having 7 quads, the shelter can take the form of ABBABBA; BBBBBBB; and BBBABBB. In the form options noted, the quads are connected together end to end, the resulting framework is curved forming an arcuate shape. "Arcuate" shape as used herein refers to a gradual rounded slope rising gradually from ground level (in the case of a B quad as the first quad, or from the top end of an A quad) up to a maximum point or plane (depending on whether an A or B quad is in the center of the structure) followed by a gradual descending downward slope to the ground or to the top end of an A quad.

The collapsible self-supporting shelter of the present invention possesses a fundamental architectural design based on the geodesic dome. But to make the structure function as a portable, quick erect/strike shelter (up and down) for multiple uses, several unique features are necessary. The components of the shelter are as has been noted, tubular strut elements connected to hubs to form a matrix. The resultant structure is a clear span interior without supporting columns.

There are a number of important elements that distinguish the present invention from the prior art. The first element is the articulating hub assembly as disclosed in U.S. Pat. Nos. 5,797,695 and 7,481,235 the contents of which are hereby incorporated by reference herein. These hub assemblies permit the shelter's supporting frame to expand and contract by allowing the connected struts (tubing) to rotate (articulate) 180 degrees from a tightly collapsed bundle to a fully expanded and erect shelter. Furthermore, the articulating hub assembly has plurality (e.g., eight) of slotted openings where the struts are connected to the inside of the hub. These openings permit the struts to rotate in the expanded mode and form two parallel planes. Each plane supports a fabric cover: an exterior and an interior.

The articulating hub assemblies also incorporates a threaded center hole which allows a mushroom shaped screw, called a keeper, to attach both the interior and an exterior covers to their respective plane. These two covers provide protection and insulation.

As generally stated above, the framework is covered with attached flexible material to complete the shelter function of the invention. When the framework has been expanded to its functionally operative condition, the flexible material on the exterior of the shelter matrix is held taut by the framework to which the material is attached. The covering material in the past has been the source of difficulty when it is not retained in a taut condition. The covering in the past has required a higher pitch on the frame because, in inclement conditions, the weight of rain, ice and snow can accumulate in pockets on the upper more horizontal quads.

The second important element relating to the improved design and function of the shelter is the floating hub in connection with the fixed riser. This is a significant improvement in the state of the art.

The floating hub allows the exterior cover on the shelter to form a sharply pitched exterior shape when in the expanded mode. Furthermore, the floating hub automatically recesses into the frame structure upon striking thereby reducing the tension on the cover and allowing it to fold into the collapsed frame.

The sharply pitched exterior cover formed by the floating hub prevents water, ice and snow from accumulating on troughs or low spots on the fabric cover. Without this floating hub, the exterior fabric cover would more closely follow the contours of the semi-circle arch of the supporting frame. Since fabric expands and contracts with temperature and humidity, the exterior cover over time forms troughs or pockets. This is especially true on the flatter sections toward and at the top of the shelter which would be the roof.

The third important element is the "Riser." The floating hub increases the slope or pitch of the fabric cover on the sides of the Riser which serves to form a higher, sharper and stable ridge line at the top. Together the floating hub and Riser features increase the pitch of the exterior fabric cover and force ice, water and snow to slide off. If these two features were not integrated, the accumulation of ice, water and or snow would exceed the design limited of the structure and the shelter would collapse under too much weight.

The floating hub of the present invention comprises four distinct parts and is used in conjunction with articulating hub assemblies described hereinafter and in the patents noted above as well as the hub described in U.S. patent application Ser. No. 11/228,651, incorporated by reference. As the tubular rod frame of the shelter is expanded upward to erect the overall assembly, the top surfaces of selected articulating hub assemblies each push a base plate element of the floating assembly upward. The base floating plate is connected to a top floating hub by means of a connecting rod.

When the shelter assembly of the present invention is fully erected as depicted in the figures described hereinafter, the floating hub(s) are positioned along the length and width of the shelter to provide hard points along the standard surface of the shelter frame assembly (i.e., where the upper surface when covered with fabric would be in the absence of the floating hub) suitable for attaching the fabric cover thereby forming an acute downward slope from the higher pitch to prevent rain or snow or both from collecting on the cover surface. The novel function served by the floating hub assembly is to establish a hard point at an extended position above the standard surface of the frame structure, such that when a fabric cover is attached to the exterior surface of the shelter, a high pitched acute straight line downward slope is formed thereby to prevent weighty snow, water and/or ice from collecting on the cover surface, thereby forming a depression on the cover eventually resulting in the collection of water or ice in the surface depression. The floating hub thus prevents the cover from sagging under the weight of ice, snow, rain, etc.

Further, the benefit of the shelter with the arrangement of struts and hubs and floating hub assembly is the portability of same and the ability to raise large structures from small transporting packages. For example, an assembled shelter in accordance with the present invention covering an area of 386 $ft^2$ can be carried to the site for striking in a parcel 5 ft×3 ft×2 ft.

As noted above, there are different size hubs used for the shelters depending upon the dimensions of the shelter, i.e., the number of quads forming an arch of the frame structure. The 7 quad arrangements of ABBABBA and BBBABBB each have floating hubs. The BBBBBBB frame with the riser has an adequate pitch down on its own thus eliminating the need for a floating hub. The former two arrangements with the A quads need the floating hub to sharpen the pitch of the fabric so it will not collect snow or ice. The 7 quad arrangements noted above with a center A quad has the floating hubs on the configuration. One could add it to the BBBBBBB quad frame, but the floating hub in this case would dampen the pitch. The slope or pitch of the BBBBBBB quad is adequate enough to prevent snow/ice build up on the fabric. The other two have a flat A quad in the center which dampens the pitch from the riser so the floating hub mitigates this condition.

In all of the shelters embodied in the present invention, one can add the riser and floating hub to all the quads at the top of the structure. Theoretically this works; however practically, it may not serve a useful purpose on some of the quads as it is not necessary.

The hubs used in the quads will all be the same size based on the diameter of the connecting struts. The 2, 3 and 4 quads use a ⅝" OD tubing with a circular hub with a diameter of 2¼". The larger structures with 5, 6 and 7 quads will span a greater width and therefore require a larger diameter strut. The larger diameter tube will have a different size hub. For example, hubs in shelters denoted "J" or "M" hubs are used in the B quads. The M hub shelter has a ¾" OD tube and an octagon shaped hub with a width of 3". The J hub Shelter has a 1" OD tube also with an octagon shaped hub with a width of 3⅝". This hub is covered in U.S. Pat. No. 7,481,235 to A. Jon Prusmack, incorporated herein as noted above.

The following summarizes whether a floating hub and/or riser serve(s) a useful purpose:

On a two quad (BB) structure one could use a floating hub but a riser is really not required.

On the three quad (BAB) structure, a riser is included. The addition of a floating hub would, in this case, flatten the pitch from the riser and make it more susceptible to snow/ice build up. The pitch of the BAB is sharp so the floating hub is not needed.

On the four quad structure generally, no riser or floating hub is included on top. Either of these can be added and will sharpen the pitch more dramatically.

The five quad structure has both the riser and floating hubs

On the six quad structure generally, no riser or floating hub is included, but this can be added. The addition of either would sharpen the pitch like a church roof.

A first significant feature of the articulating hub of the present invention is allowing the struts to articulate or move freely when either upward, (i.e., vertical) or opposing side, (i.e., horizontal) forces are applied. These forces cause a 180° (i.e., a semi-circular) rotation of the strut components which comprise up to eight struts per hub.

More specifically, with respect to the collapsed network of tubular struts, assemblies, etc. laid out prior to erection, when manual upward pressure is applied at 90° (i.e., perpendicular) to the ground at specific location on the network, multiple hub assemblies are displaced from positions physically contacting the ground to specific elevated positions above the ground. The upward vertical force creates an action that moves the articulating hub assemblies of the present invention from static positions to tension positions and forms a structure of interconnected struts and articulating hub assemblies that is self-supporting. The resultant erected structure has four exterior sides. As noted above, the size and the shape of the structure can vary based upon the length of the struts and the location of scissor points thereon.

To collapse the frame to its original position on the ground, simultaneous and opposing forces are applied on each of the four sides of the structure, 180° to each other and 90° to the vertical (along the 0° or X-axis), to specific articulating hub assemblies. This action allows the tubular strut to move from a tension position with the assemblies above ground, back to a static position and collapse down to the original location on the ground.

The slits in the hubs described in U.S. Pat. No. 7,481,235 which secure the tubular struts into the hub are offset at a 45° angle so that the struts emanating radially from any given hub rotate within a unique geometric plane not shared with any other rod, thus the rods can easily fold in on themselves and provide a compact bundle for storage or expand easily for a quick set-up.

There are three embodiments of the articulating hub used in the present invention. For the purposes of this disclosure, they are the articulating hubs described and claimed in U.S. Pat. Nos. 5,797,695 and 7,481,235. To facilitate assembly of the hub, the bottom half of the assembly is substantially thicker than the top, and contains slits in the interior top and bottom hub sections to capture the tang and pin elements of the struts.

With respect to the structure depicted in FIG. 1B, the quads formed using a "J" articulating hub are maximally 7 feet square with a height when the structure is erected between the ground to the center point of quad IV of up to 12.5 feet. The quads formed using the "M" hub are maximally 4'10" feet square, with a height when the structure is erected between the ground to the center point of quad IV of up to 8.75 feet. The horizontal distance between quad I and quad VII in FIG. 1B will vary depending upon hub and strut size is used. For example, the strut length could be 5.0 ft to increase both width and height. The addition of two quads to that disclosed in the shelter depicted in FIG. 1A allows larger shelters to be constructed.

A second significant feature of the articulating hub assembly of the present invention is the ability to secure fabric covers (covering the tubular frame network) to the hub body and allow the two covers (interior and exterior) to move simultaneously with the tubular frame. In the assembly there is a mushroom shaped keeper element, having a top and a shaft extended downwardly therefrom, wherein the shaft is capable of being inserted through the hub top, and the shaft is capable of being secured to the hub bottom. The central opening of the hub bottom may be threaded, and the shaft of the shaft of the keeper element also threaded to coincide with the central threaded opening of the hub bottom to allow the keeper to threadedly engage the hub body. Where a cover is placed over the tubular structure, the keeper element may secure the cover by holding the cover between the top of the keeper element and the hub top in a configuration where the shaft of the keeper element is placed through an opening in the cover and secured to the hub body. The top of the keeper is contoured to match the slope of the exposed surface of the hub cover.

The collapsible structure of the present invention is a substantial improvement over prior art assemblies as a result of the novel articulating hub assemblies, the riser and the floating hub. The present invention enables the rapid deployment of larger structures from a given collapsed volume, relative to the prior art, and enables collapsible structures with absolute dimensions larger than previously possible. In particular, the hub assembly of the present invention is a substantial improvement over prior art in that it enables struts of the deployable structure to form a more compact collapsed form and enables the use of larger diameter rods where required for larger or more robust structures.

Objects and features as well as additional details of the present invention will become apparent from the following detailed description and annexed drawings of the presently preferred embodiments thereof, when considered in conjunction with the associated drawings.

DESCRIPTION OF THE DRAWINGS

FIGS. 3A and 3B1 to 3B4 shows a side view of each quad and in the 13 quads indicates the angle subtended by those quads FIG. 4 is an exploded view of a hub portion of the quad depicted in FIG. 3.

DESCRIPTION OF THE PREFERRED EMBODIMENT

The Quads Forming the Shelter

The present invention relates to three dimensional frameworks for portable shelters which involve pairs of crossed, pivotally connected struts and hub means pivotally connecting the struts of adjacent pairs of struts in orthogonally patterned end-to-end relation to define separate components referred to as "quads" so that the framework is movable between a collapsed bundled condition in which the struts are disposed in generally parallel relation and an expanded condition in which the quads and framework are disposed in three dimensional form. The quads are so arranged that a horizontally disposed top central region of the framework is at least partially bounded by quads extending in different directions therefrom and which effect a transition angularly from the horizontal disposition of the top region to vertically disposed quads of the assembly at the sides, i.e., horizontal to vertical subtends an angle of 90°.

The fundamental design of the quick erect/strike structure or shelter is a relationship between geometry and architecture. The two basic building block quads, designated as A and B, are square shaped structural elements that are connected together to form 1. a vertical or 2.) horizontal plane element via the A quad, and 3.) a curved arch via the B quad. The quads themselves form a polyhedron within tetrahedron square. Thus, only the B quads provide arcuate inclination on both sides of the center of the structure.

The A quads provide only vertical height above the base or horizontal distance in the center of the shelter between two B quads. The common design element is the isosceles triangle, i.e., a triangle having equal sides. There is a relationship between the numbers of quads (isosceles triangles), the location of the center point defining the arch and the types of structural quads used. The base of each isosceles triangle in the overall arrangement of component elements represents a B quad, providing the arcuate inclination.

Each quad has struts of equal length and width but is connected at scissor points allowing them to rotate and turn at different point locations along the length of the struts. This is necessary in the case of the B quad in order to effectively create an arch that will mimic a semi-circle and transition from vertical to horizontal planes.

The A quad is symmetrical and has the struts crossing points, called scissor points, equidistant from the ends. Since the A quad is symmetrical, it inherently can only form a vertical or horizontal plane.

Figure 17:
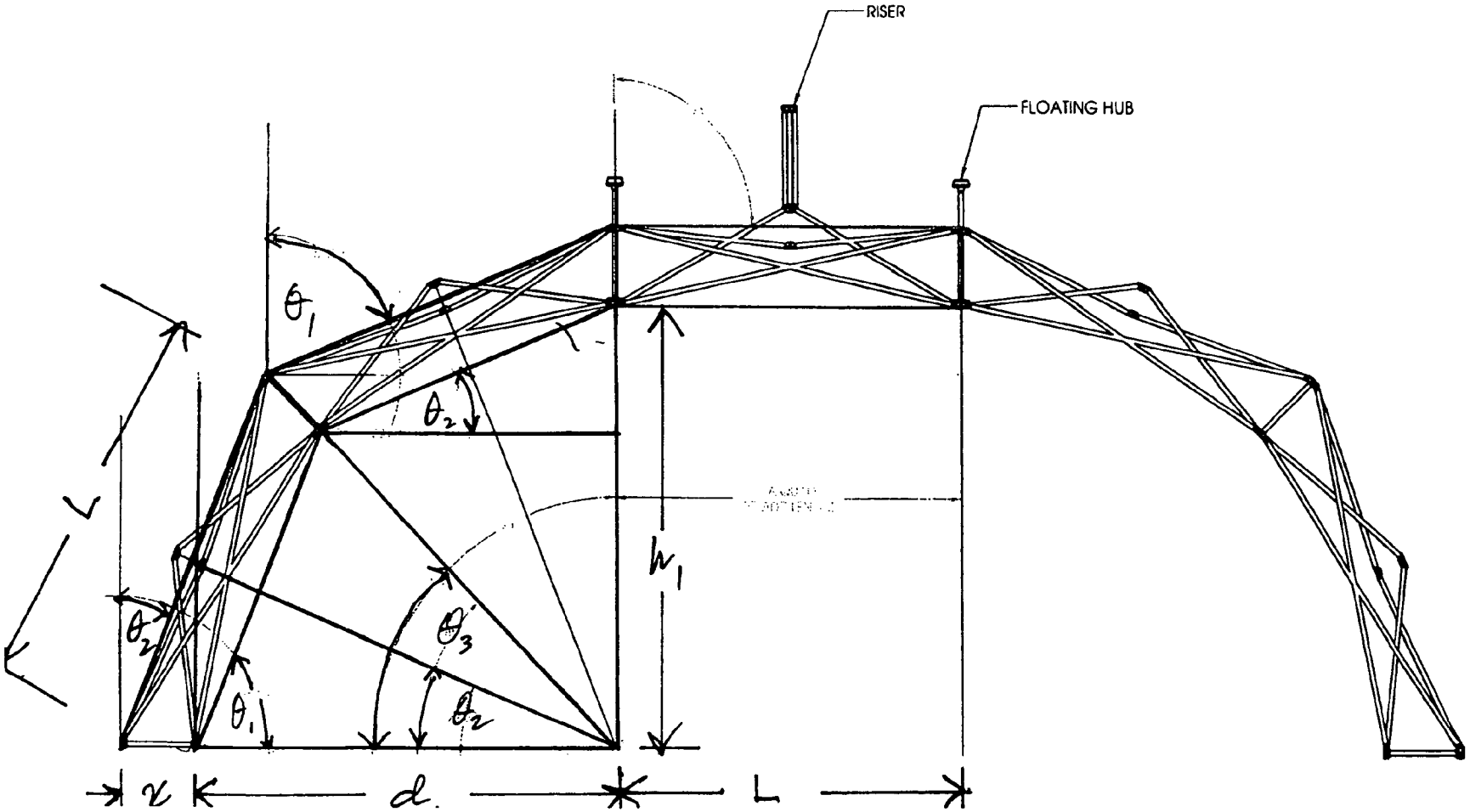
FIG. 17 is a calculation sheet to determine what length of strut to use in a quad to achieve a specific width and height of the arch.

The B quad is also square, but the strut crossing points are asymmetrical and are positioned at unequal distances from the ends. This design allows one end to form a zero degree plane and the other end to form an angular plane to match the number of isosceles triangles necessary to create an arch. This angle is determined by dividing the number of B quads (isosceles triangles) into 180. FIG. 17 shows this relation ship.

The base of the isosceles triangle defines the length and width of the quad and are the elements that when connected together form an arch that is a semi circle or 180 degrees. The vertex of these isosceles triangles all meet at a point which is at a center or midway on the ground between the ends of the two furthest quads each with on end on the ground.

By knowing the length of the strut which is defined as the base of the isosceles triangle and is one dimension of the quad and knowing that the two legs of the isosceles triangle will be equal, and knowing also the angle at the vertex of the isosceles triangle as calculate by dividing the number of B Quads into 180, and using the law of sine and cosine, one can calculate what length and height the legs of the isosceles triangle will be which is essentially the interior width and height based on the given strut length.

The apex angle which subtends the quads of the shelter of the present invention that contains only B quads is determined in one of two ways depending upon the configuration of the shelter. For purposes of calculation, using the isosceles triangles mentioned herein, the apex is located on the base. The apex is formed by the intersection of two imaginary line segments, the first line segment emanating from the base hubs which are the exterior and interior hubs positioned at the bottom of the quad in contact with the base, and the other line segment emanates from the hubs positioned at the top of the quad. The hubs at the "top" of the quad are referred to hereinafter as "shared hubs" because these hubs are intermediate and shared by the struts of a first hub and the struts of the next succeeding hub in the quads that comprise the rows of arches forming the shelter. This sequence of shared hubs continues until the last quad in the row contacts the base Thus in any given set of quads forming a row, there are only two sets of hubs that are not shared hubs, i.e., "base hubs" as these two sets of hubs are in contact with the base. The base is the ground or any surface upon which the shelter is to be constructed.

In the instance of a shelter having an even number of only B quads, the apex is located at a point on the horizontal base, vertically directly below and normal to the intersection of the middle two B quads in the sequence of quads forming the arch. See FIG. 20.

In the case of a shelter having an odd number of only B quads, the apex is located a point on the base directly below and normal to the center of the odd B quad positioned in the middle of the sequence of quads forming the arch. See FIG. 25.

In the instance of a shelter having a vertical A quad positioned on the base on each side of the shelter, and having an even number of B quads in between said A quads, the apex is located at a point, which point is formed by the intersection of a horizontal line segment that extends between the shared hubs which join the top of the A quad to the succeeding B quad On each side of the shelter, and a vertical line segment that extends downward from the center point situated between the two B quads that are in the middle of the sequence of B quads forming the row, said vertical line segment being positioned normal to the line segment between the shared hubs. See FIG. 23.

In the instance of a shelter having a vertical A quad positioned on the base on each side of the shelter, and having an odd number of B quads in between said A quads, the apex is located at a point, which point is formed by the intersection of a horizontal line segment that extends between the shared hubs which join the top of the A quad to the succeeding B quad on each side of the shelter, and a vertical line segment that extends downward from the center point of the odd B quad, in the sequence of quads forming the arch, said vertical line segment being positioned normal to the line segment between the shared hubs.

In the event the row of connected quads forming the shelter has an A quad in its center, two apexes are formed from the intersection of imaginary line segments, one of which extends horizontally from the base hubs and the other imaginary line segment that extends vertically down from the center of the sets of shared hubs where the B quad joins the A quad each sharing in the use of the common shared hubs. This forms two arcs of 90° facing in opposite directions. Within these two 90° quadrants, 2 B, 4 B or 6 B quads can be installed resulting in BAB, BBABB or BBBABBB shelters. The apex would in these instances would subtend angles of 90°, 45° and 30° respectively. See FIG. 24.

Figure 25:
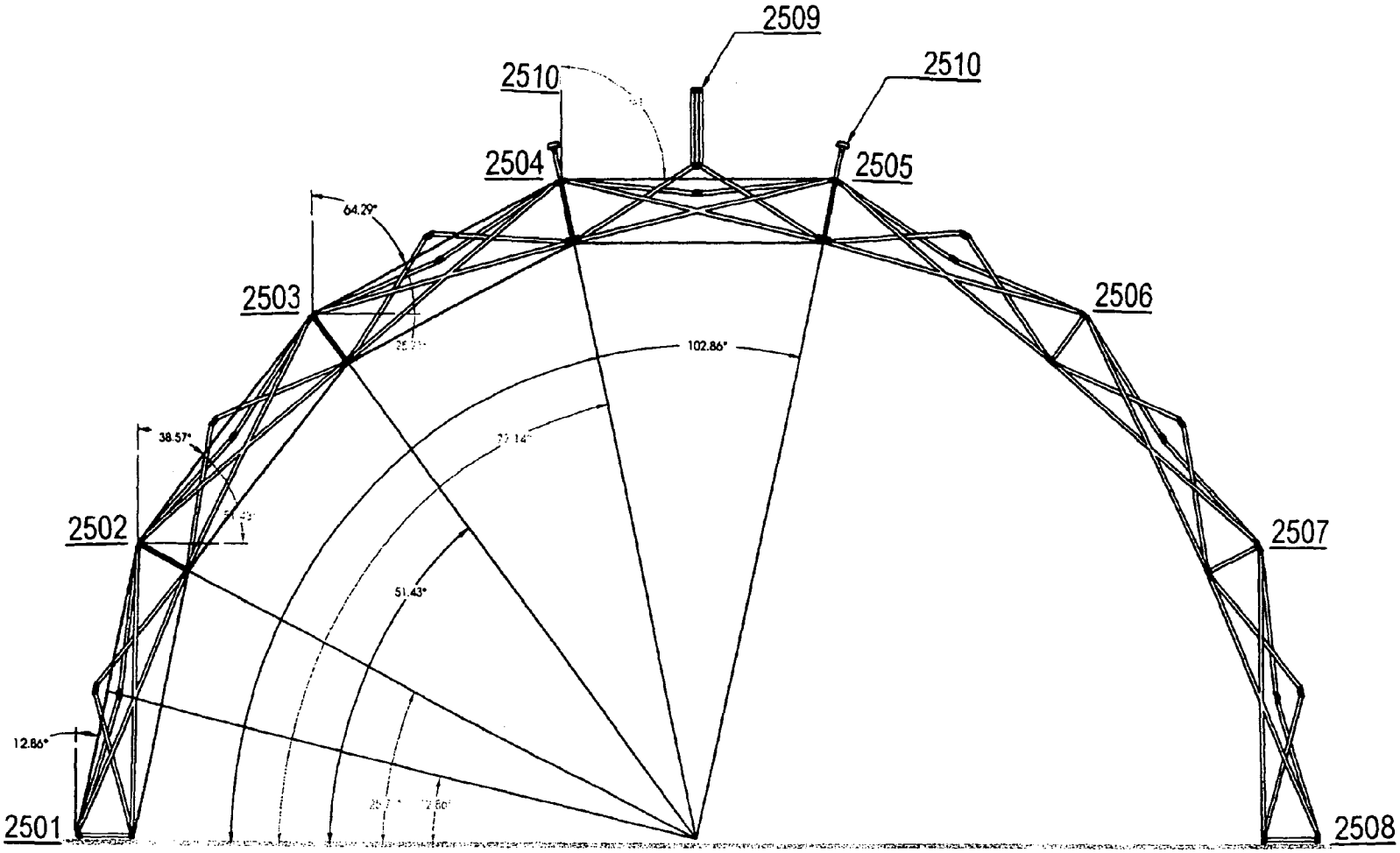
FIG. 25 is a front cross-sectional view of seven assembled BBBBBBB quads of the present invention forming a shelter along with a riser between two floating hubs.

As noted in detail above, shelters of the present invention are formed from A and B quads ranging from 2 quads to 7 or more quads. The number and type of quads used is a function of what use the shelter is to be put. An individual may wish to use only 2 quads to form a "pup" tent type shelter. Conversely, a commercial or government entity may wish to erect a shelter that contains substantial square footage and/or cubic volume using the 7 or more quads. The B quads are the heart of the structure. They provide the upward and downward slope associated with the structure. The shelter can be formed from only B quads as shown in FIG. 25. If one wishes to provide additional height along the vertical axis from the base up, and wishes to add to the width of the structure (from the first in-line quad to the last), one inserts an A quad between adjacent B quads. Thus it is the desired dimensions of the structure that determine how many and which quads will be used.

The struts that form the B quad are elongated and straight, but the asymmetrical crossing points noted above allow the quads that are formed therefrom to provide a radian-like curvature to the shelter, although there is no actual curvature to the quad. There is no enclosed arc as is found in a radian but there is a gradual slope (rise/run) ascent and descent when the B quads are used alone or in combination with an A quad.

To arrive at a shelter design and shape to match a specific width and height, a combination of isosceles triangles (two, three, four, five, etc) is necessary to define the overall structural arch. The exact number of isosceles triangles necessary is determined by dividing up the number of structural B quads which define the initial shelter's length and height into 180°. If additional length and height is desired, A quads are added to the base and center of the B quads comprising the structure.

In referring to the Figures depicting the shelters of the present invention, for the purpose of discussion herein, the term "vertex" shall mean an angle at the base of the triangle. The "base" in this context is, as referred to previously, the longitudinal line segment extending from the bottom exterior and interior hubs of a quad to the top exterior and interior hubs of the same quad. This "base" is not to be confused with the "base" referring to the ground or surface upon which the shelter is set up. The vertex angles of the isosceles triangle is formed as a result of an imaginary line extending from an apex which intersects with a quad in position in the row assembly. The term "apex" refers to the pointed end of or the tip of the isosceles triangles. The apex is located within the interior of the shelter at a location which is determined in a manner as set forth in detail hereinafter.

Figure 20:
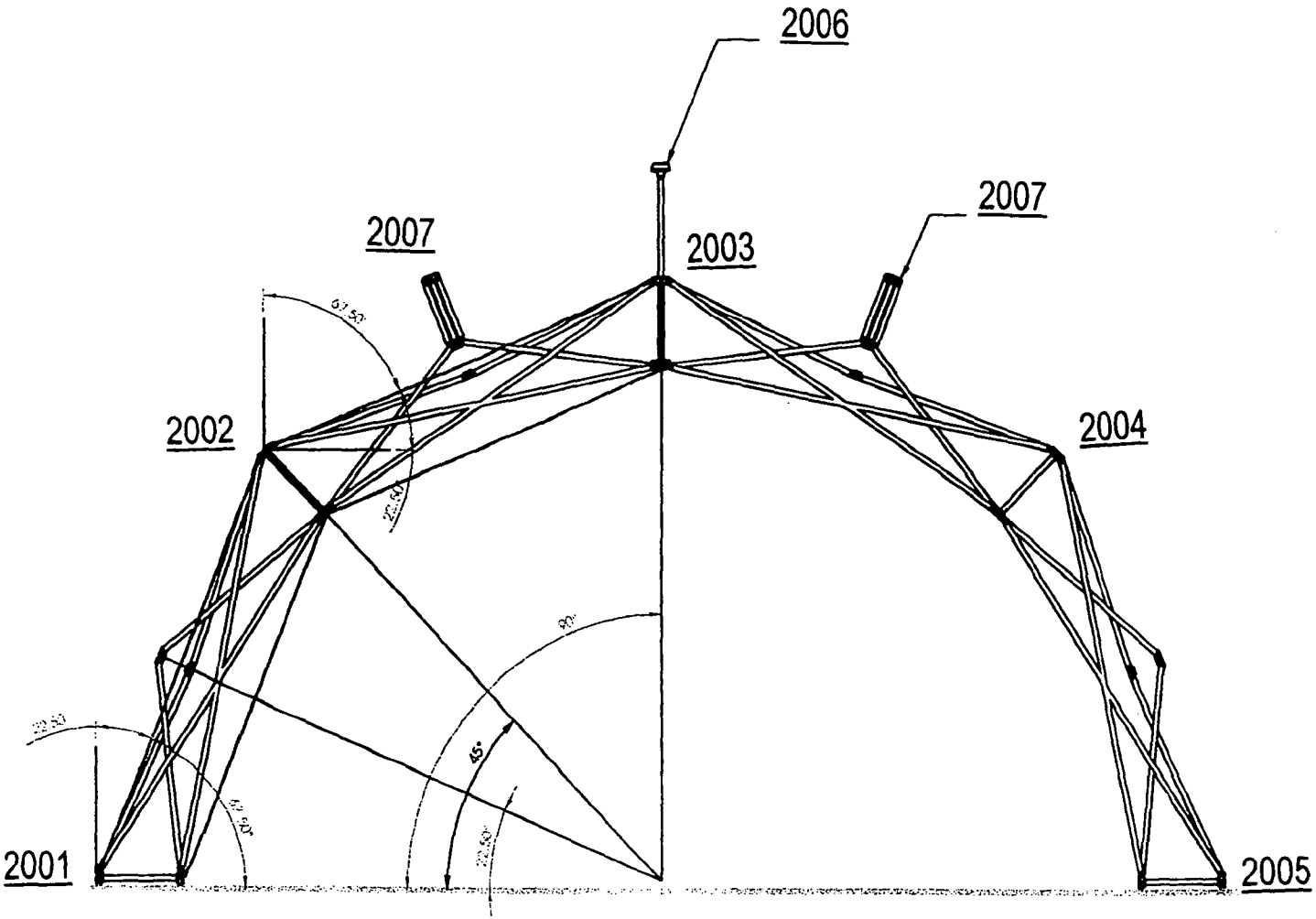
FIG. 20 is a front cross-sectional view of four assembled B quads of the present invention forming a shelter.
Figure 20A:
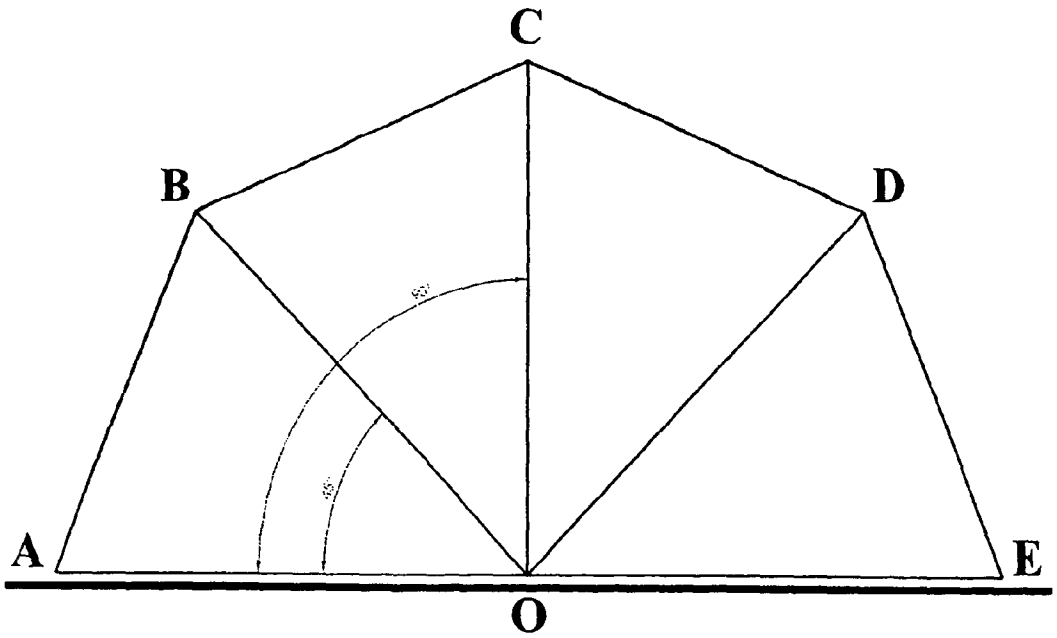
FIG. 20A is a side cross-sectional view of the outline of the perimeter of the shelter depicted in FIG. 20 showing the angles subtended by the base of the triangles.

For the purpose of discussion, the B quad as installed in the structure depicted in FIG. 20A forms the base of an isosceles triangle. The imaginary sides of the isosceles triangles emanating from the vertexes at opposite ends of the B quads subtend angles located at the apex which is located at the center point of the horizontal base within the structure. Depending upon the number of B quads used in the structure, the subtended angle will range between 90° for two BB quads (See FIG. 18) to 25.7° for seven BBBBBBB quads (See FIG. 25). If A quads are used in conjunction with the B quads, the subtended angle of the B quad is determined by eliminating the A quads and joining the B quads together and making the calculation as to the subtended angle accordingly. For example, in reviewing FIG. 21A, to determine the subtended angle of the four bases, one would eliminate triangle COD (resulting from the presence of the horizontal A quad) and merge lines CN and DP to obtain four triangles, each having apexes of 45°.

Viewing from the front of the structural outline of the shelter depicted in FIG. 20A, there are four straight line representations of the sides of B quads, AB, BC, CD, DE which define the arcuate shape of the shelter. As the name "isosceles" implies, lines forming the sides of the triangles connecting apex center point O with vertices at A, B, C, D and E are of equal length. The apex is within the interior center of the shelter at the base surface. In FIG. 20A, the multiple isosceles triangles as shown at AOB, BOC, COD, DOE define the arch. The vertices are OAB, OBA, OBC, OCB, etc. Since there are no A quads, there is no vertical or horizontal extension to the B quads present in the structure. The quad (base of the triangle depicted) subtends an angle of 45°.

Figure 21:
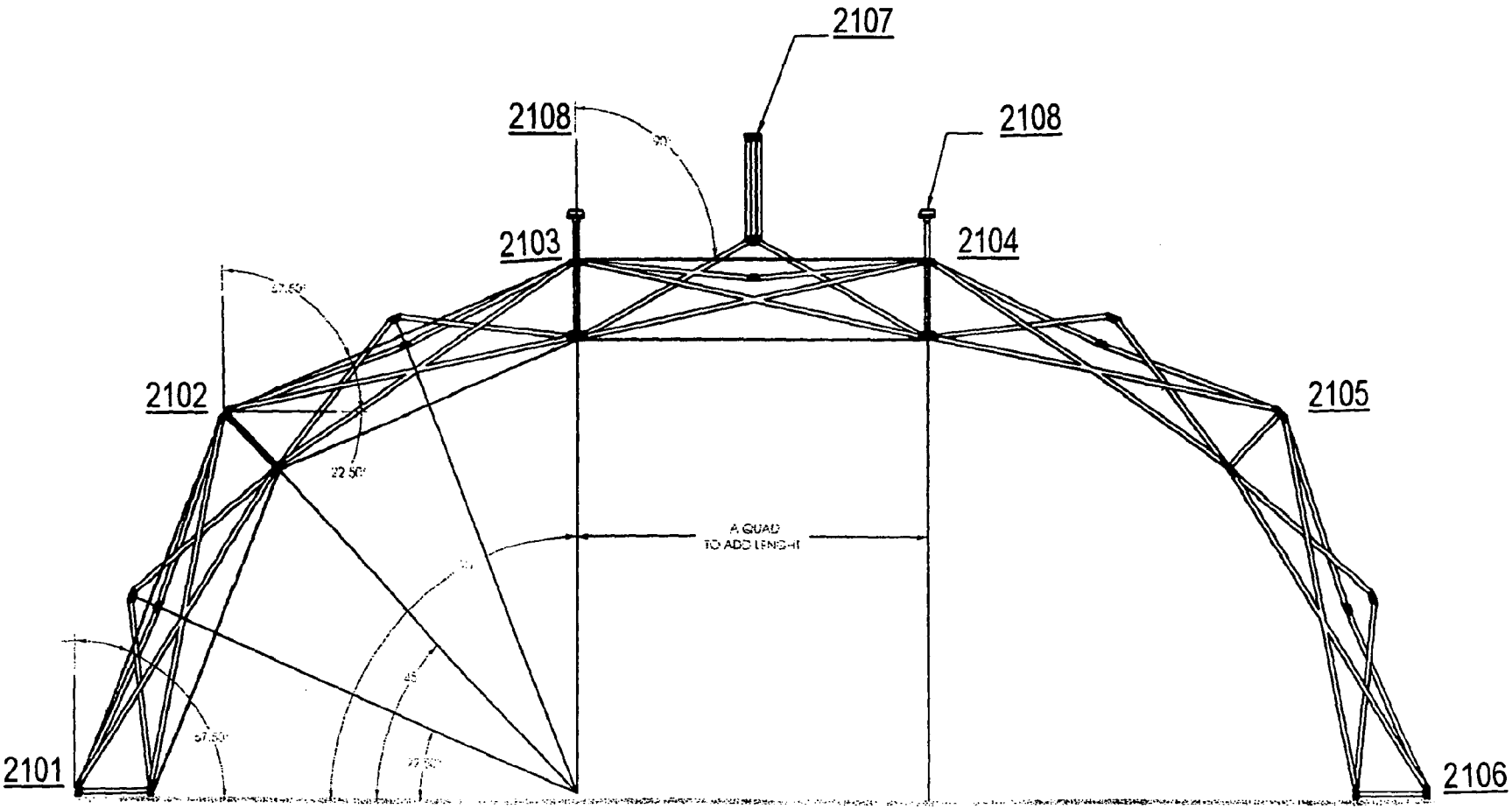
FIG. 21 is a front cross-sectional view of five assembled BBABB quads of the present invention forming a shelter along with a riser and two floating hubs therebetween.
Figure 21A:
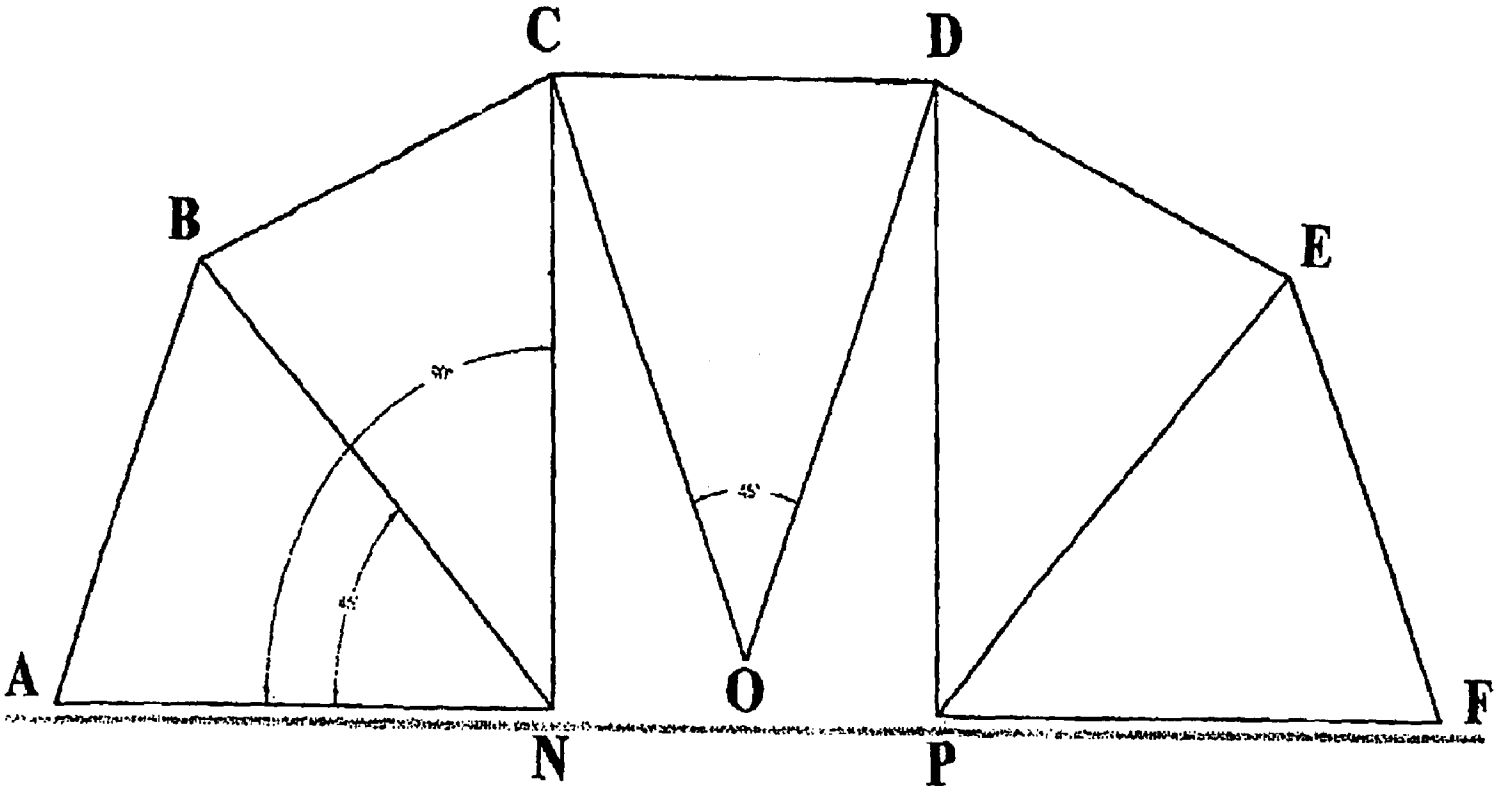
FIG. 21A is a side cross-sectional view of the outline of the perimeter of the shelter depicted in FIG. 21 showing the angles subtended by the base of the triangles.

Viewing from the front of the structural outline of the shelter depicted in FIG. 21A, there are four straight line representations of B quads AB, BC, DE and EF which represent the side views of the quads, i.e., the bases of isosceles triangles. These quads define the arcuate shape of the shelter. There is, in addition, a straight line representation of a horizontal A quad, line segment CD. Lines connecting center point N with vertices A, B, and C are of equal length, as are lines connecting center point P with vertices D, E and F. In FIG. 21A, multiple isosceles triangles as shown at ANB, BNC, DPE and EPF define the arch curvature. The subtended angle is 45°. The A quad merely provides width to the shelter.

By way of illustration, in referring to FIG. 25, the B quad angle at the apex is 25.7°. This angle is arrived at by dividing 180/7=25.7°. This creates a arch-like structure with a a row of B quads. Connecting a line from the hubs positioned at each end of the quads in the row of B quads with the central apex point, seven isosceles triangles result, and therefore seven B quads each with a vertex angle of 25.7°.

As noted, the quad comprises hubs and struts that form its perimeter. There are in addition, four sets of two cross member struts, each set secured at "scissor points" and situated within the interior confines of the perimeter of a quad. This portion of the quad is called a "sub-assembly." Each of the set of struts in the sub-assembly is connected to one of the set of four corner perimeter hubs at one end, and to the two central hubs within each A and B quad at the other end. The struts within the sub-assembly bisect each corner thereof at 45°. These sub-assemblies are used for enhanced stability and to provide a center support section for both exterior and interior covers used with the shelter. The center hub receives a mushroom shaped keeper that attaches the exterior and interior cover surfaces to the articulating hub assembly.

Figure 25A:
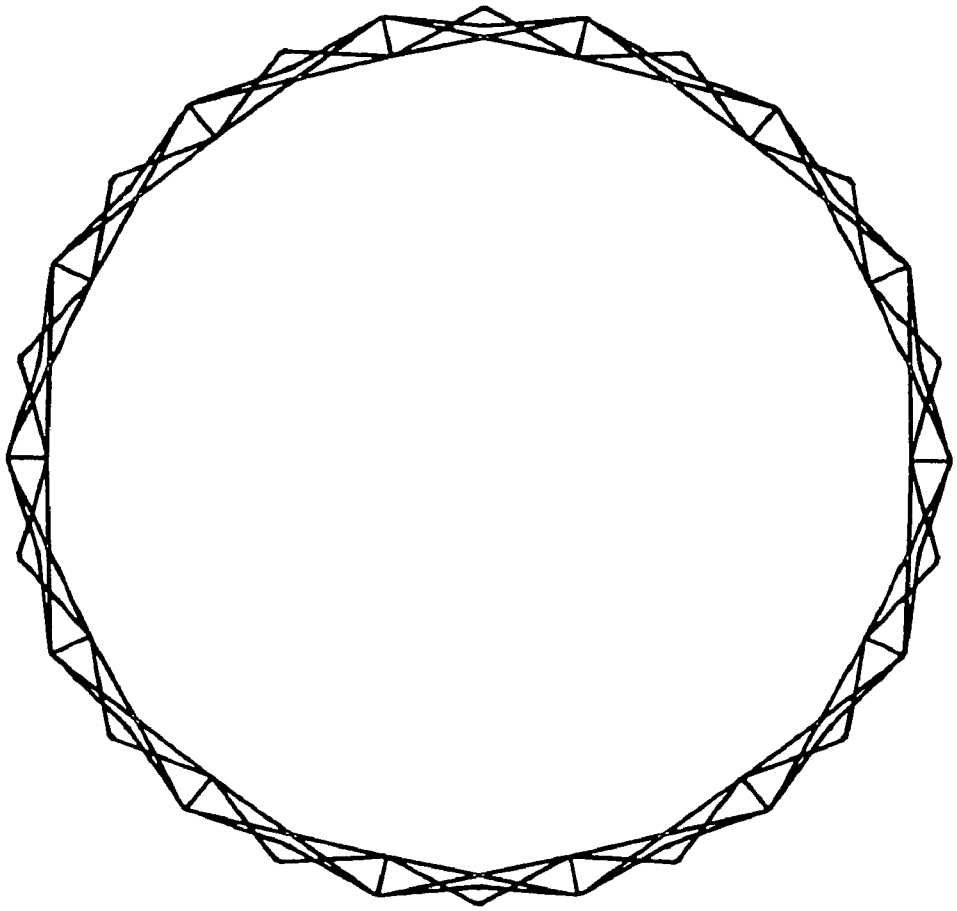
FIG. 25A is an example of the circular end result of a plurality of B quads.

The scissor points mentioned above play an essential role in expanding and contracting the shelter. The A quad has the scissor point located at the center of the strut lengths. The A quad only defines 0 and 90 degree planes. The B Quad has off-center scissor point along the length of the strut. The B quad is configured to define arches in multiple apex angles when connected. If all B quads were connected together or a combination of A and B quads connected together, the end result would be a circle. FIG. 25A is an example of the circular end result of a plurality of B quads.

A fixed dimension between A and B quad struts must be maintained in order for the struts to articulate. The sum of the distances between scissor points on the struts to the articulating hubs for both A and B Quads must be equal.

The present invention provides a convenient way to construct a portable structure using a combination of A and B quads. Through the use of a B quad one can obtain curvature to both sides of the structure, and through the use of the A quad one can obtain the desired height or length or both. Since the A quad adds height and length based on its given length L, and the B quads will provide the arch necessary to transition and connect the vertical)(90° with the horizontal)(0°), one can easily form a structure of what size desired which is portable and easily set up and give both height and length.

The angular relationships created by multiple isosceles triangles allows for the calculation of specific widths and heights of the structure. This principle determines how high and wide the structure will be. This is basically accomplished by using the Laws of Sine and Cosine and a given fixed length of the strut L.

Given a fixed strut length L, which is the base of an isosceles triangle and a given vertex angle θ, determined by dividing the number of B Quads into 180, and knowing also that the sum of the angles of a triangle must total 180, there is enough information to calculate the legs of the isosceles triangle which is essentially a one component of the width (half an arc) and the interior height.

If the strut length L does not provide adequate width or height, then a new strut length L2 can be used to increase or decrease the width or height of the interior of the structure.

Using three examples, structures comprising three different configurations of quads were constructed using:

A full arch: BBABB

A full arch: BBBBBBB

A full arch: ABABA

Example 1

Figure 23:
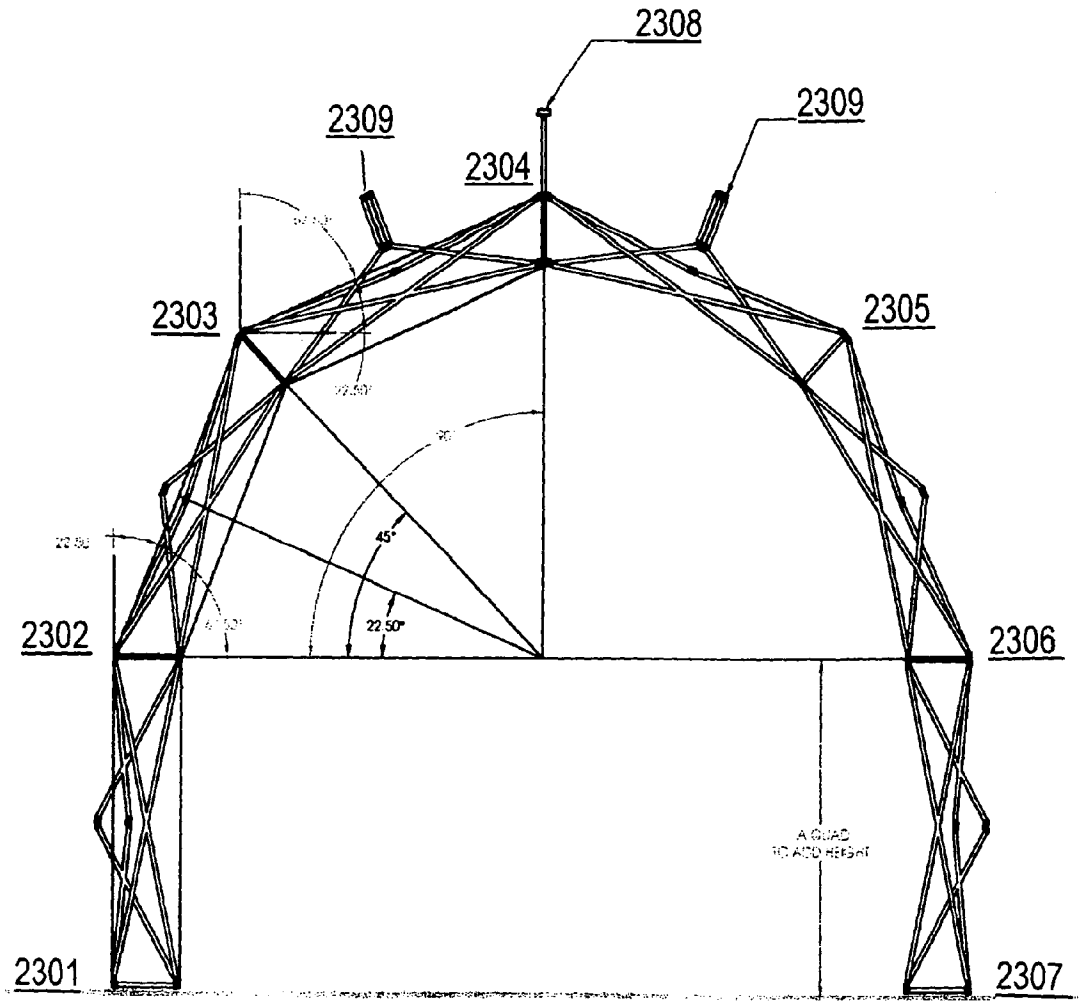
FIG. 23 is a front cross-sectional view of six assembled ABBBBA quads of the present invention forming a shelter along with a riser between two floating hubs.

BBABB Refer to FIGS. 17 and 23

Given: a length L The vertical and horizontal dimension of a strut.

Given: A full arch BBABB with four B Quads forming four isosceles triangles having an vertex angle of $180°/4=\theta_3$ and where $\theta_2=\theta_3/2$ and $\theta_1+\theta_2=90°$ or $\theta_1=(180-\theta_3)/2$ and connecting at the center with the A Quad.

Note: There are three center points for this configuration; one for each arch and the center with two different radii. Refer back to FIG. 2.

Therefore, one side or leg of the isosceles triangle $(x+d_1)$ is part of the total width of the shelter W and can be calculated as follows where:

$$W=L\times 2(d_1)$$

To find the distance $d_1$, bisect angle $\theta_3$ and form a right triangle at the base of the isosceles triangle dividing L into two part: L/2

Using the Law of Cosines where Cosine $\theta_1=L/2/(x+d_1)$ then, $$(x+d_1)=L/2/\text{Cos}\ \theta_1$$

To find the final $d_1$ we need to find x. And the distance x can be calculated from the law of Cosine where $\text{Cos}\ \theta_1=x/L/2$ and $x=L/2\ (\text{Cos}\ \theta_1)$ and therefore, Distance $d_1$ is found by subtracting x Likewise, the effective height of the interior is $h_1$. This is also a leg of the isosceles triangle so $h_1=d_1$.

Example 2

Figure 24:
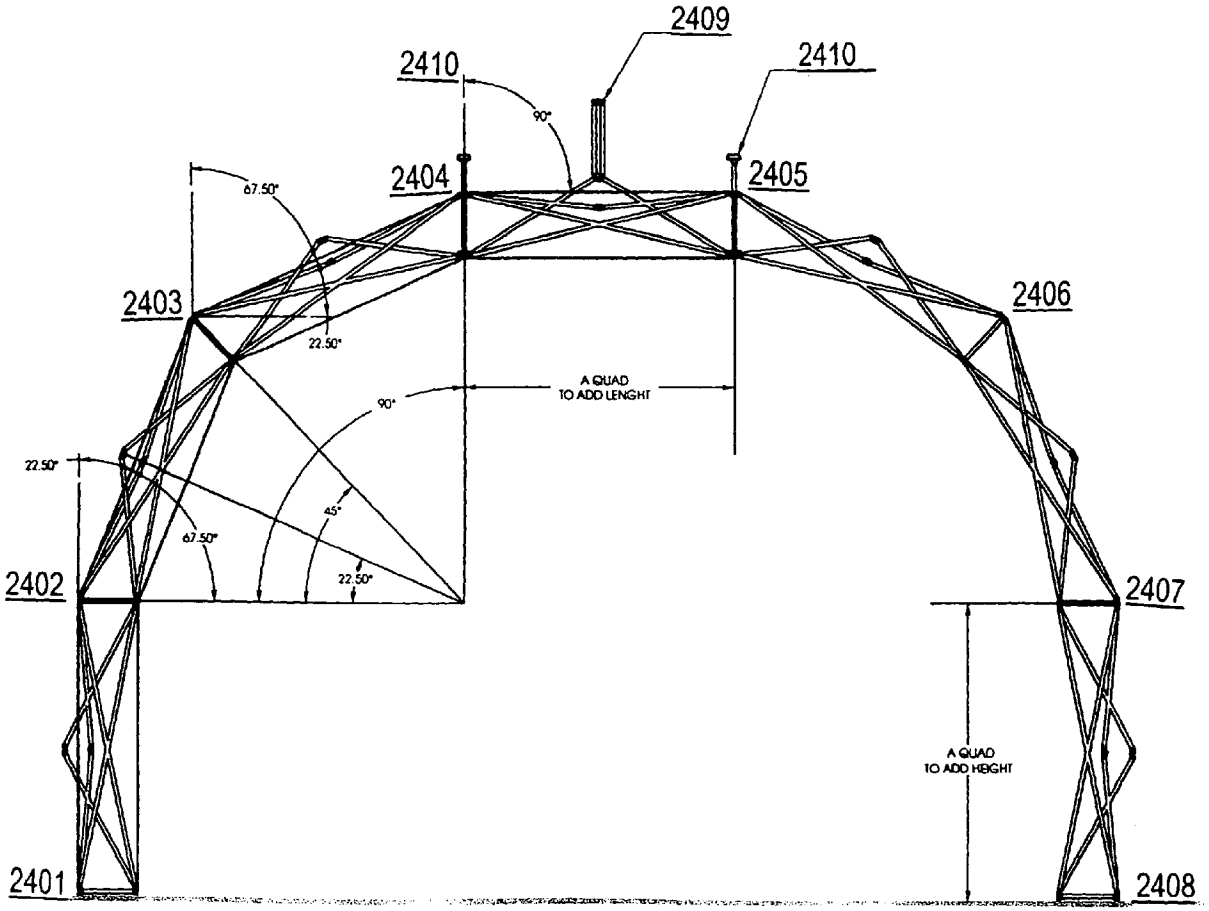
FIG. 24 is a front cross-sectional view of seven assembled ABBABBA quads of the present invention forming a shelter along with a riser between two floating hubs.

BBBBBBB: Refer to FIGS. 17 and 24

Given: A strut length L

Given: A full arch with all B Quads: BBBBBBB forming a semi-circle with seven Quads forming seven isosceles triangles each with a vertex angle of $180°/7=\theta_3$ and $\theta_1=(180-\theta_3)/2$ and $\theta_2=\theta_3/2$ Note: There is one center point. All seven isosceles triangles legs have the same radius.

$$W=2(d_1)$$

To find the leg $(x+d_1)$, bisect angle $Ø_3$ at the vertex and form a right triangle at the base of the isosceles triangle dividing L into two part: L/2 and L/2

Using Law of Cosines where $\text{Cos}\ \theta_1=L/2/(x+d_1)$ then

And $(x+d_1)=L/2/\text{Cos}\ \theta_1$

To find the effective distance $(d_1)$ we need to find x. And the distance x can be calculated where $\text{Cos}\ \theta_1=x/L$ and therefore $x=\text{Cos}\ \theta_1\ (L)$ and therefore the effective distance $(d_1)$ is less x To calculate the effective height $h_1$, which is less than the radius $d_1$, using the formula:

$\text{Sin}\ \theta_1=h_1/d_1$ and therefore $h_1=\text{Sin}\ \theta_1/(d_1)$

Example 3

ABABA: Refer to FIGS. 17 and 25

Given: A length L

The procedure to calculate height and width with this Quad configuration is similar to the previous examples. The added height is increased by a factor of L and the added width is increased by a factor of L.

The quads can be used to create almost any size structure. As depicted in the drawings FIGS. 18 to 25, the basic A and B quads can be connected together in various combinations to create an arch-like structure. Either of the quads can be any size depending upon the length of strut and the ratio of these lengths plus the positioning of the scissor point allowing the struts to articulate.

The quads, whether A or B comprise a substantially square structure having a base, two sides and a top. They are designated as an "A" quad or a "B" quad depending upon the location of the scissor points along the length of the struts of the subassembly, as explained in greater detail hereinafter. The struts used in a subassembly in the center of the quad contains four pairs of struts each pair having struts which are of different lengths. As a result, when the shelter containing the B quads is expanded, the scissored struts of different length in the subassembly cause the quad to pitch toward the horizontal plane from the vertical plane. The B quads provide an angular plane between each quad in the larger expanded assembly ranging generally from 25.7° to 45° degrees. This angular range allows the quads to rise/fall and curve to obtain the substantially arcuate shape which many of the embodiments possess.

The Shelter with Riser and Floating Hub

The preferred embodiment shelter structures are formed by securing the quads together end to end, i.e., base to top, etc. to form an elevated sequence of quads referred to as "a row." To provide the requisite area/volume within the interior of the shelter, the structures of the present invention are three dimensional, i.e. it has dimension along the X, Y and Z Cartesian axis. Thus the length of the shelter is a function of the number of rows of quads placed side by side. Placing a given number of rows side by side creates a sequence of quads normal to the row referred to hereinafter as a "column." In the case of two quads forming the shelter from a front view cross sectional perspective, the leading edge of the structure will assume the form of an inverted "V". (See FIG. 18.) If three quads BAB (See FIG. 19.) or five quads BBABB (See FIG. 21.) are used to form a shelter, the leading edge outlines of these various shelters will assume a truncated quasi-arcuate form due to the presence of an A quad in the center of the row. Others containing even numbers of quads in the row will assume a quasi-arcuate form as discussed in greater detail hereinafter. When a plurality of quads are used to form a row, the quads are disposed in a substantially arcuate (elevated) form in which adjacent quads share common end-defining pairs of crossed, pivotally connected struts.

Figure 1A:
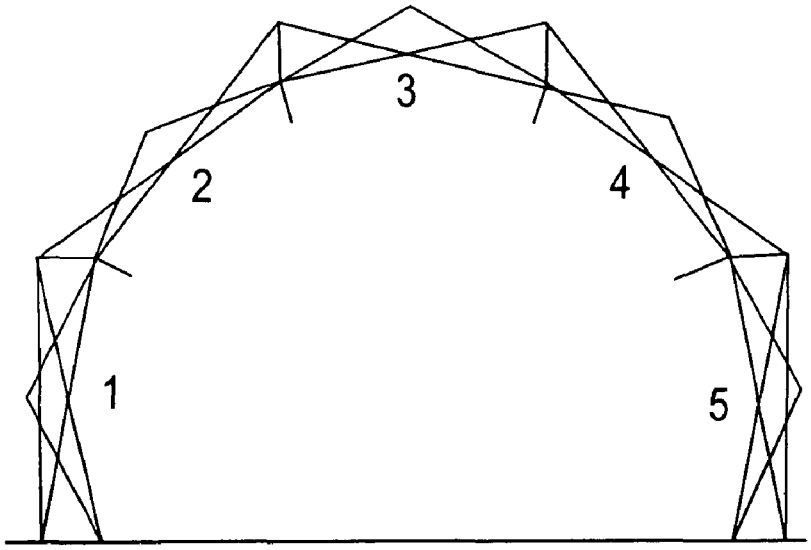
FIG. 1A Prior Art
FIG. 1A is a front-view cross-sectional representation of the perimeter outline of a deployable structure as found in the prior art.
Figure 1B:
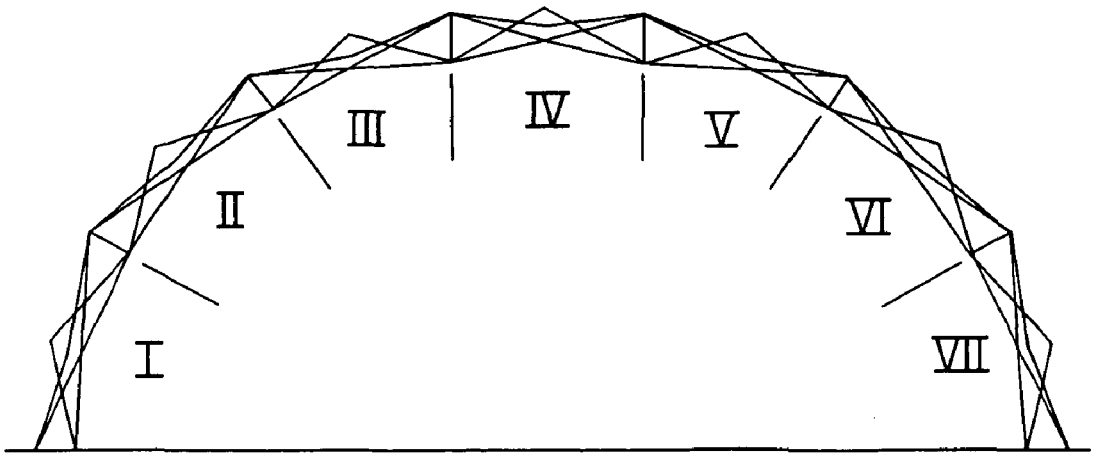
FIG. 1B is a front-view cross-sectional representation of the perimeter outline of the deployable structure of the present invention using the "J" hub.
Figure 2:
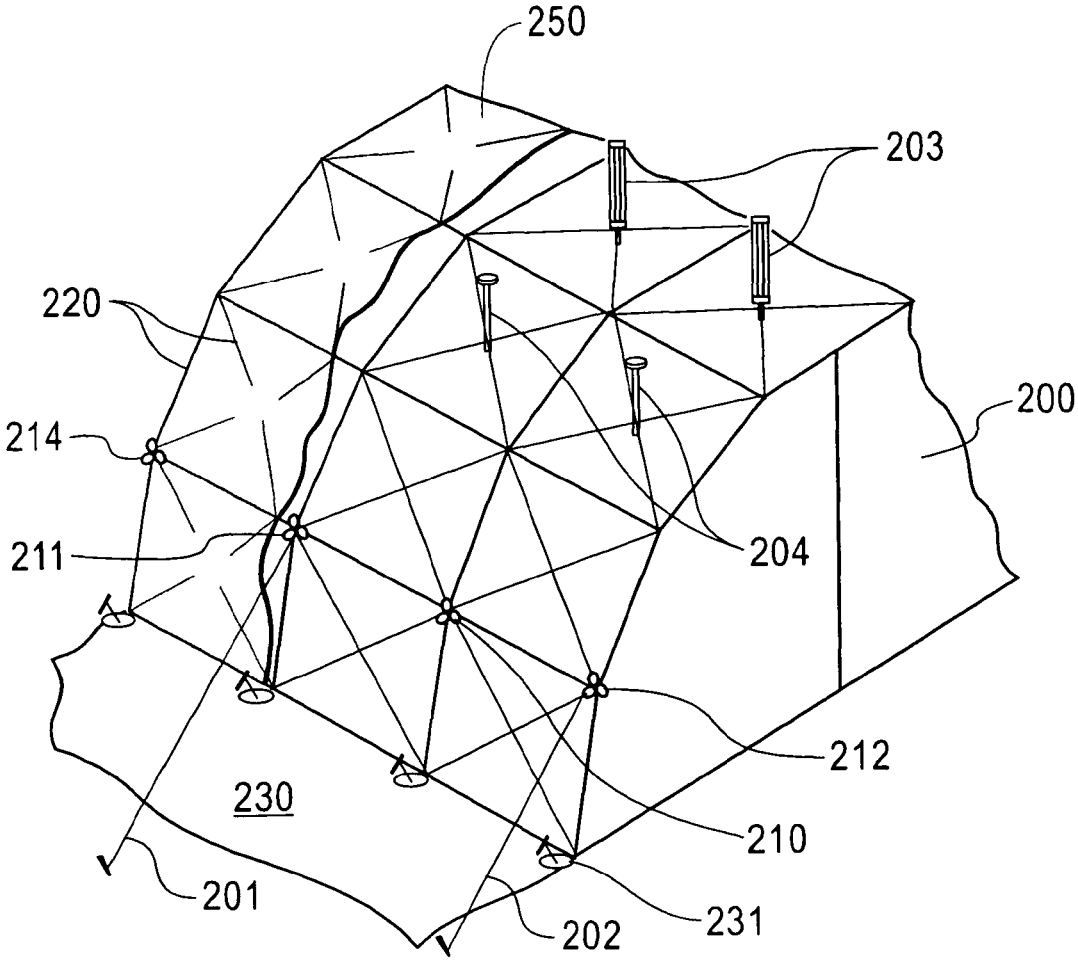
FIG. 2 is a cutaway schematic diagram of a portion of a portable shelter with floating hubs and risers.

FIG. 2 is a cutaway schematic oblique view of a portion of a BBBABBB portable shelter 200 with floating hubs 230 and 231, showing the arcuate arrangement of the quads along the horizontal and vertical axes. FIG. 2 depicts a portion of the deployment shelter covered with protective fabric 250, securing lines 201 and 202, attached to external loops 212 and 214 which are fixed to keepers 210 and 211. Risers 203 and floating hubs 204 are shown in place. External loops 210 and 214 are available to secure connect additional lines thereto if desired. The outline of the rectangular quads 220 formed by struts and hubs is depicted. The center hubs located within the square quads are not shown in this FIG. 2.

When a plurality of quads are coupled end to end as shown in FIG. 2, the first quad that is located on the planar surface or base 230 contains the base hubs located along line 231. The hub tops (not specifically shown) are located along the line joining 212 and 214 vertically above the base hubs connected by struts depicted in each square quad by the X that appears therewithin. The next quads above the first column in the sequence, depending upon the number of them, share hubs so that the top hubs of quad one in each row are the base hubs of quad two, and next above that, the top hubs of quad two are the base hubs of quad three, and so on for each quad in the chain that winds up and around until the hubs of the last quad of the row are located on the base planar surface in line with the hubs of the first quad.

Figure 3:
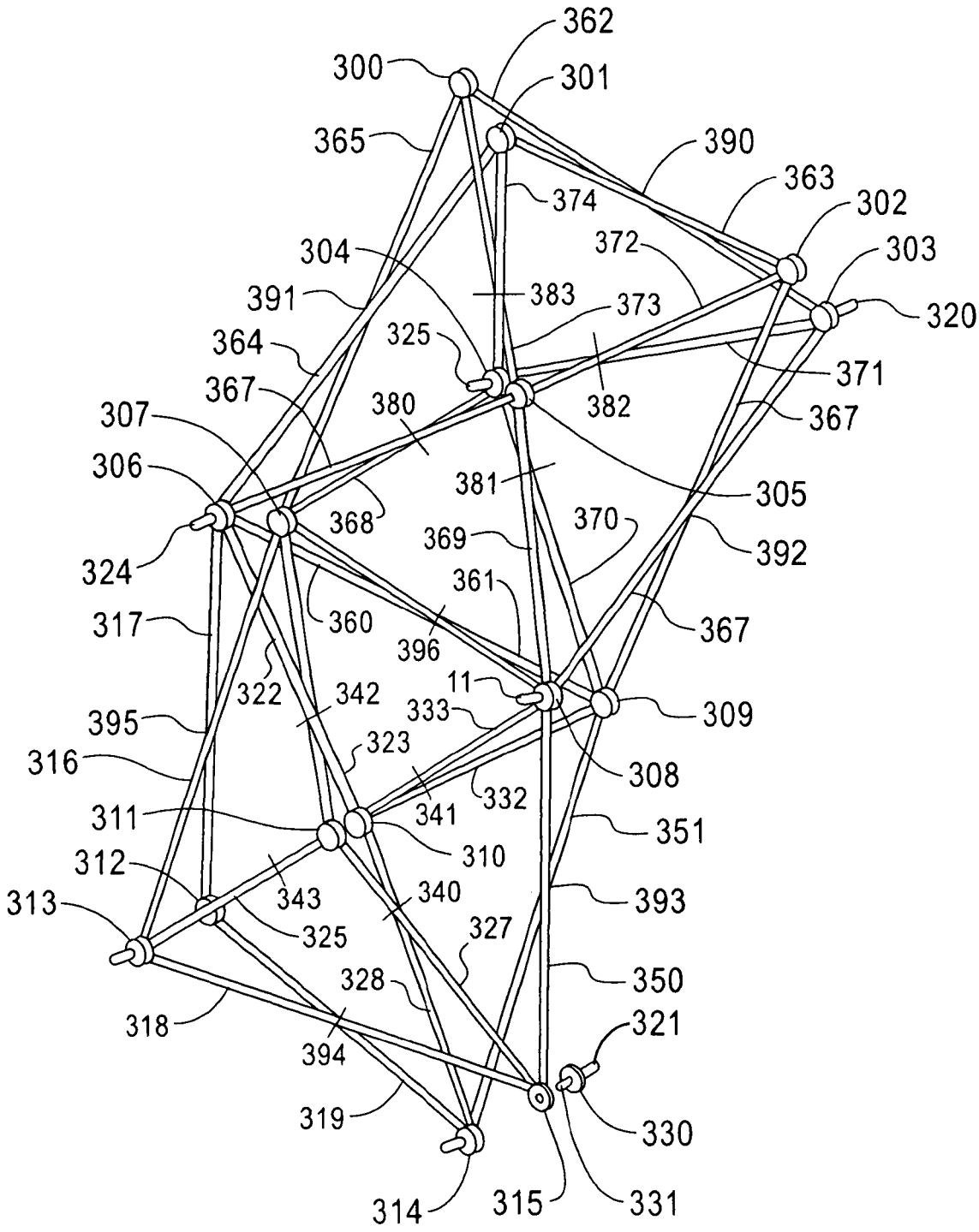
FIG. 3 depicts an oblique closeup view of an A quad and a B quad used to form the arcuate structure of the present invention.

FIG. 3 depicts an oblique closeup view of two of the seven quads used to form the arcuate form noted above showing the hubs and struts in their deployed positions. In the assembled shelter there is a plurality of articulating hub assemblies connected to tubular struts. Each quad possesses 8 articulating hub assemblies, wherein some of the articulating hub assemblies located at an end of the quad may be shared by the quad(s) located contiguous therewith. There are 4 sets of tubular struts, each set having a single flexible pivot or scissor point and a total of 8 diagonal struts wherein two diagonal struts are connected to an articulating hub assembly in the center of the quad.

More specifically, FIG. 3 depicts an illustration of a "B" quad secured to an "A" quad end to end, i.e., base to top, etc. to form an elevated sequence of quads secured end to end to form a quad. This is the arrangement that is found in a row wherein an arching B quad is connected to a straight A quad when it forms the horizontal section of the row. The term "exterior" as used herein when referring an articulating hub assembly expresses a face of said hub which is on the outside (facing the elements) of the quad assembly facing the exterior plane of the shelter to be covered with the exterior cover of the shelter. The term "interior" as used herein when referring an articulating hub assembly expresses a face of said hub which is on the inside (facing the interior of the shelter) of the quad assembly facing the plane to be covered with an interior cover used to form an interior "wall" of the shelter.

Referring to FIG. 3, the "A" quad is depicted as the top quad of the figure. The "A" quad depicted has a base, a pair of first and second exterior base side hubs aligned evenly in a vertical plane with respect to each other and a pair of first and second interior base side hubs aligned evenly in a vertical plane with respect to each other.

FIG. 3 depicts the "A" shelter as the top quad of the two quad structure with the "B" quad interconnected via shared articulating hubs 306, 307, 308 and 309, which quad "A" and quad "B" share. The arrangement depicted in FIG. 3 provides a detailed view of a BAB shelter obviously with a "B" quad missing. FIG. 3, depicting the arrangement of an "A" quad and a "B" quad is for illustrative purposes only and serves to detail the various struts and hubs and how the scissor points differ between the "A" and "B" quads. There are examples set forth hereinafter wherein the positions of the quads are reversed wherein the "A" quad is on the bottom or on contact with the planar surface (i.e. the ground or surface whereupon the shelter is struck) and the "B" quad is attached to the "A" quad via the exterior and interior articulating hubs which the "A" quad shares with the "B" quad.

In quad "A," at the top of FIG. 3, there is: a first exterior base side hub 306 and said first interior base side hub 307 being in substantial in-line alignment with respect to each other and a second exterior base side hub 308 and a second interior base side hub 309 being in substantial in-line alignment with respect to each other; and a first tubular strut 360 connecting said first exterior base side hub 306 with said second interior base side hub 309; and a second tubular strut 361 connecting said second exterior base side hub 308 with said first interior base side hub 307;

tubular struts 360 and 361 are adjacent to each other and extend diagonally at the base between the exterior side hubs 306, 308 and interior side hubs 307, 309 and being joined at a scissor point 396 substantially in the center of the length of each said strut.

The "A" quad has a top side comprising a pair of first 300 and second 302 exterior top side hubs aligned evenly in a vertical plane with respect to each other and a pair of first 301 and second 303 interior top side hubs aligned evenly in a vertical plane with respect to each other.

The first exterior top side hub 300 and the first interior top side hubs 301 are in substantial in-line alignment with each other; and the second exterior top hub 302 and said second interior top hub 303 are being in substantial in-line alignment with each other.

There is a third tubular strut 362 connecting the first exterior top side hub 300 with said second interior top interior hub 303; and a fourth tubular strut 363 connecting second exterior top hub 302 with first interior top side hub 301. Tubular struts 362, 363 are adjacent to each other and extending diagonally at top between said exterior top hubs 300, 302 and interior top hubs 301, 303 and are joined at a scissor point 390 substantially in the center of the length of each said struts 362, 363.

The first side of quad "A" comprises a pair of tubular struts 364, 365 adjacent to each other. A first first-side strut 364 extends diagonally between said first exterior base side hub 306 and said first interior top side hub 301, and a second first side strut 365 extends diagonally between first interior base side hub 307 and first exterior top side hub 300, said first side struts 364, 365 are joined at a scissor point 391 substantially in the center of the length of each said strut;

The second side of quad "A" comprises a pair of tubular struts 366, 367 adjacent to each other. A first second-side strut 366 extends diagonally between said second exterior base side hub 308 and second interior top side hub 303, and a second side strut 367 extending diagonally between second interior base side hub 309 and second exterior top side hub 302, the second side hubs being joined at a scissor point 392 substantially in the center of the length of each said strut.

The "A" quad further has a subassembly contained within the area defined by the top, base and sides thereof. The subassembly has a pair of center hubs 304, 305 comprising an exterior center hub 304 and an interior center hub 305 positioned substantially in-line substantially in the center of said quad with respect to each other, wherein four sets of two tubular struts each extend from said center hubs to said top and said base hubs.

The "A" quad subassembly includes four sets of struts which extend radially outward from each of the two center hubs and are connected to the hubs located at the base and top corners of the quad. In the lower left first quadrant of the subassembly, first center strut 367 connects first exterior base hub 306 to interior center hub 305 and second center strut 368 connects first interior base hub 307 to said exterior center hub 304, first and second tubular struts 367 and 368 being adjacent to each other and extending diagonally and being joined at a scissor point 380 substantially in the center of the length of first and second struts 367 and 368.

In the lower right quadrant of the subassembly, a third center strut 369 connects second exterior base hub 308 to interior central hub 305 and a fourth center strut 370 connects second interior base hub 309 to exterior central hub 304, the third and fourth tubular struts 369 and 370 being adjacent to each other and extending diagonally and being joined at a scissor point 381 substantially in the center of the length of the third strut 369 and said fourth strut 370.

In the upper left quadrant, there is a fifth center strut 373 which connects first exterior top side hub 300 to said interior center hub 305 and a sixth center strut 374 which connects first interior top side hub 301 to said exterior center hub 304, the fifth and sixth tubular struts 373, 374 are situated adjacent to each other and extend diagonally and are joined at a scissor point 383 substantially in the center of the length of said fifth and said sixth struts.

In the upper right quadrant of the "A" quad there is a seventh center strut 372 connecting said second exterior top side hub 302 to interior central hub 305 and an eighth center strut 371 connecting said second interior top side hub 303 to exterior central hub 304, the seventh and eighth tubular struts 371 and 372 being adjacent to each other and extending diagonally and being joined at a scissor point 382 substantially in the center of the length of seventh and eighth struts 371 and 372.

The "B" quad is virtually identical to the "A" quad with the exception of the location of the scissor points along the side elements and in the subassembly. The "B" quad has a base which is positioned on the planar surface, two sides and a top. The top of the "B" quad includes two exterior hubs and two interior hubs and a set of struts connecting these hubs elements.

Hubs 306, 307, 308 and 309 are examples of "shared hubs in that they serve functional purposes for both the A quad and the B quad. The term "shared hub" refers to an articulating hub (or hubs) whether exterior or interior, which secures struts forming the network of contiguous quads (See articulating hubs 306, 307, 308 and 309). The shared hub serves as a joint hub, for the sake of discussion, in the front or top end of one quad and the back or bottom end of another quad as well as receiving struts therein from quads forming arched rows which are adjacent to the hub. The shared hubs can rotate 180° about its vertical axis to allow the shelter to expand from collapsed to erected form.

FIG. 3 illustrates the quads disposed in the form in which adjacent quads share common end-defining pairs of crossed, pivotally connected struts.

Quad "B" has as its base, a pair of first and second exterior base side hubs aligned evenly in a vertical plane with respect to each other and a pair of first and second interior base side hubs aligned evenly in a vertical plane with respect to each other, First exterior base side hub 313 and said first interior base side hub 312 are in substantial in-line alignment with respect to each other and said second exterior base side hub 314 and said second interior base side hub 315 are in substantial in-line alignment with respect to each other.

At the base, a first tubular strut 318 connects first exterior base side hub 313 with second interior base side hub 315 and a second tubular strut 319 connects a second exterior base side hub 314 with first interior base side hub 312.

Tubular struts 318 and 319 are adjacent to each other and extend diagonally at the base between said exterior side hubs 313 and 314 and interior side hubs 312 and 315 and are joined at a scissor point 394 substantially in the center of the length of each strut.

The "B" quad has a top comprising a pair of first and second exterior top side hubs aligned evenly in a vertical plane with respect to each other and a pair of first and second interior top side hubs aligned evenly in a vertical plane with respect to each other. The top of the "B" quad also serves as the base of the "A" quad described above. The first exterior top side hub 306 and first interior top side hub 307 are in substantial in-line alignment with each other, i.e. the interior substantially behind the exterior hub; and said second exterior top hub 308 and said second interior top hub 309 are in substantial in-line alignment with each other.

A third tubular strut 360 connects the first exterior top side hub with said second interior top side hub and a fourth tubular strut 361 connects second exterior top hub 308 with said first interior top side hub 307. Tubular struts 360 and 361 are adjacent to each other and extend diagonally at said top between said exterior top hubs 306 and 308 and interior top hubs 307 and 309 and are joined at a scissor point 396 substantially in the center of the length of each strut.

A first side of the "B" quad comprises a pair of tubular struts 316 and 317 adjacent to each other, a first first-side strut 316 extending diagonally between said first exterior base side hub 313 and said first interior top side hub 307, and a second first side strut 317 extends diagonally between the first interior base side hub 312 and said first exterior top side hub 306, said first side struts 316 and 317 being joined at a scissor point substantially in the center of the length of each said strut.

A second side of the "B" quad comprises a pair of tubular struts 350 and 351 adjacent to each other, a first second-side strut 350 extends diagonally between said second exterior base side hub 314 and said second interior top side hub 309, and a second side strut 351 extends diagonally between said second interior base side hub 315 and said second exterior top side hub 308, said second side struts being joined at a scissor point 393 substantially in the center of the length of each said strut;

The "B" quad also has a subassembly contained within the area defined by top, base and sides of the quad. The subassembly has a pair of center hubs 310 and 311, comprising an exterior center hub 311 and an interior center hub 310 positioned substantially in-line (i.e. the interior hub substantially directly behind the exterior center hub) and substantially in the center of said quad with respect to each other. There are four sets of two tubular struts each extend from said center hubs to said top and said base hubs which are arranged as follows:

a) There is a first center strut 325 connecting first exterior base hub 313 to interior center hub 310, and a second center strut 326 (not shown due to overlay of strut 325 obscuring view) connecting said first interior base hub 312 to said exterior center hub 311. The first and second tubular center struts 325 and 326 in the subassembly are adjacent to each other and extend diagonally and are joined at a scissor point 343 substantially off-center of the length of said first and said second struts 325 and 326.

b) Third center strut 328 connects second exterior base hub 314 to said interior central hub 310 and a fourth center strut 327 connects second interior base hub 315 to exterior central hub 310. Third and fourth tubular struts 327 and 328 are adjacent to each other and extend diagonally and are joined at a scissor point 340 substantially off-center the center of the length of said third and said fourth struts;

c) A fifth center strut 323 connects first exterior top side hub 306 to said interior center hub 310 and a sixth center strut 322 connects first interior top side hub 307 to exterior center hub 311. The fifth and sixth tubular struts 322 and 323 are adjacent to each other and extend diagonally and are joined at a scissor point 342 substantially off-center of the length of said fifth and said sixth struts 322 and 323.

d) A seventh center strut 333 connecting second exterior top side hub 308 to interior central hub 310 and an eighth center strut 332 connects second interior top side hub 309 to said exterior central hub 311. The seventh and eighth tubular struts 332 and 333 are adjacent to each other and extend diagonally and are joined at a scissor point 341 substantially off-center of the length of said seventh and eighth struts 332 and 333.

The illustration of the scissor points in FIG. 3 in the subassembly of quad "B" as depicted as being "off center" is not drawn to scale.

Having described the structures of the A and B quads, preferred embodiments of the present invention can be developed from these two quads. An initial basic preferred embodiment utilizes two quads joined together in the manner depicted in FIGS. 18A-18C. Ideally, two B quads are connected together (BB). It is possible to join two A quads, but they would be almost flat to the ground with relatively little elevation; however, depending upon the intended use (i.e., covering field gear, etc.) they could be used effectively. The A Quads provide a 0 and 90° plane while the B Quads provide an angular plane moving from 25.7° to 45° degrees. The angle is determined by dividing the number of B Quads into 180°. This is achieved in the B quad by adjusting the scissor points (pivot points) connecting the struts from one inside to the other inside of the B Quads. All the strut lengths have a constant ratio and stay the same.

Thus, one can use a strut of any length to achieve specific width and height objectives. The wider the structure (i.e., the arch), the more critical is the diameter and strength (hence more weight) of the tube that forms the strut.

FIG. 3 shows the positioning of end hubs 300, 301, 302, 303, 306, 307, 308, 309, 312, 313, 314 and 315. It further depicts the locations of hubs 304, 305, 310 and 311 located in the center of the square quad. The hubs all have threaded openings through their centers which can accommodate mushroom shaped "keepers," an example of which is shown as 330 with the threaded extension at 331 with external loops 321. Threaded element 331 and keeper 330 threadedly secure the canvas fabric covering the strut matrix to the hub, and provide a means to anchor the shelter to a convenient ground surface. Keepers with external loops, such as denoted at 308, 313, 314, 320 all serve to secure the cover in place over the matrix.

Figure 4:
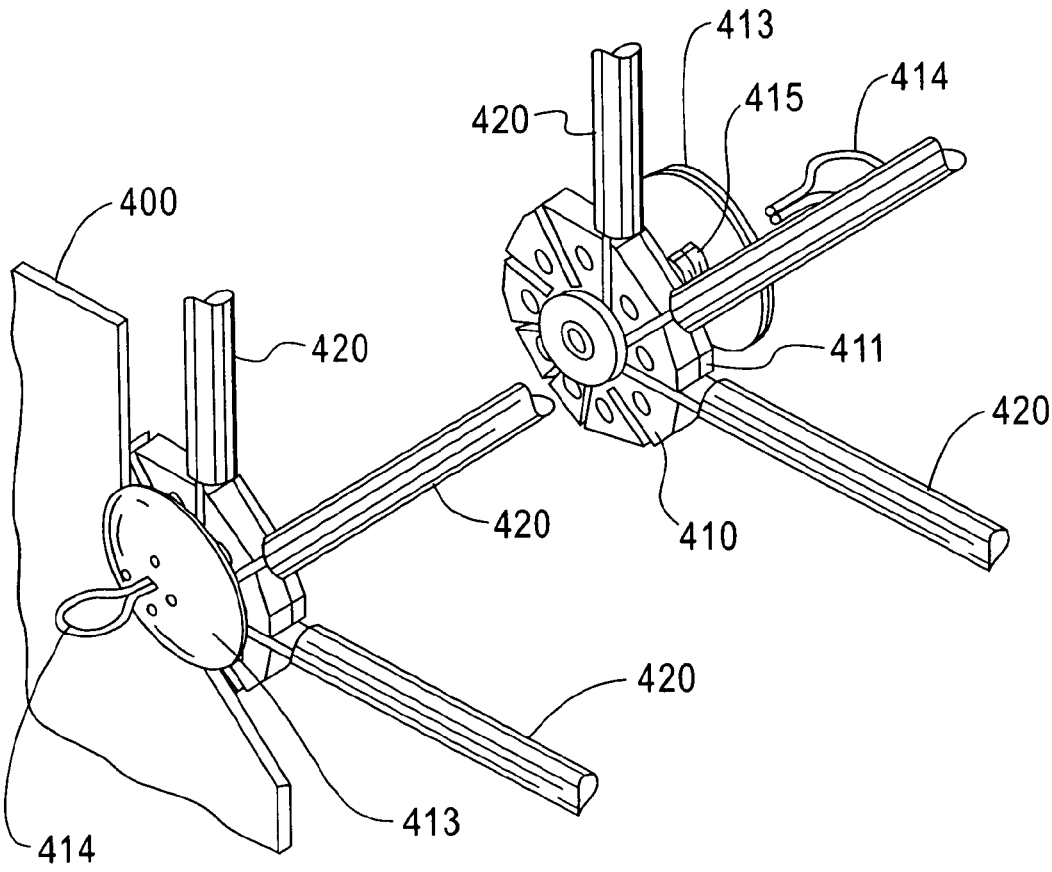

FIG. 4 is an exploded view of a portion of the quad depicted in FIG. 3 showing the spatial relationship of the interior side of hub 410 with its superior side 411, tubular struts 420, fabric 400, keeper component 413 and external loop 414. This is a closeup view of the hubs and struts which form the quads depicted in FIG. 3.

Figure 5:
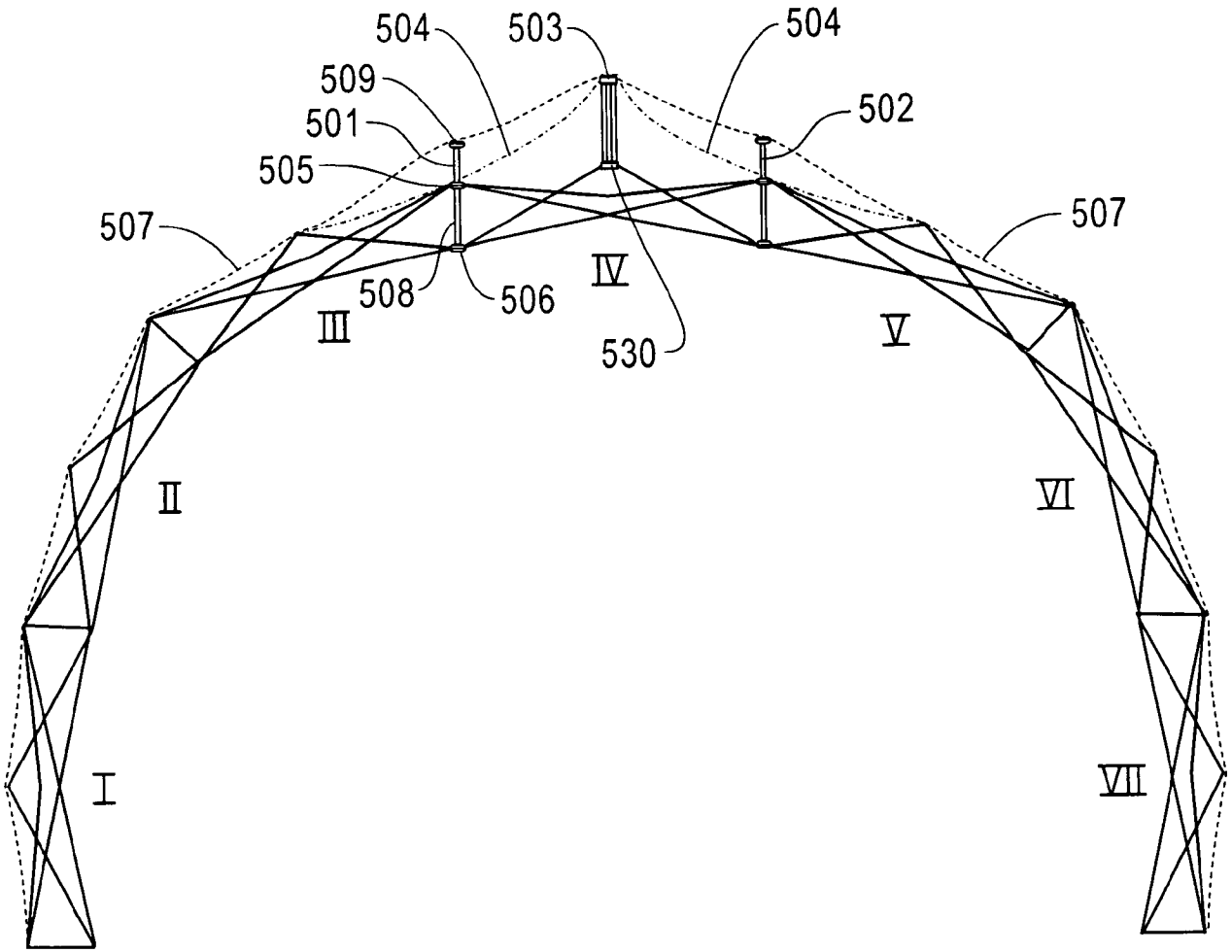
FIG. 5 depicts a front cross sectional view of an erected shelter assembly formed from seven quads.

FIG. 5 depicts a front cross sectional view of an erected shelter assembly 500 of the present invention without the end assembly section arch. This is an ABBABBA shelter. There are seven quadrants depicted extending counterclockwise from Ito VII. Quads I, IV and VII are A quads and quads II, III, V and VI are B quads. The connection of these quads "A" and "B" is shown in FIG. 3. FIG. 5 includes floating hub assemblies 501 and 502. In the center of the structure is a riser 503 located at the top center of shelter assembly. The prior art version of the assembly would not include the floating hub but instead includes partially shown fabric covering 504, which would be connected at riser 503 and to one of the articulating hub assemblies (of the type described in the Prusmack references cited above) positioned at 505. And therein lies the problem. With the occurrence of rain or snow, the fabric, extending downward from riser 503 would eventually start to sag under the weight of same. As a result of the sagging condition, a dangerous trough eventually would form on the fabric cover allowing water or ice to collect and thereby exceeding the mandated weight load of 10 lbs/ft$^2$ for such structures at the location in question.

FIG. 5 depicts two floating hub assemblies 501 and 502 of the present invention. For the purpose of discussion of this FIG. 5, reference is made only to 501, however the information applied to 501 applies equally as well to 502 and other floating hubs not shown. The base 506 of the floating head assembly is attached to a connecting rod 508 which slides through a center opening in articulating hub assembly 505. Articulating hub 505 provides a platform for the floating hub to move concurrently up and down as it moves up upon expansion or down upon retraction of the shelter. At the opposite end of the base of the floating hub assembly and attached to connecting rod 508 is top 509. Fabric 507 is attached to riser 503 and to top 509 of the floating hub. As shown in FIG. 5, the floating hub unit of base 506, connecting rod 508 and top 509 creates an extended point to attach the fabric cover and form a tight downwardly sloped surface allowing rain, ice and snow to slide off the top of the shelter assembly and down the sides.

In viewing the structure depicted in FIG. 5, sloped quads (II and III and V, VI), two on each side of the structure which extend upwardly form vertical A quads to join and be fixedly attached to horizontal quad IV which is parallel to the ground/base beneath it. In the center of flat quad IV is riser 503. The structure is generally erected outdoors and is thus exposed to the elements. The geometry of quads III through V dictate that rain water, or snow will descend down the sides of fabric covered quads. Because quads III and V have little slope associated with each of them with the riser and cover in place, they will tend to collect rain/snow and eventually sag under the weight of the rain or snow. Riser 503 is situated in the center of quads III and V to provide an apical plane above quads III and V so that the rain or snow will not collect on the surface of the fabric above quads III and V. In the past, the fabric covering quads III and V beneath riser 503 would eventually collect rain water or snow since there was a substantial distance between the top of riser 503 and points down slope of the deployed structure. The floating hubs 501 and 502 of the present invention provide a smooth upward transition on the fabric surface of the deployed structure so forming a taut surface so that no rain or snow collects above quads III and V.

Figure 6A:
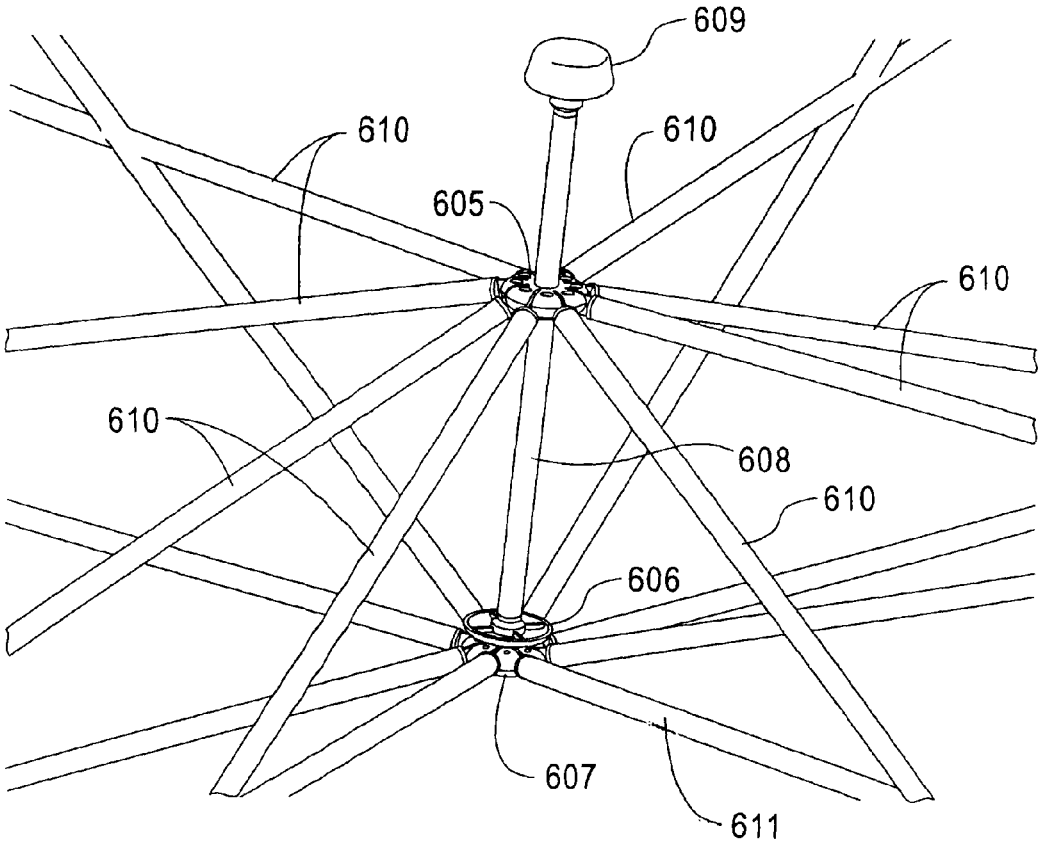
FIG. 6A is a magnified oblique view from the top of the floating hub as it appears when the structure is fully erected as shown in FIG. 5.

FIG. 6A is a magnified oblique view of the top of the floating hub as it appears when the structure is fully erected (as shown in FIG. 5). Base 606 is attached to connecting rod 608 which upon expansion of the shelter has slideably passed through the center opening in articulating hub 605. Top 609 is attached to connecting rod 608 at the end opposite of base 606. Base 606 rests upon articulating hub assembly 607 which is elevated into contact with the underside of base 606 during the procedure of raising the shelter assembly into an erected state. FIG. 6A also shows the struts 610 which are connected to hub 605 and struts 611 which are connected to hub 607. Before the shelter is set up in place, hub 607 is position at the bottom of the bundled assembly. When the assembly is set up, hub 607 is raised until it comes in contact with base 606 and upon further set up procedure, hub 607 pushes the floating hub assembly into position above the top plane of the shelter.

Figure 6B:
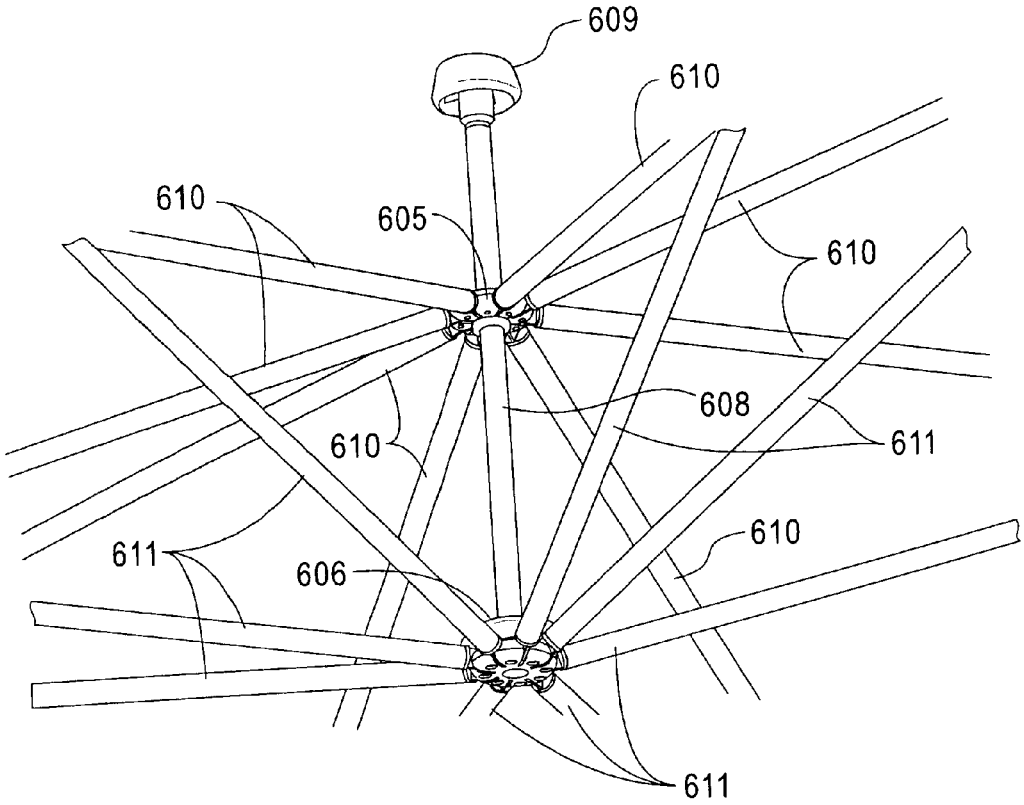
FIG. 6B is a magnified oblique view from the bottom of the floating hub as it appears when the structure is fully erected as shown in FIG. 5.

FIG. 6B is a magnified oblique view from a different vantage point of the same assembly depicted in FIG. 6A. Base 606 is attached to connecting rod 608 which has slideably passed through the center opening in articulating hub 605. Top 609 is attached to connecting rod 608 at the end opposite of base 606. Base 606 rests upon articulating hub assembly 607 which is elevated into contact with the underside of base 606 during the procedure of raising the shelter assembly into an erected state.

More specifically, with respect to the collapsed network of tubular struts, assemblies, etc. laid out prior to erection, when manual upward pressure is applied at 90° (i.e., perpendicular) to the ground at specific location on the network, multiple hub assemblies are displaced from positions physically contacting the ground to specific elevated positions above the ground. The upward vertical force creates an action that moves the articulating hub assemblies from a static position to a tension position and forms a structure of interconnected struts and articulating hub assemblies that is self-supporting. The resultant structure has four physical sides. The size and the shape of the structure can vary based upon the length of the struts and the location of scissor points.

To collapse the frame to its original position on the ground, simultaneous and opposing forces are applied on each of the four sides of the structure, 180° to each other and 90° to the vertical (along the 0° or X-axis), to specific articulating hub assemblies.

This action allows the tubular strut to move from a tension position with the assemblies above ground, back to a static position and collapse down to the original location on the ground.

The appropriate diameter of the hub is a function of the size of the deployable structure to be assembled as discussed. The hubs are of different sizes depending upon the dimension of the shelter in which they are used. One embodiment of a hub has an octagonal shape which allows larger diameter tubular struts of 1 inch or greater which are fixed in the slots in the hub to rotate when erecting or collapsing the structure.

Accordingly, in one embodiment, the slots in the hubs in such case, which allow the tubular struts to be secured in the hub are offset at a 45° angle so that the struts easily fold in on themselves and provide a compact bundle for storage or expand easily for a quick set-up.

Figure 7:
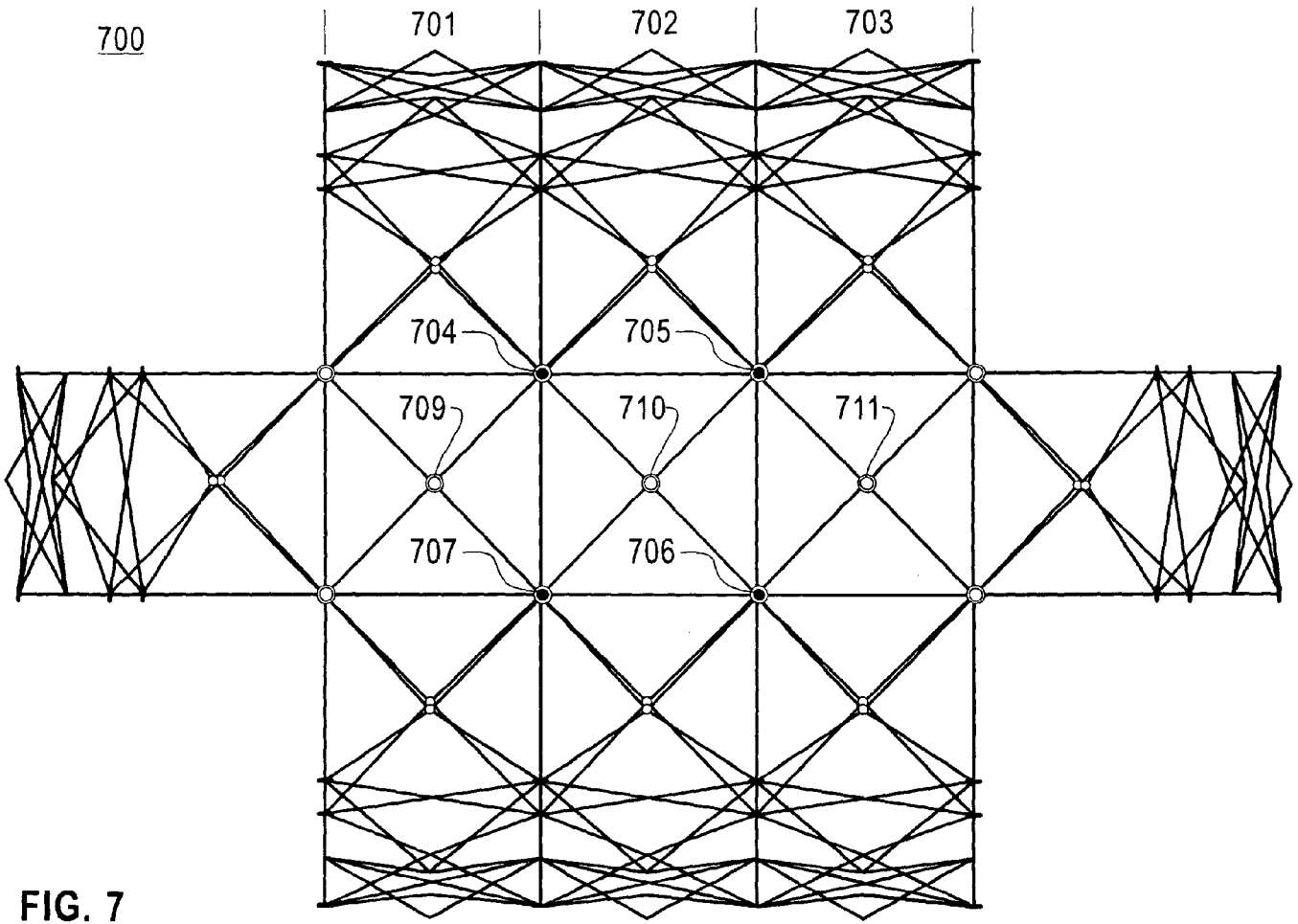
FIG. 7 is a top view of a shelter of the present invention fully erected.
Figure 8:
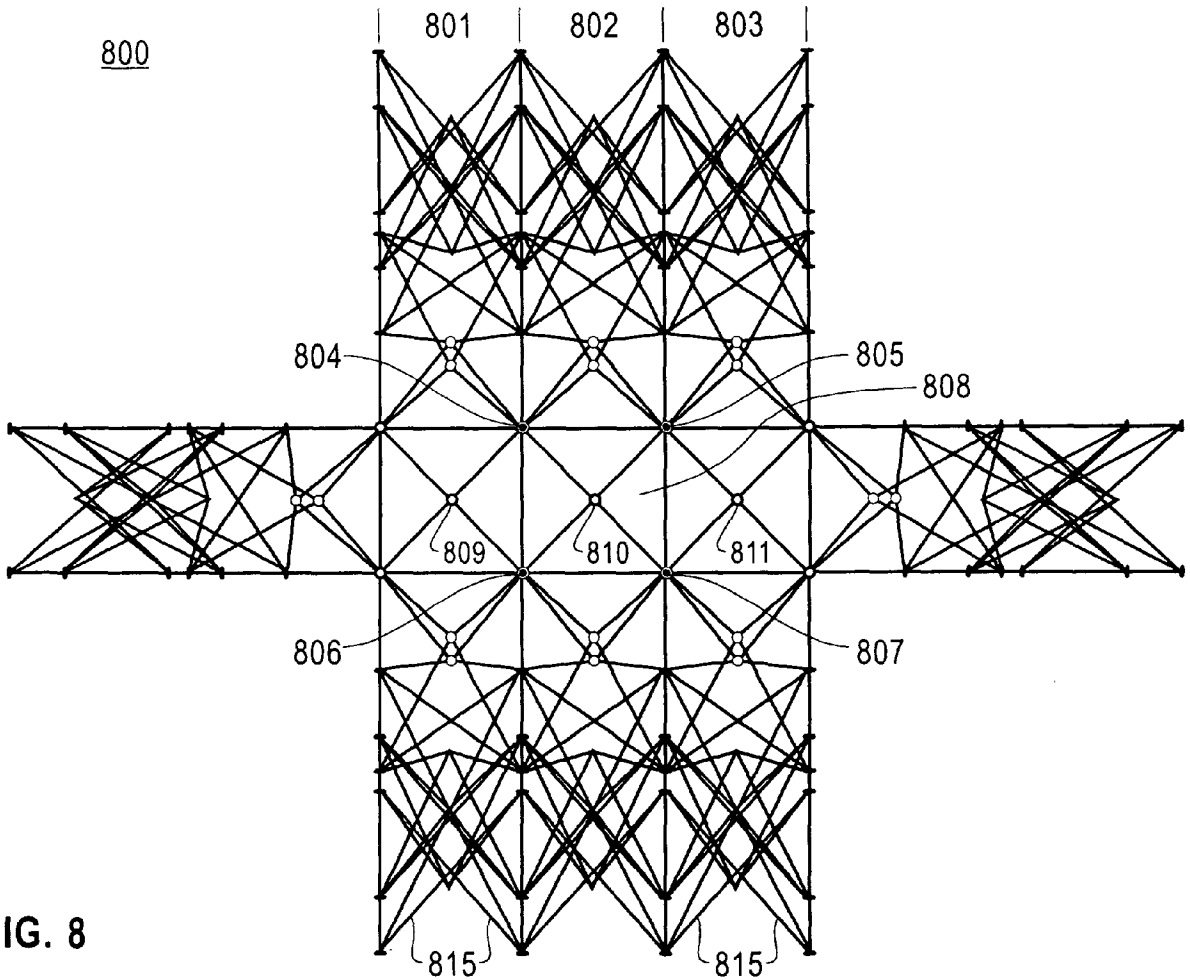
FIG. 8 is a top view of the shelter depicted in FIG. 7 partially erected.

FIG. 7 is a top view of the shelter 700 of the present invention fully erected. As noted above, the shelter structure of the present invention is formed from quads wherein a four sided rectangular or square section in combination with others form an arch. Arches 701, 702 and 703 comprise three interconnected arches of seven quads each forming three separate rows. Viewing from the top along the horizontal plane, the individual interconnected quads located side by side (in this case three quads each) form a column. In FIG. 7 floating hubs, 704, 705, 706 and 707 are located at the apexes of center quad 708 located in center arch 702. Risers 709, 710 and 711 are positioned in the center quad of each arch. According to the present invention, the number of floating hubs (F) for an erected shelter is determined using the formula: $F=2(A-1)$ wherein A=the number of arches (rows). In the shelter depicted using the formula given, the number of floating hubs is 4 which number is calculated by inserting the number of arches depicted and doubling the resultant number: $2(3-1)=4$ FIG. 8 is a top view of the shelter 800 of the present invention partially erected. As noted above in the description accompanying FIG. 7, the shelter structure is formed from quads to form an arch. Arches 801, 802 and 803 each comprise seven interconnected quads connected to form an array (column) of arches three deep. The struts 815, depicted in FIG. 8, by way of illustration, are not fully extended and are folded back on the hubs.

Figure 9:
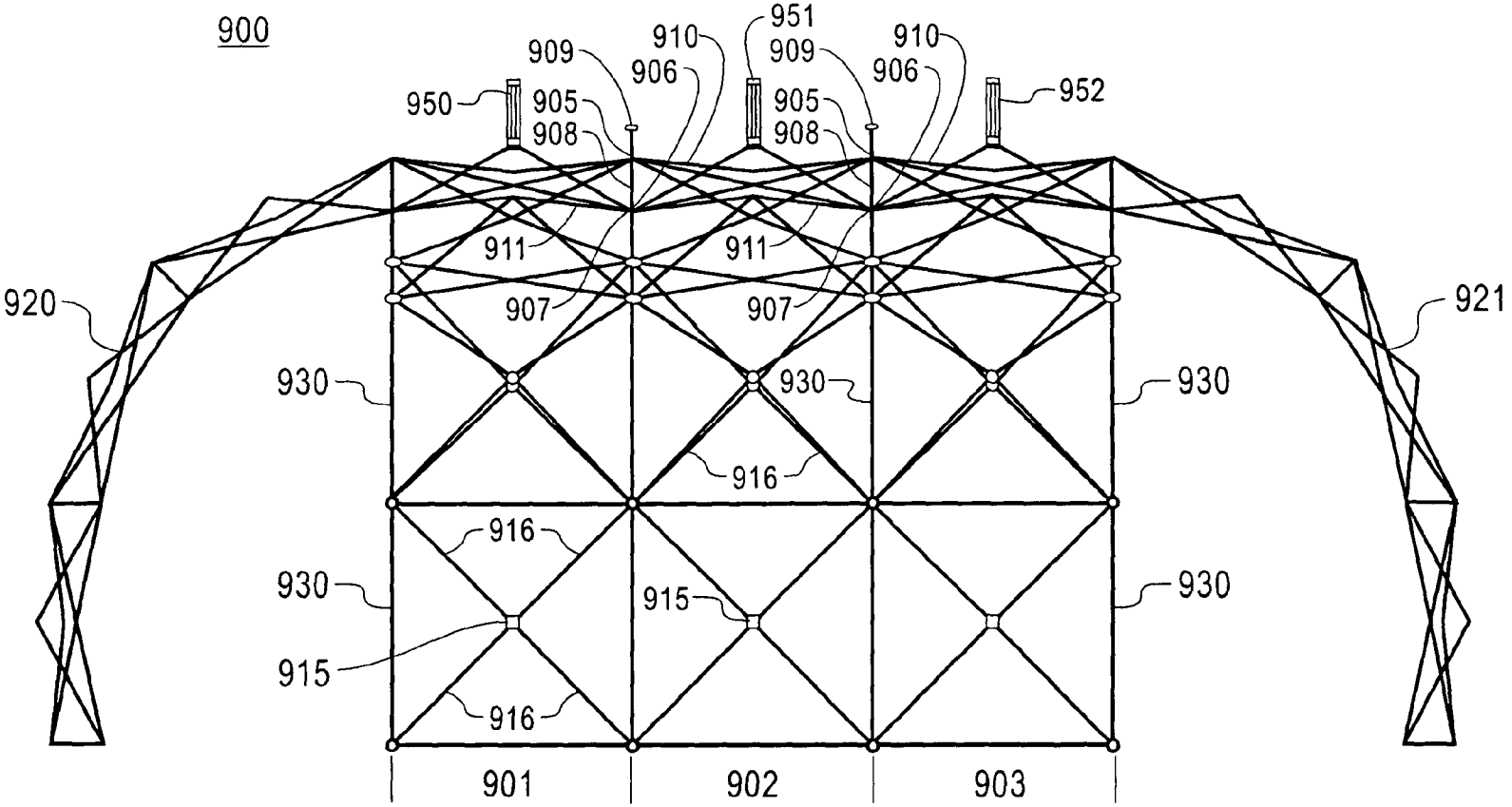
FIG. 9 depicts a side view of a deployable shelter comprising a plurality of quads and showing end sections

FIG. 9 depicts a side view of a deployable shelter 900 comprising a plurality of quads 930 and end sections 920 and 921 having articulating hub assemblies 915 connected to tubular struts 916 together forming the matrix upon which the fabric cover (not shown) rests and to which it is secured. End sections such as 920 and 921 are not required for frame/shelter support. The end sections are used to form four means of ingress/egress to and from the shelter depicted in FIG. 9, as opposed to two means of ingress/egress present in shelters without end sections. FIG. 9 depicts three arched rows 901, 902, 903 of quads positioned and fixed side by side. Although three arches are shown in the drawing comprising the structure, there can be as many arches side by side as desired, i.e., columns, depending upon the size and volume of the building desired. FIG. 9 shows a fully erected shelter with floating hub assemblies with the bases 906 resting on hubs 907 and connecting rods 908 extending upward through hubs 905 attached to top 909 with struts 910 fixedly secured into hub 905 and struts 911 fixedly secured into hub 907. The tops 909 of the floating hubs are in their appropriate place in a downward sloped plane below and beneath risers 950, 951 and 952. In the particular embodiment depicted in FIG. 9, there are two other floating hub assemblies (not shown) positioned on the opposite top side of the shelter. When the fabric cover (not shown) is placed over the exterior of the structure, risers 950, 951 and 952 form an apex with respect to the neighboring tops of the floating hub so that rain or snow will descend down the sides of the fabric secured to the matrix of quads and will drain off by gravity and will not be collected on the top of the structure.

Figure 10:
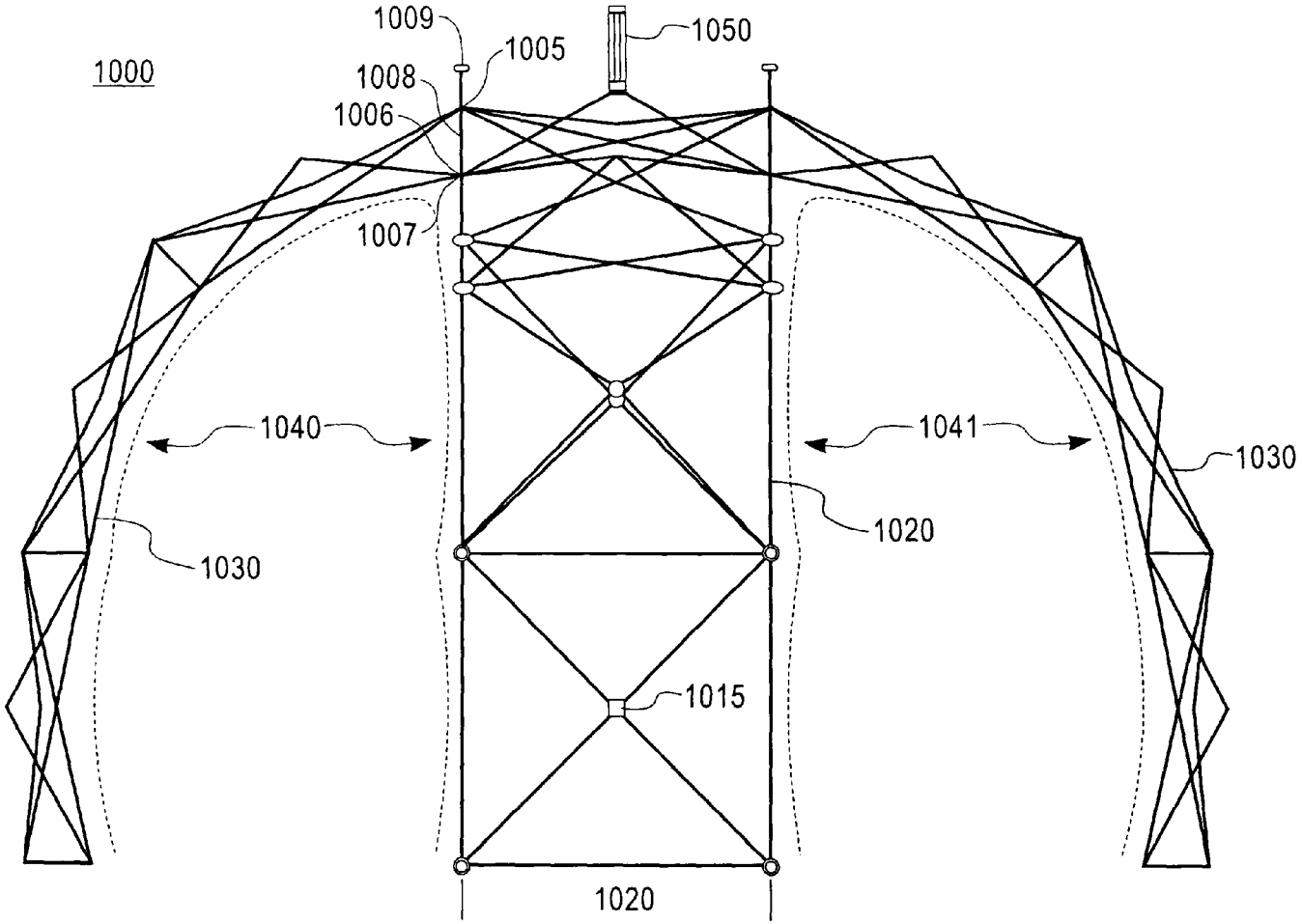
FIG. 10 depicts a cross sectional view of end of the deployable shelter of the present invention showing risers, floating hubs and end arches.

FIG. 10 depicts a cross sectional end view of the deployable shelter of the present invention showing the end arch 1020 showing only quad 1030. FIG. 10 depicts the floating hub assemblies with integrated frame, showing top 1009 the stopper hub assembly 1005 connecting rod 1008 and base plate 1006 resting on hub 1007. Riser 1050 extends above the tops 1009 of the floating hub assembly. The areas denoted 1040 and 1041 are covered with fabric and are ports of ingress to and egress from the shelter and have means associated with them to open and close the doorways. The dotted lines adjacent 1040 and 1041 represent the cover of the shelter. Hubs as illustrated at element 1015 and struts as illustrated at 1030 comprise the balance of the assembly.

Thus far, the fully erected deployable shelter has been described. The objective in developing a deployable shelter is to possess the capability to swiftly erect a portable building that could serve many functions in time of war at the battlefront or at the site of a natural disaster anywhere in the world, or for any other reason.

Figure 11:
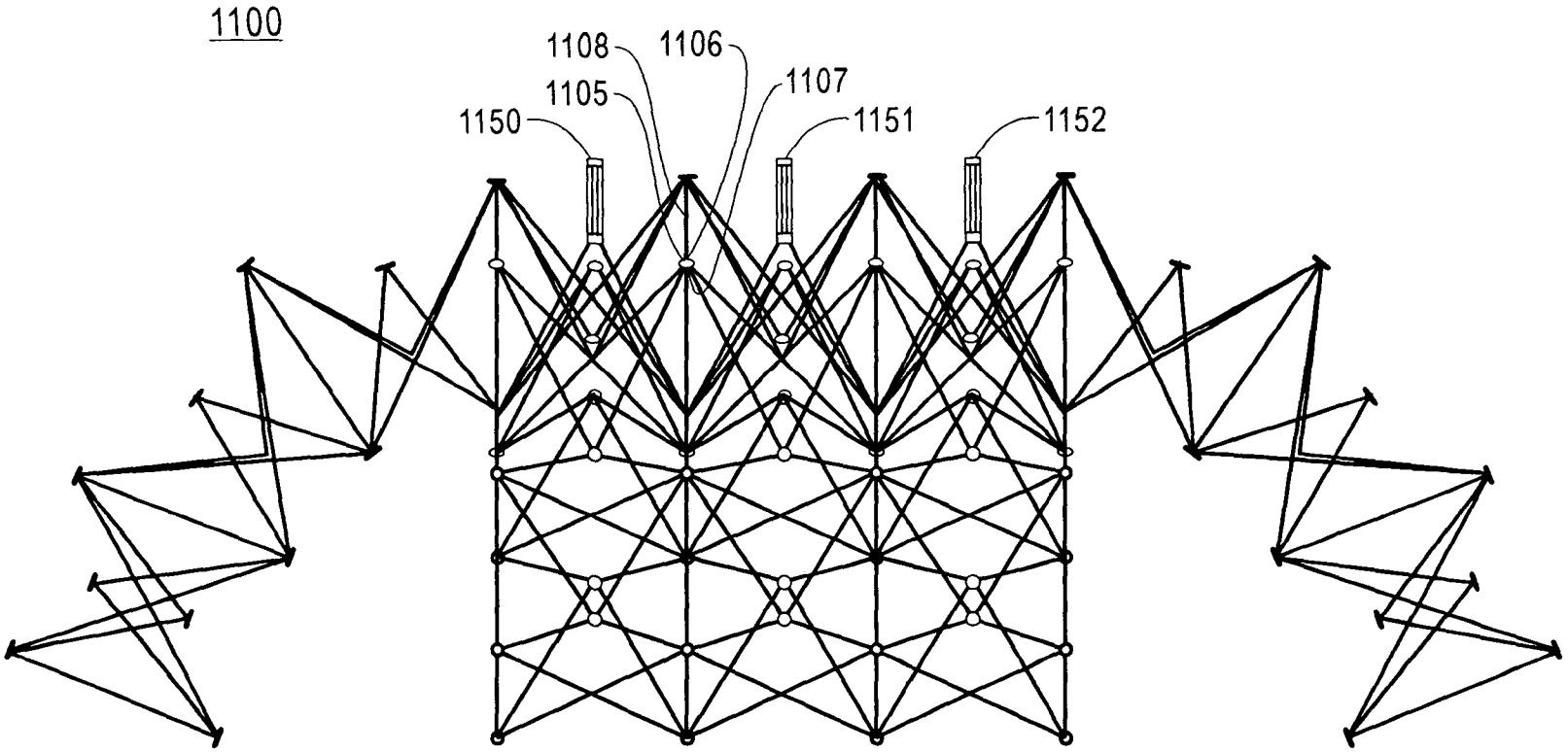
FIG. 11 depicts a side view of a partially erected deployable shelter showing the positioning of the tops of the risers.

FIG. 11 depicts a side view of a partially erected deployable shelter showing the positioning of the tops of risers 1150 1151, 1152, with respect at that stage to the tops 1109 of the floating hubs. The deployable shelter is shown in an intermediate stage of being set up. FIG. 11 depicts the floating hub assemblies with integrated frame, showing top 1109 the stopper hub assembly 1105 connecting rod 1108 and base plate 1106 resting on hub 1107. Risers 1150, 1151 and 1152 are substantially even with tops 1109 of the floating hub assembly. Articulating hub assemblies which as stated above connect the struts together to form the frame, push up the base 1106 and connecting rod 1108 of the floating hub so that points A the bottom of top 1109 and B the upper surface of hub 1107 will have a distance between them. During set-up, simultaneously, elements base plate 1106, connecting rod 1108 and top 1109 comprising the floating hub assembly rise since they are all elevated by the upward movement of hub 1107.

Figure 12:
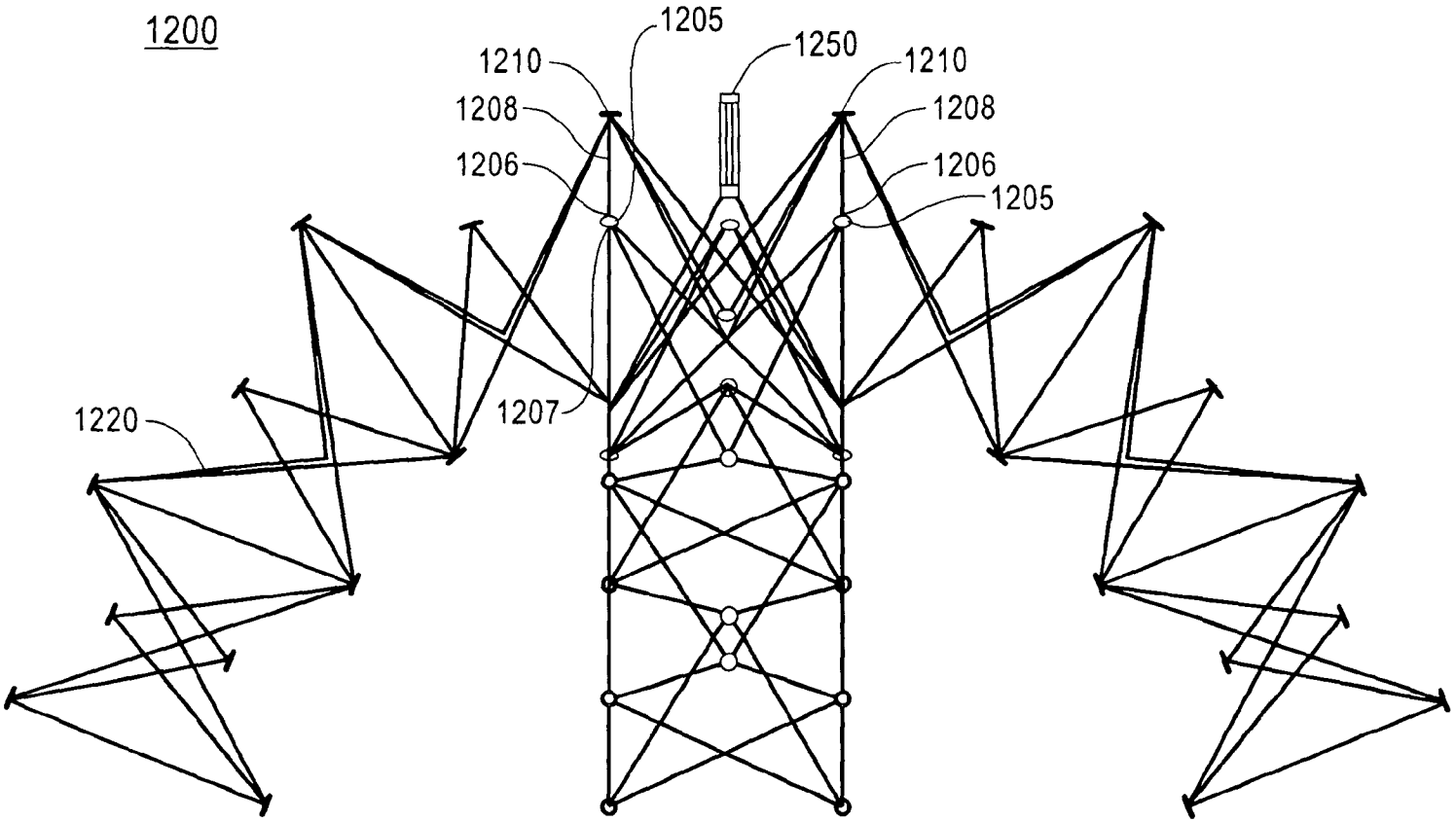
FIG. 12 depicts an end view of the shelter partially erected with the end structure attachment.

FIG. 12 depicts an end view of the shelter partially erected with the end structure attachment. The elements, such as hubs and struts comprising the shelter are as has been described hereinabove, the contents of which are hereby incorporated by reference herein. The struts in the configuration shown in FIG. 12 are being folded toward the vertical plane. The nature of the hub design allows the struts to flex through 180° arc so that they are easily moved from a compact upright vertical position in storage to a more arcuate horizontal plane when the shelter is fully erected.

FIG. 12 depicts the floating hub assemblies with integrated frame, showing top 1209, the stopper hub assembly 1205 connecting rod 1208 and base plate 1206 resting on hub 1207. Riser 1250 is substantially even with tops 1209 of the floating hub assembly. Articulating hub assemblies which as stated above connect the struts together to form the frame, push up the base 1206 and connecting rod 1208 of the floating hub so that points A the bottom of top 1209 and B the upper surface of hub 1207 will have a distance between them when the assembly is fully erected. During set-up, simultaneously, elements base plate 1206, connecting rod 1208 and top 1209 comprising the floating hub assembly rise since they are all elevated by the upward movement of hub 1207.

Figure 13:
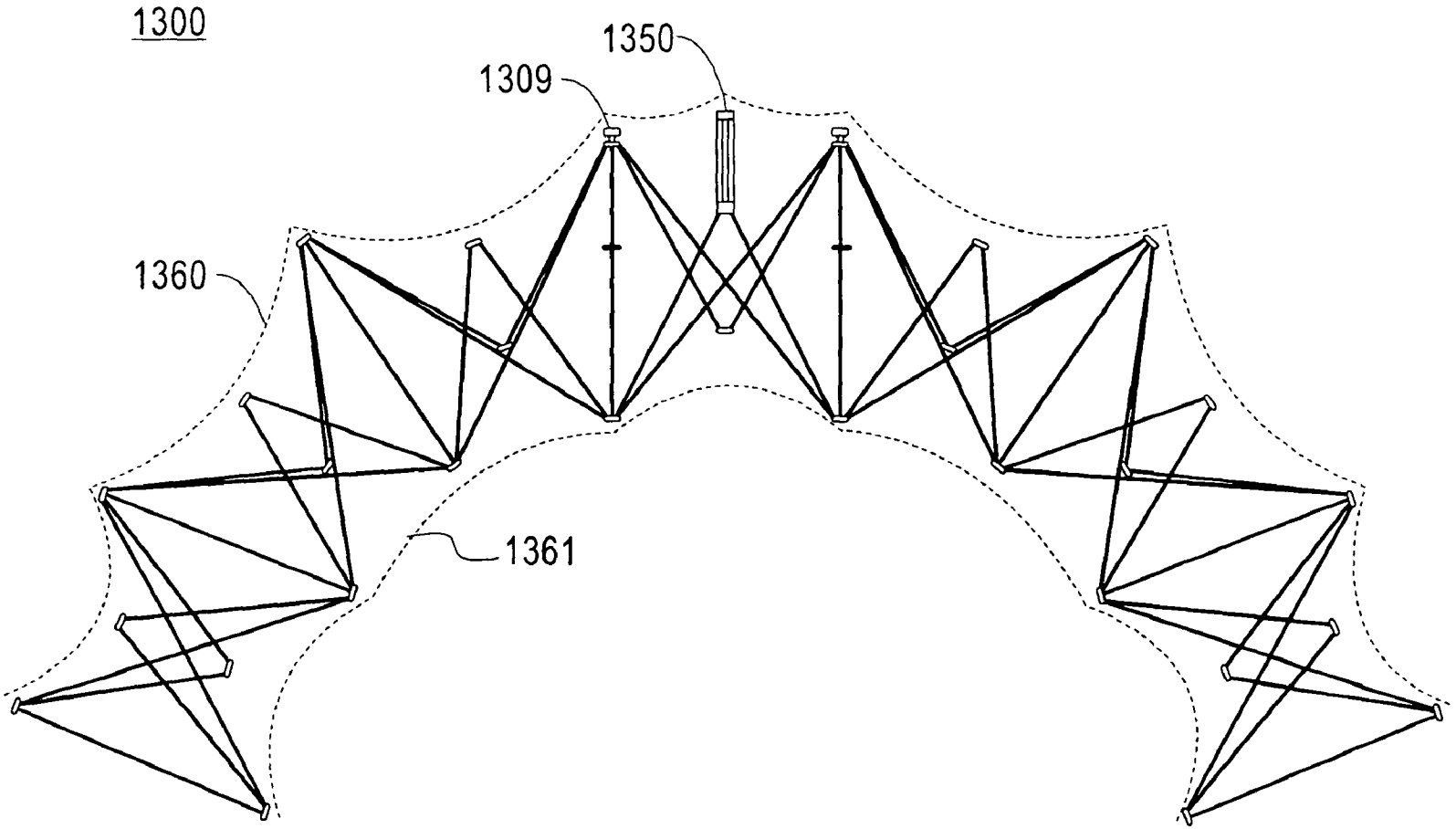
FIG. 13 depicts a side view of the shelter of the present invention which is depicted in an intermediate set up stage.

FIG. 13 depicts a side view of the shelter of the present invention which is depicted in an intermediate set up stage. The depiction is similar to that shown in FIG. 12 with the exception that fabrics 1360 and 1361 are affixed to the hubs. These elements form the exterior covering for the shelter and the interior wall of the shelter. The tops 1309 of the floating hub and riser 1350 are at substantially the same height.

Figure 14:
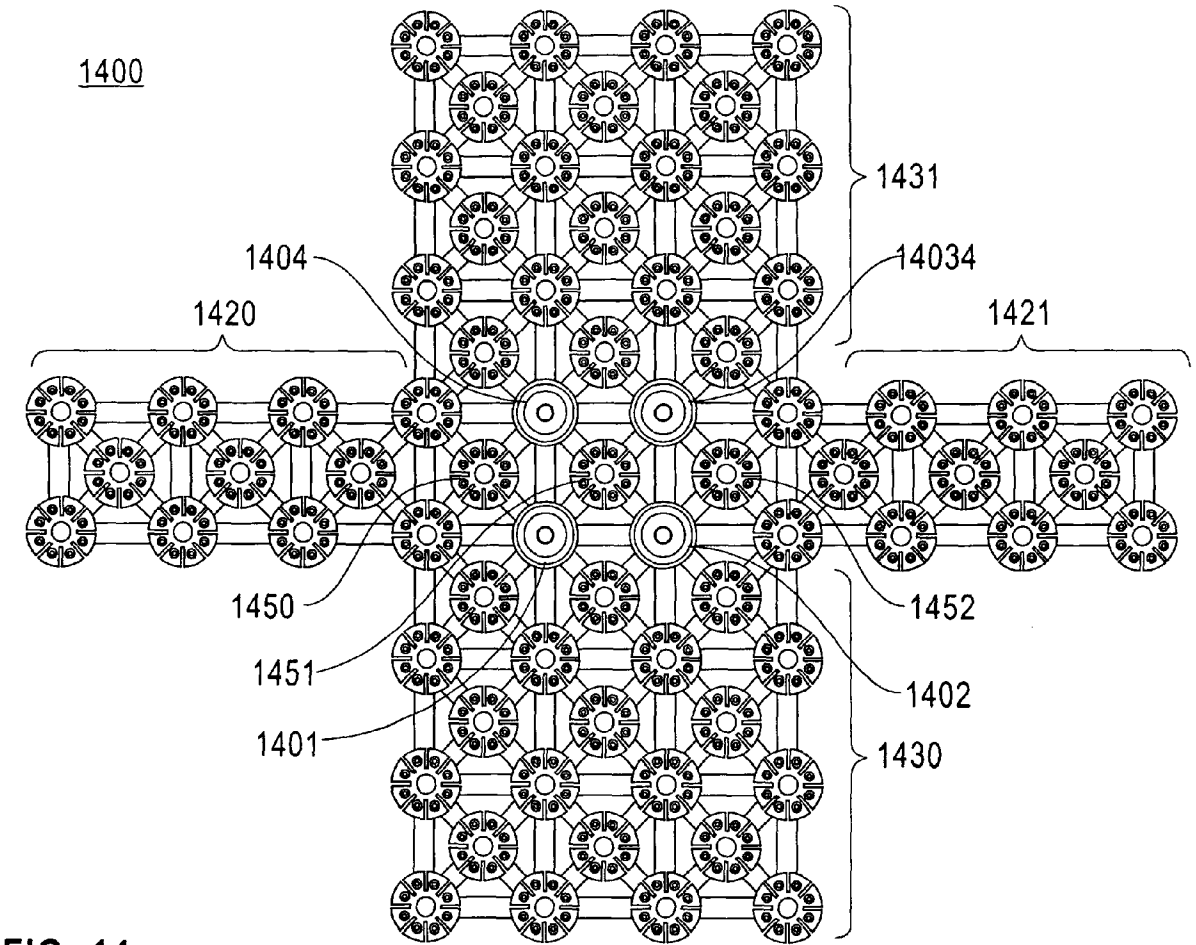
FIG. 14 is a top view of the collapsed or packed frame shelter frame assembly showing end arches.

FIG. 14 is a top view of the collapsed or packed frame shelter frame assembly 1400 showing end arches 1420 and 1421 and side quads 1430 and 1430. The risers, 1450, 1451 and 1452 are positioned in the center of the shelter and the top elements 1401, 1402, 1403 and 1404 of the floating hub assembly surround riser 1451. The articulating hub assemblies and struts comprise the balance of the shelter structure as described hereinabove.

Figure 15:
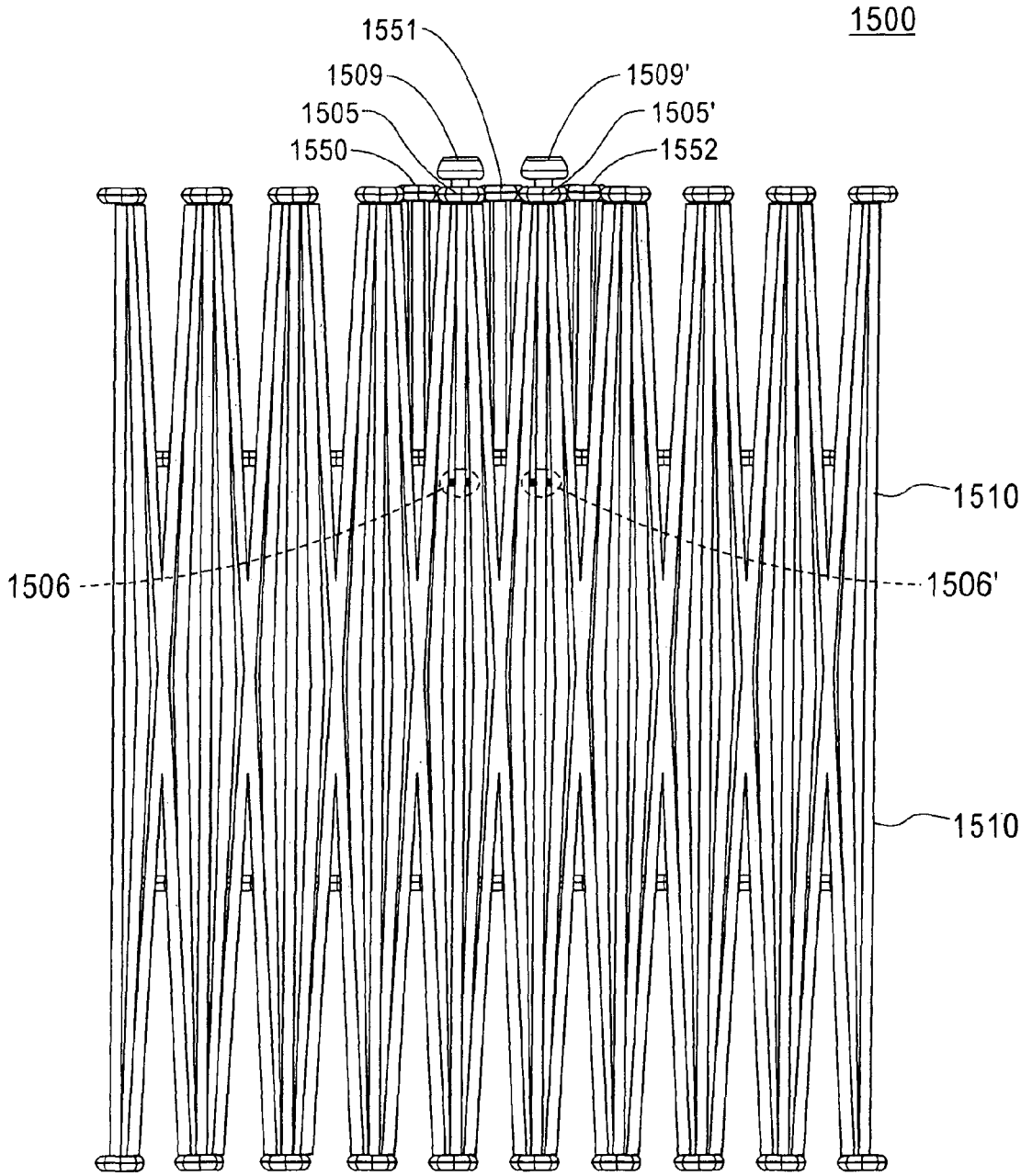
FIG. 15 is a first side view of the shelter frame assembly wherein the collapsed frame 1500 is in tightly packed configuration.

FIG. 15 is a first side view of the shelter frame assembly wherein the collapsed frame 1500 is in tightly packed configuration. Risers 1550, 1551 and 1552 shown with floating hub top 1509 and 1509' in what appears to be in between the risers noted. The two tops of floating hubs behind the tops shown are obscured. The top elements 1509 and 1509' of the floating hub are connected to a connecting rod (not shown) through hubs 1505 and 1505' and terminates at base plates 1506 and 1506' respectively. The articulating hub assemblies and struts (e.g., 1510) comprise the balance of the shelter structure according to the structure disclosed hereinabove.

Figure 16:
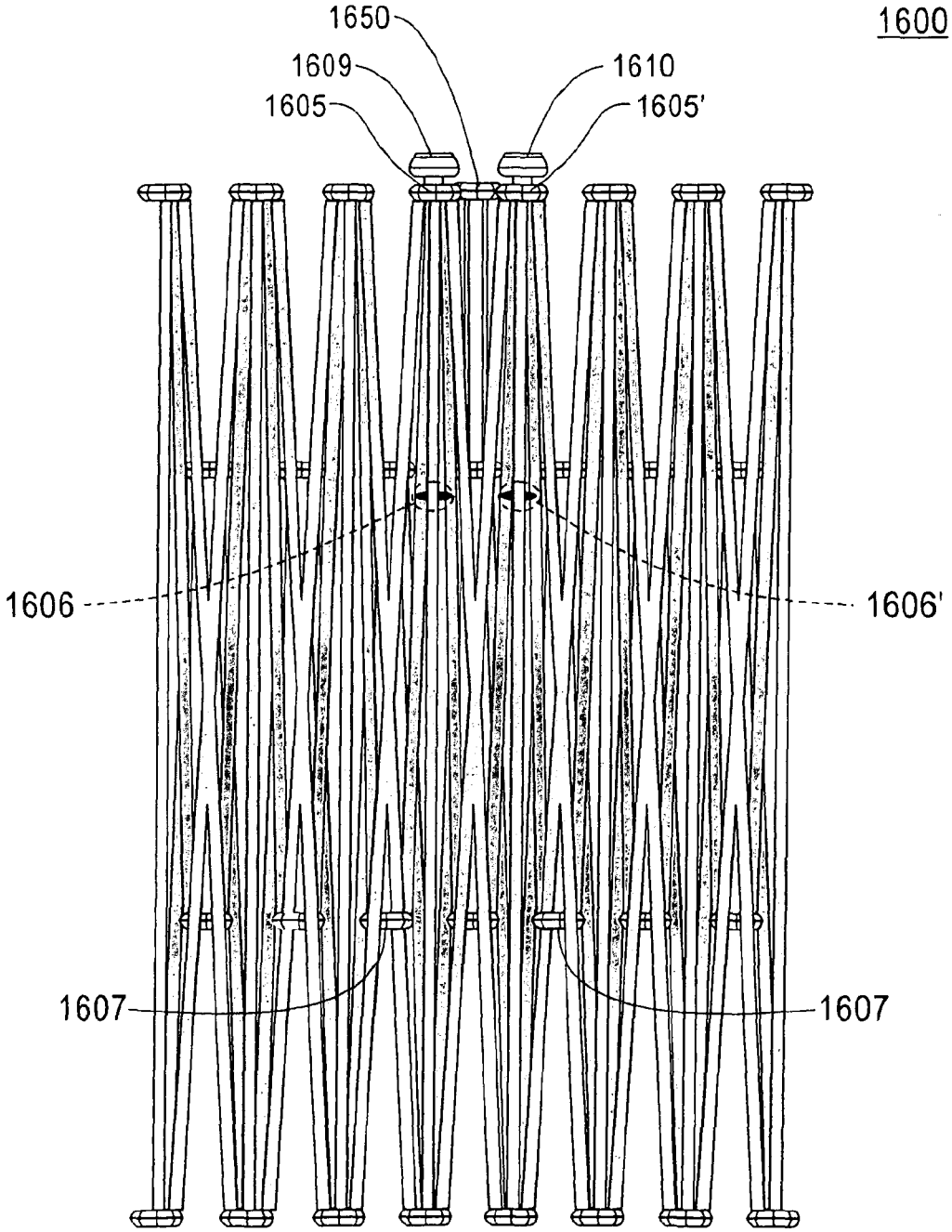
FIG. 16 is a second side view of the shelter frame assembly wherein the collapsed frame is tightly packed.

FIG. 16 is a second side view of the shelter frame assembly wherein the collapsed frame is tightly packed. A single riser 1650 is shown with floating hubs 1609 and 1610 in place. The top elements 1609 and 1610 of the floating hubs are connected to a connecting rod (not shown) through hubs and terminates at base plate 1606. FIG. 16 provides a clearer exposition of the position of hub 1607, when the assembly is in the storage or unerected state. During such time when the assembly is erected, hubs 1607 are elevated to the extent that each hub 1607 contacts base plates 1606 and accordingly, connecting rods and tops 1609 rise to the height depicted in FIG. 5.

The Shelters Formed from Quads

Figure 18:
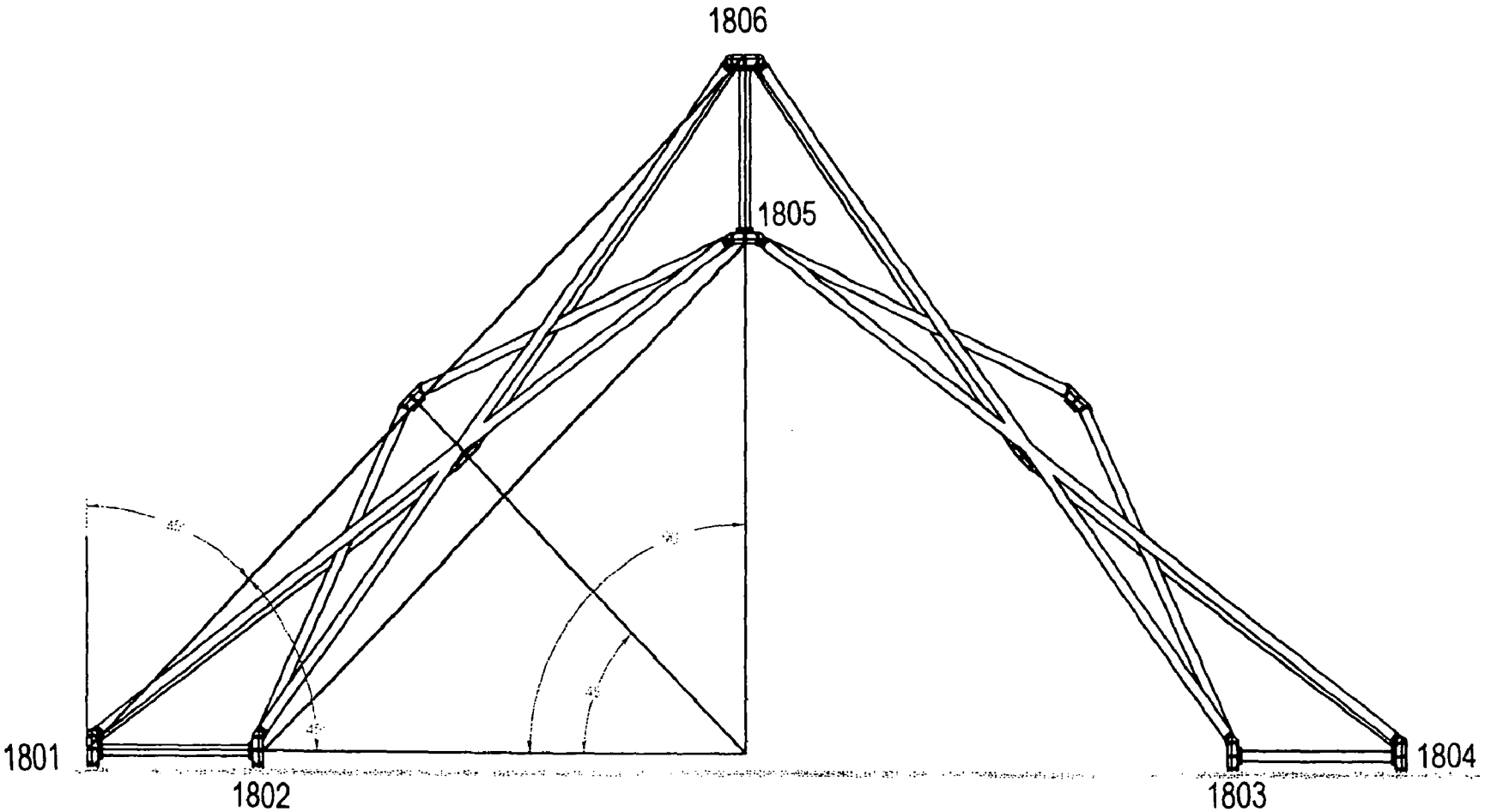
FIG. 18 is a front cross-sectional view of two assembled BB quads of the present invention forming a shelter.

FIG. 18 depicts a two quad (BB) structure showing the structural arrangement of struts and hubs extending between 1801 and 1806 and between 1806 and 1804. This figure provides a detailed view of how the quads and hubs transition from the horizontal plane to the vertical plane. In FIG. 18, the "base exterior hubs", i.e., the outside hubs that contact the surface upon which the shelter is erected are shown at 1801 and 1804. The "base interior hubs" are shown at 1802 and 1803. The shared hubs are depicted as the exterior shared hub 1806 and the interior shared hub at 1805. There is no need for a riser or floating hub with this shelter. In viewing this BB structure, FIG. 18 at 1801 indicates that the angle between a vertical plane and a line segment connecting the exterior hub at 1801 and the shared hub at 1806 is 45°. The apex subtended in this embodiment is 45°. On a two quad (BB) structure, a floating hub can be incorporated therein but a riser is really not required.

Figure 19:
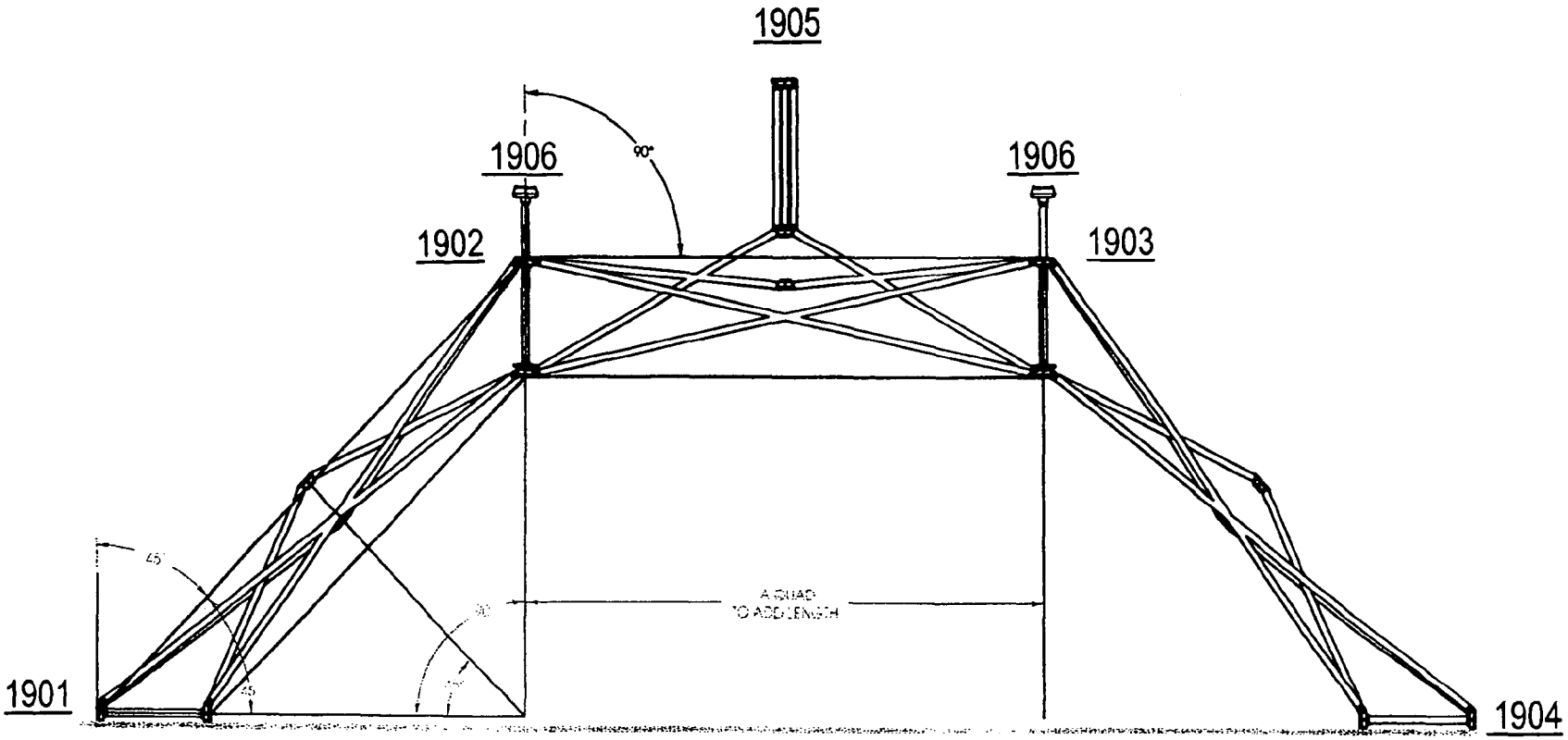
FIG. 19 is a front cross-sectional view of three assembled BAB quads of the present invention forming a shelter along with a riser.

To form a three (3) quad arch shelter as depicted in FIG. 19 one adds an A quad between the B's, thus forming a BAB quad configuration. The B quad extends between 1901 and 1902; the A quad between 1902 and 1903 and the final B quad between 1903 and 1904. The shelter has a riser 1905 above and in the center of quad A. FIG. 19 at 1901 indicates that the angle between a vertical plane and a line segment connecting the exterior hub at 1901 and the shared hub at 1902 is 45°. The presence of the A quad adds width to the shelter. Length is formed by connecting the arches side by side. It has been determined that on all arches having an odd number of quads, (e.g., 3, 5, 7, etc.) it is necessary to add a riser for reasons explained more fully hereinafter. On the three quad BAB structure, there is a riser. The addition of a floating hub would, in this case, flatten the pitch from the riser and make it more susceptible to snow/ice build up. The pitch as it is positioned is quite sharp.

Figure 22:
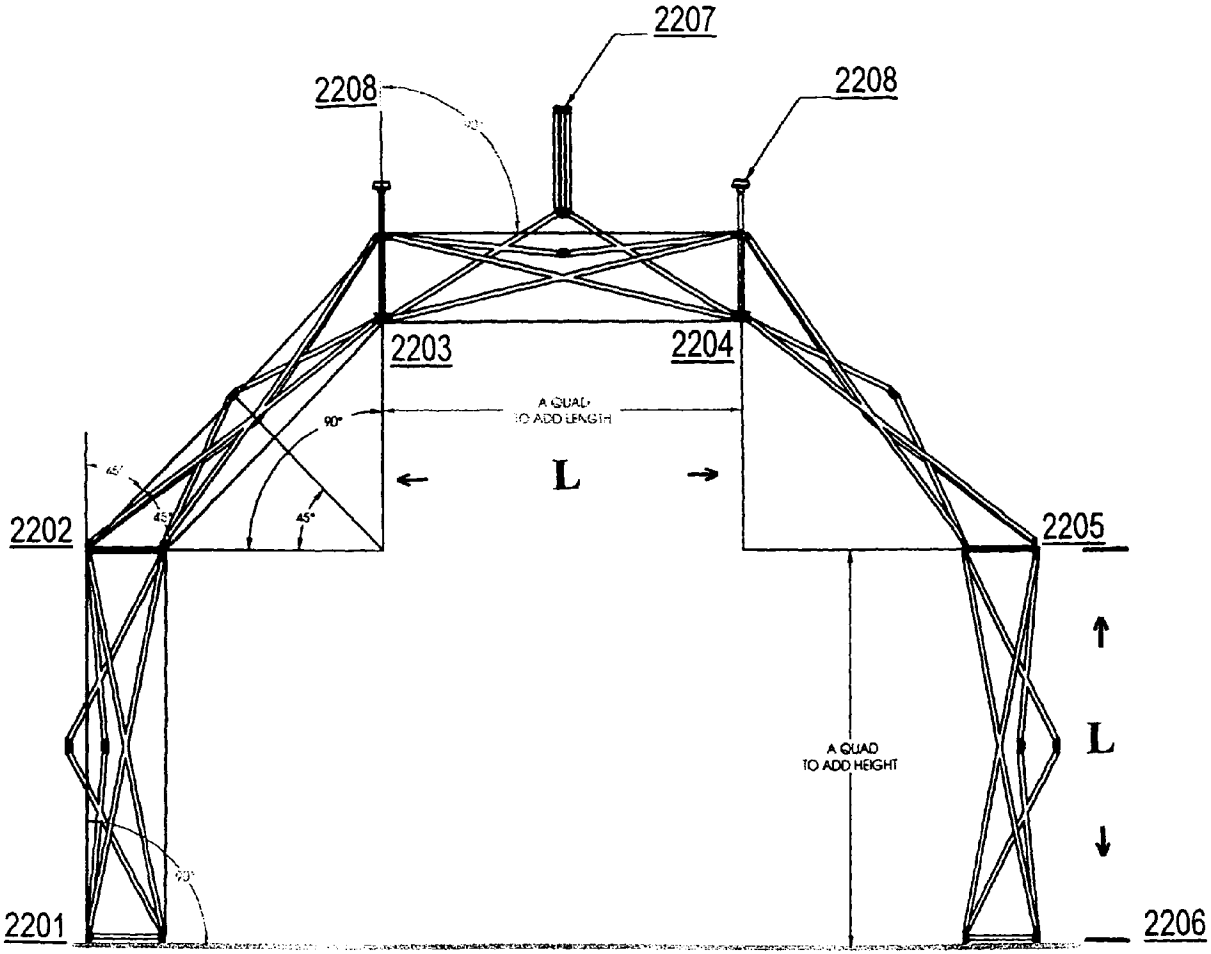
FIG. 22 is a front cross-sectional view of five assembled ABABA quads of the present invention forming a shelter.

Note that the B quads are both at an angle to the vertical plane and that the A quad is in the center of the structure, horizontal and at a right angle to the vertical plane. The B quads are necessary to provide the angular curvature needed to form the arcuate outline of the structure and the A quads provide absolute height and width to the structure. This embodiment shows how the A and B quads defined in detail at FIG. 3, cooperate to form a collapsible portable self-supporting shelter structure. In the case of the embodiment depicted in FIG. 19, if one desired to obtain additional cubic volume to the shelter, one could include an A quad to each of the two B quads at 1901 and 1904. The resultant structure or shelter would be ABABA as shown in FIG. 22. One can add another A quad at 1902 and the resultant structure would be a ABBAABBA. The insertions of the A quads would increase the operating width within the structure.

To form a four (4) quad arch shelter as depicted in FIG. 20, four B quads (BBBB) are connected. FIG. 20 depicts a front cross sectional view of the shelter. The hubs in B quads extend between 2001 and 2002; 2002-2003; 2003-2004 and 2004-2005. Floating hub 2006 is positioned above risers 2007. FIG. 20 indicates that the angle between a vertical plane and a line segment connecting the exterior hub at 2001 and the shared hub at 2002 is 22.5° and the angle between a vertical plane and a line segment connecting the exterior shared hub at 2002 and the exterior shared hub at 2002 is 67.5°. These two angles total 90° which is the arc generated by the positioning of the two quads passing from the horizontal plane at base level to the vertical plane extending from the base surface through the center top of the shelter. On a four quad structure, there is generally no riser or floating hub. If desired, this can be added and will sharpen the pitch more dramatically.

To form a five (5) quad arch shelter as depicted in FIG. 21, one adds an A quad in the center (BBABB). FIG. 21 depicts a front cross sectional view of the shelter. The B quads extend between 2101 and 2102; 2102-2103; the A quad between 2103 and 2104 and the remaining B quads between 2104 and 2105 and 2105 and 2106. The A Quad provides the flat top so a riser 2107 is needed and in this case two floating hubs 2108 and 2108 are positioned adjacent the riser. FIG. 21 indicates that the angle between a vertical plane and a line segment connecting the exterior hub at 2101 and the shared hub at 2102 is 22.5° and the angle between a vertical plane and a line segment connecting the exterior shared hub at 2102 and the exterior shared hub at 2102 is 67.5°. These two angles total 90° which is the arc generated by the positioning of the two quads passing from the horizontal plane at base level to the vertical plane extending from the base surface through the center top of the shelter.

As noted above in the description of FIG. 19, the A quad in this FIG. 21 embodiment essentially provides a 0 degree horizontal plane and provides length to the shelter depicted.

FIG. 22 depicts a five (5) quad arch shelter having an ABABA arrangement. In this embodiment, two A quads (2201-2202 and 2205-2206) are added to the shelter to provide height L to the BAB embodiment depicted in FIG. 19. The A quad (2203-2204) in the center of the shelter gives the additional length L desired along the horizontal axis. The B quads extend between 2202 and 2203 and 2204 and 2205. FIG. 22 indicates that the angle between a vertical plane and a line segment connecting the exterior hub at 2202 and the shared hub at 2203 is 45°. FIG. 22 shows a riser 2207 and floating hubs 2208. On a five Quad structure, there is both a riser and floating hubs FIG. 23 depicts a modification of the shelter depicted in FIG. 20, the modification being the addition of two vertical A quads on opposing sides of the shelter. Two B quads on each side of the center line (BBBB) form a row/arch. Note this arrangement of quads requires a riser and floating hubs and provides more elevation than obtained in other arrangements. A plurality of these arches then can be connected together side by side to form a three-dimensional structure. FIG. 23 illustrates a front cross-sectional view of the shelter having two A quads 2301 to 2302 and 2306 to 2307. These two A quads (2301-2302 and 2306-2307) are vertical and provide the raised sides to the shelter. The B quads flow arcuately from and to the base A quads to the base plane. FIG. 23 indicates that the angle between a vertical plane and a line segment connecting the exterior hub at 2302 and the shared hub at 2303 is 22.5° and the angle between a vertical plane and a line segment connecting the exterior shared hub at 2303 and the exterior shared hub at 2002 is 67.5°. These two angles total 90° which is the arc generated by the positioning of the two quads passing from the top of the A quad 2302 to the vertical plane extending from the base surface through the center top of the shelter. This shelter has A floating hub 2308 extending up through hub 2304. Risers 2309 are present on each side of floating hub 2308.

A preferred embodiment of the present invention is a seven quad arch shelter. A shelter having a plurality of rows comprised of seven quads results in a shelter that is most desirable when used as a tactical support headquarters or hospital or other uses where interior space is needed. Among the several 7 quad shelter options, there are three most preferred are set forth hereinafter.

In FIG. 24, the shelter has seven quads total, comprising six B Quads and a single A Quad (BBBABBB). This arrangement of quads requires a riser 2409 and two floating hubs 2410 and provides more width to the shelter than other seven quad arrangements. In this embodiment, there are two succeeding B quads rising from the top hubs of the A quad to join a central top A quad followed by two more succeeding quads which slope back down to an A quad. There are four B quads which provide the arcuate shape to the structure. The hubs comprising the vertical A quads extend between 2401-2402 and 2407 and 2408 and between 2404 and 2405 in the horizontal plane. The B quads extend between 2001 and 2002; 2002-2003; 2003-2004 and 2004-2005. FIG. 24 indicates that the angle between a vertical plane and a line segment connecting the shared exterior hub at 2402 and the shared hub at 2404 is 22.5° and the angle between a vertical plane and a line segment connecting the exterior shared hub at 2403 and the exterior shared hub at 2404 is 67.5°. These two angles total 90° which is the arc generated by the positioning of the two quads passing from the horizontal plane at base level to the vertical plane extending from the base surface through the center top of the shelter.

FIG. 25 depicts seven B Quads (BBBBBBB) extending from 2501-2502; 2502-2503; 2503-2504, 2505-2506, 2506-2507 to 2507-2508 which flow arcuately from the horizontal base plane. In this embodiment, there are seven succeeding B quads rising from the horizontal plane which ascend to a center and then slope back down to the horizontal plane. There are seven B quads which provide the arcuate shape to the structure. The structure depicted in FIG. 25 shows riser 2509. No floating hub is necessary in this configuration. The BBBBBBB quad frame arrangement shown in FIG. 25 with the riser has an adequate pitch down from the riser so the floating hub, while it could be used, is not absolutely necessary. The shelters ABBABBA and BBBABBB, shown in FIGS. 23 and 24 require the floating hub to sharpen the pitch of the fabric so it will not collect snow or ice.

The slope or pitch of the BBBBBBB Quad shown in FIG. 25 is adequate enough to prevent snow/ice build up on the fabric. The other two shelters depicted in FIGS. 24 and 26, have a flat A quad in the center which dampens the pitch from the riser so the floating hub mitigates the problem of collecting ice or snow.

Figure 26:
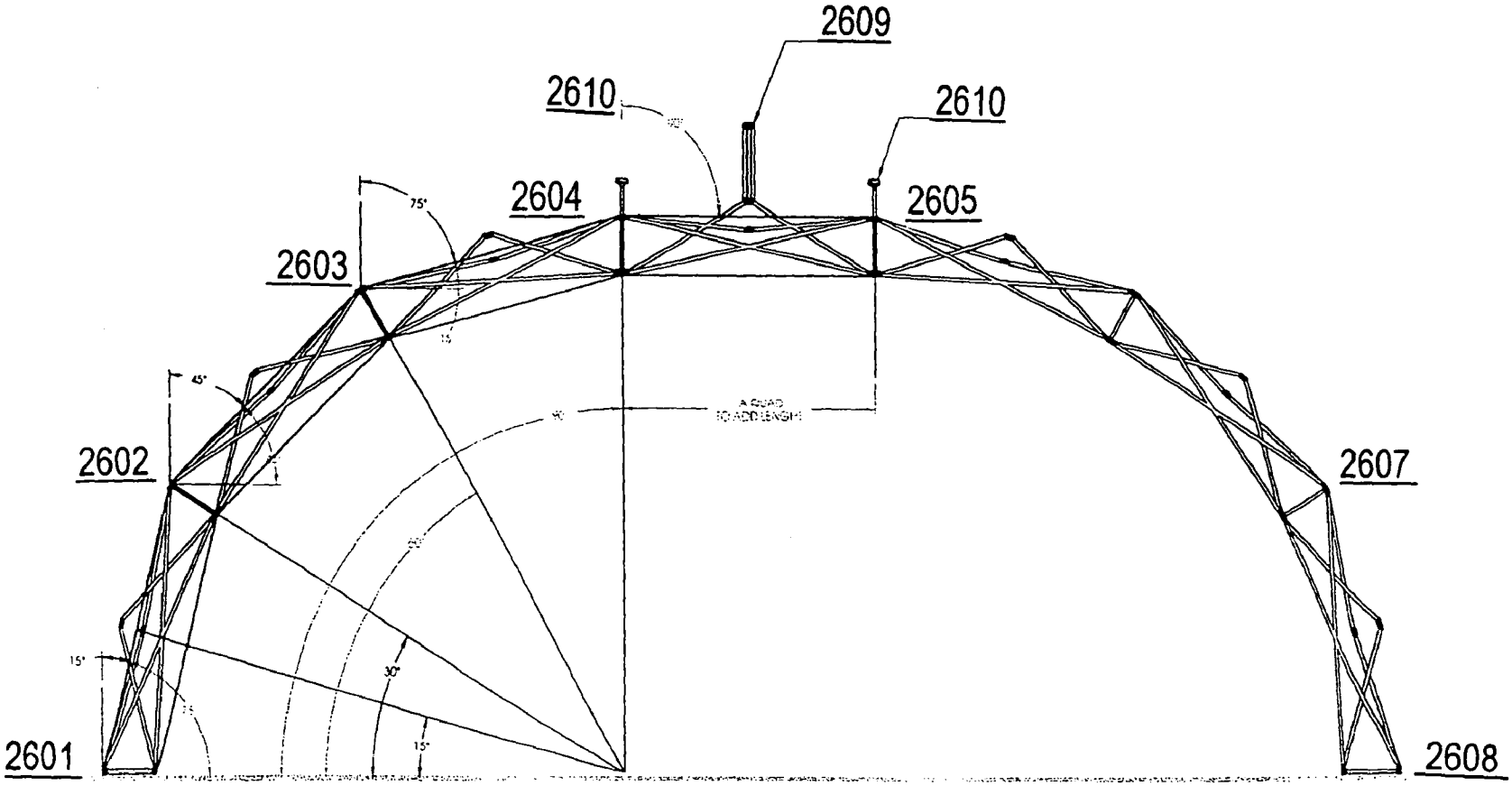
FIG. 26 is a front cross-sectional view of seven assembled BBBABBB quads of the present invention forming a shelter along with a riser between two floating hubs.

FIG. 26 depicts one A quad extending from 2604 to 2605 and six B Quads extending from 201-2502; 2502-2503; 2503-2504, 2505-2506, 2506-2507 to 2507-2508 (BBBABBB) which flow arcuately from the horizontal base plane to the A quad at 2604 and thenb from A quad 2605 down to the horizontal base plane. In this embodiment, there are three succeeding B quads rising from the horizontal plane which ascend to a center A quad and then slope back down to the horizontal plane. There are seven B quads which provide the arcuate shape to the structure. The structure depicted in FIG. 26 shows riser 2609 and floating hubs 2608. FIG. 26 indicates that the angle between a vertical plane and a line segment connecting the shared exterior hub at 2601 and the shared hub at 2602 is 15° and the angle between a vertical plane and a line segment connecting the exterior shared hub at 2602 and the exterior shared hub at 2603 is 45°, and the angle between a vertical plane and a line segment connecting the shared exterior hub at 2603 and the shared hub at 2604 is 75°

The shelters ABBABBA and BBBABBB, shown in FIGS. 23 and 24 require the floating hub to sharpen the pitch of the fabric so it will not collect snow or ice.

The slope or pitch of the BBBBBBB Quad shown in FIG. 25 is adequate enough to prevent snow/ice build up on the fabric. The other two shelters depicted in FIGS. 24 and 26, have a flat A quad in the center which dampens the pitch from the riser so the floating hub mitigates the problem of collecting ice or snow.

In order for the B quads to assemble in an arcuate form, the scissor points joining the four sets of struts in the subassembly are located at a point along their respective lengths off center. Where the A quad subassembly has the set of struts in its subassembly joint at the mid point along the length of the struts, the B quad does not. The scissor points are set so that when the shelter is set up and fully erected, the exterior planar face of the B quads will be inclining up to the center point of the shelter (whether that mid point is in an A quad or a B quad), and then declining back to the base plane. The scissor points of the subassembly struts are set so that the planar exterior face of the B quad The Quads disclosed in FIGS. 18-20 use ⅝" OD tubing with a circular hub with a diameter of 2¼" as disclosed in U.S. Pat. No. 5,797,695 to A. Jon Prusmack Obviously, the quads depicted in FIGS. 21-26 will span a greater width and therefore require a larger diameter tube. The larger diameter tube will have a different size hub. For example, certain shelters have a ¾" OD Tube and an octagon shaped hub with a width of 3". Another shelter has a 1" OD Tube also with an octagon shaped hub with a width of 3 ⅝."

One can add the riser and/or floating hub to all of the shelters depicted in the drawings. Theoretically this works practically, but as noted above, it may not make sense on some of the quads. The hubs would be all the same size based on the diameter of the connecting tubes. The Quads disclosed in FIGS. 18-20 use ⅝" OD tubing with a circular hub with a diameter of 2¼" as disclosed in U.S. Pat. No. 5,797,695 to A. Jon Prusmack Obviously, the quads depicted in FIGS. 21-25 will span a greater width and therefore require a larger diameter tube. The larger diameter tube will have a different size hub. For example, certain shelters have a ¾" OD Tube and an octagon shaped hub with a width of 3". Another shelter has a 1" OD Tube also with an octagon shaped hub with a width of 3 ⅝."

The lengths of the struts (tubes) have a constant ratio of lengths: meaning that height and width of the shelter is a function of the strut lengths and scissor points; all with the same ratio of measurements (lengths). The arches with the odd number of quads (3, 5, 7, etc.) can have an end arch at both ends of a connection of arches.

The Articulating Hub Assembly

The shelter structure which uses the floating hub possesses separate quads which together form a convex structure. The quads are disposed in the arcuate form in which adjacent quads share common end-defining pairs of crossed, pivotally connected struts. The articulating hub assembly used in conjunction with the struts forming the quads are an integral part of the system. As a result of the use of the specific hubs disclosed herein in the construction, the framework may be manipulated between a collapsed condition and an expanded condition by flattening the quads so that their free ends are positioned beyond those positions which they occupy in the expanded condition of the framework. As a result of the flexibility of the articulating hubs, the framework may either be manipulated into the expanded condition or into the collapsed condition, dependent upon whether the framework is to be collapsed or expanded.

Another key feature in converting the matrix frame to a shelter assembly is securing the fabric covers (covering the tubular frame network) to the articulating hub assembly body and allow the two fabric covers (interior and exterior) to move simultaneously with the tubular frame upon either set-up or fold-up. As noted above, the cover can be any suitable fabric such as canvas, nylon, polyester, etc., and can be impregnated with fire retardants, insect repellants, etc. A mushroom shaped "keeper" component with a screw-type stem is secured through an opening in the articulating hub assembly to attach the fabric layers thereto.

All the components comprising the deployable shelter described hereinabove are interchangeable. The hub sections are joined together using screws making replacement a simple step. Also if a strut is broken when the shelter is erected, the strut can be replaced by removing the broken strut along with the other strut to which it is secured without having to remove the entire collection of tubular elements as is the case in the prior art.

As noted above, the present invention relates to a deployable shelter and an articulating hub assembly which serves to connect tubular rods that comprise the basic construction elements for a prefabricated, self-supporting, deployable structure.

Figure 27:
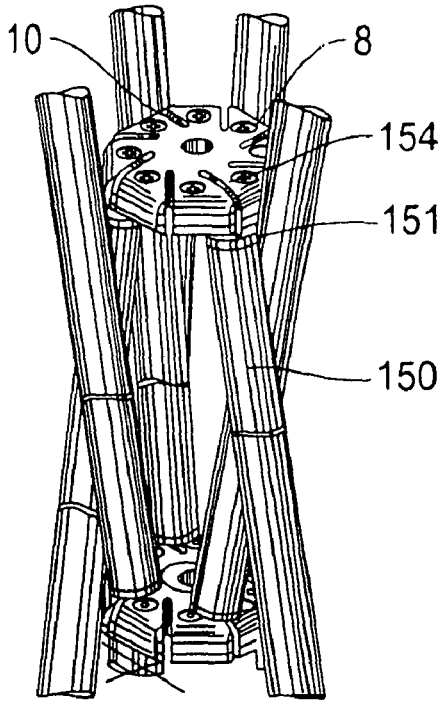
FIG. 27 is an oblique view of hubs and tubular struts as they appear when the deployable shelter is in a folded state.

FIG. 27 depicts tubular struts 150 and two hubs 8 and 9 of the present invention, with the tubular struts in their intermeshed orientations when the structure is in a folded state. When viewing the hubs as depicted in FIG. 27, the "bottom" element, 10, of hub assembly 8, is shown connected to four tubular struts, and the "top" element, 11, of hub assembly 9 is shown also connected to four tubular struts. The tubular struts are connected to the hub by means of a plug 151 affixed within the interior of tubular strut 150. Plug 151 is connected to tang 154 which is held within the hub body 8. FIG. 27 shows only 7 struts for clarity.

Figure 28:
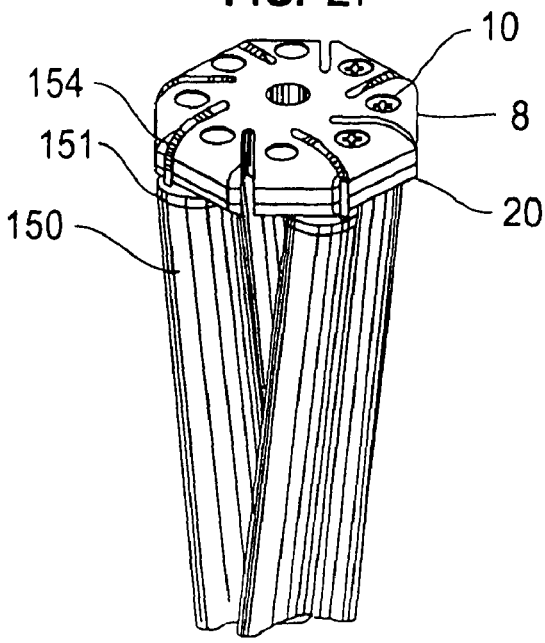
FIG. 28 is an oblique view of a portion of the structure depicted in FIG. 27.

FIG. 28 shows the "bottom" 10 of hub assembly 8 of the present invention, with four tubular struts 150 in their folded and intermeshed positions. Similar to FIG. 27, the tubular struts 150 are fastened to plug 151 which is, in turn, fastened to tang 154 which is captured within hub body 8 as is described in further detail below.

Figure 29:
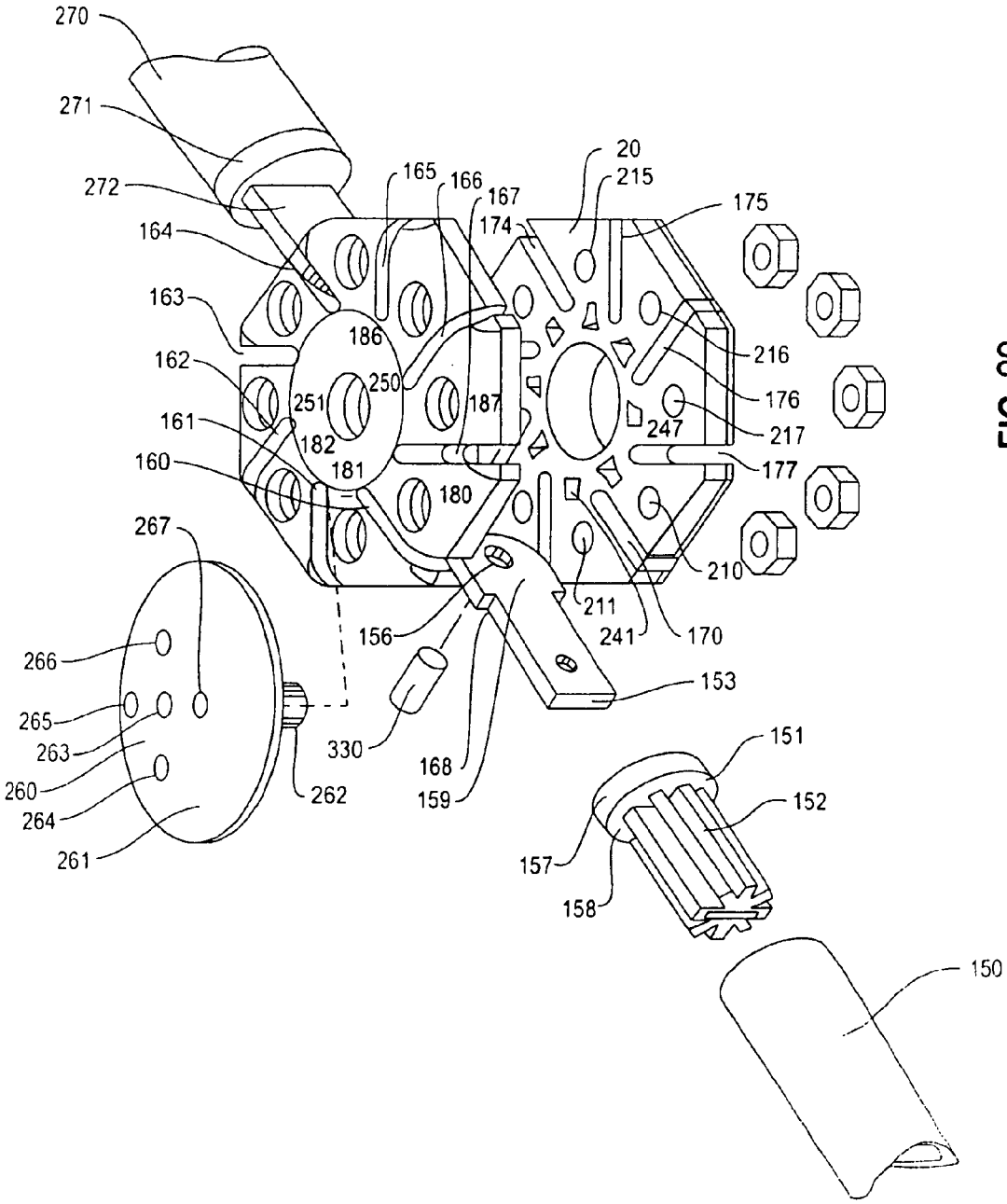
FIG. 29 is an exploded oblique view of the improved hub of the present invention.

FIG. 29 is an orthogonal exploded view of the articulating hub assembly of the present invention depicting the bottom 10 and top 20 sections of the hub body with the connecting end of tubular struts 150 and 270 of the skeletal matrix as well as other relevant parts shown in their respective locations when the assembly is in use. As illustrated in FIG. 29, within the end of tubular strut 150 is fastened plug 151 with the assistance of ribs 152. Plug 151 is generally and preferably cylindrical in shape and has a crown 157 at one end which rests against shoulder 158 when assembled. The diameter of the portion of plug 151 beyond crown 158 is substantially the same as the inside diameter of the tubular strut elements which form the skeletal matrix of the shelter. When assembled, a rivet (not shown) secures tang tail 153 in plug 151 to the tubular element (not shown). Head 159 of tang 154 is wider than tail 153 and merges therewith at shoulder 168. Tang 154 is captured within the hub assembly by means of roll pin 330 which is inserted through opening 156 in tang 154. Roll pin 330 is captured within groove 200 (shown in FIG. 31B) in hub bottom 10 so that tang 154 is captured by hub 8 but able to move within slits 160 and 170 in hub bottom 10 and top 20, respectively. Slits 160 and 170 are in registered alignment.

Into radial slits 160 and 170 there is inserted a tang 154 having a head 159 and a tail 153. Tang 154 is inserted through a plug 151 which is also inserted within the end of tubular strut 150. Tang 154 is held in place within hub bottom 10 by roll pin 330 which is inserted through an opening 156 through head 159. Roll pin 330 is secured in a groove (not shown in FIG. 29 but shown in FIG. 29) in the underside of hub bottom 10. (See FIG. 31B.)

The tail 153 of tang 154 is sufficiently long to extend radially outward from radial slits 160 and 170. Tail 153 of tang 154 possesses a width substantially the same as is present in a slit that extends radially through plug 151.

Hub bottom 10 has seven slits analogous to slit 160 (161 through 167), and hub top 20 has seven slits analogous to slit 170 (171 through 177), in registered alignment with the slits in the hub bottom.

Within hub bottom 10 are openings 180 through 187. These openings are recessed and are in registered alignment with openings 210 to 217 in hub top 20. Each opening 180 through 187 and 210 to 217 receives a means for securing bottom 10 and hub top 20. Preferably the securing means is a fastener 280 through 287, not shown in this view. Openings 180 through 187 in the hub bottom 10, and 210 to 217 on the top 20 are preferably recessed so the heads of the fasteners and the nuts (not shown) lie flush with the respective surfaces of the hub. The nuts and fasteners referred to are tightened to secure hub top 20 to hub bottom 10.

The openings in hub top 20 also are provided with recesses 220 to 227. Recesses 220 to 227 are configured to both capture nuts 230 to 237 and enable them lie flush with the respective surfaces of hub top 20. The fasteners and nuts 230 to 237 are threaded so that they may be threadedly engaged. To improved structural performance and minimize weight, hub top 20 contains wells 240 to 247.

Hub bottom 10 has a central opening 250 with threads 251 whereas hub top 20 has a larger central opening 252.

Hub assembly 8 may be equipped with one or more keepers, 260. The keeper is mushroom shaped, with a top 261 and a shaft 262. The top 261 and has one central well 263 about which are distributed four wells 264 to 267. The shaft 262 of the keeper is threaded to match that of central opening 250 so that it may engage threads 251 of hub bottom 10. In addition to the nuts and fasteners noted above, keeper component 260 also secures hub bottom component 10 to hub top component 20.

Hub assembly 8 may connect anywhere from one to eight tubular struts. Shown in FIG. 29 are two tubular struts, 150 and 270. Analogous to tubular strut 150, plug 271 is fastened within tubular strut 270. Tang 272 is inserted in to plug 271. Tang 272 and plug 271 are fastened to strut 270 by means of a rivet, not shown. Tang 272 is also captured within hub assembly 8 by means of a roll pin which lies within a groove that is perpendicular to slit 164.

This view does not show the fabric which covers the tubular structure of the shelter. The cover can be any suitable fabric such as canvas, nylon, polyester, etc. and can be impregnated with fire retardants, insect repellent compositions, etc.

Figure 30A:
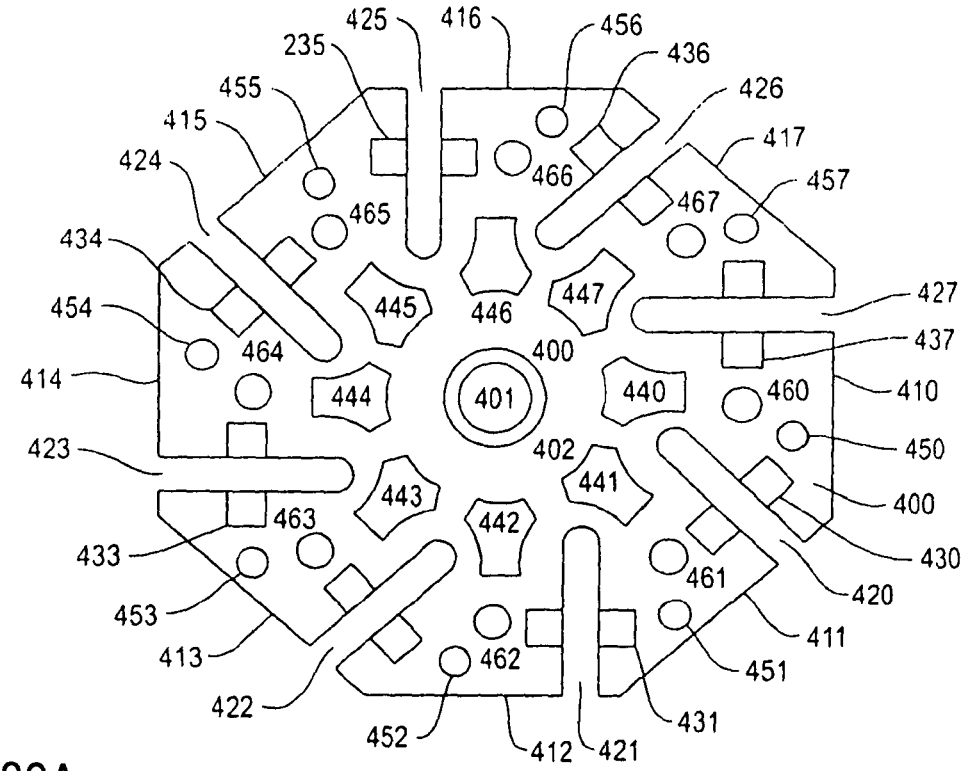
FIG. 30A is a plan view of the bottom of the improved hub of the present invention with the tubular struts and keeper in place.

FIG. 30A is a plan view of the top surface of the assembly depicted in FIG. 29 showing some of the elements detailed in FIG. 29, including the octagonal shape of hub top 20 of hub assembly 8. FIG. 30A includes hub assembly 8 with eight tubular struts each with a plug, as illustrated by element 151, and tang 154, each tang inserted within a slit as illustrated by element 160. Thus each strut is connected to hub 8 by means of tangs 154, 272 and 300 to 305 which in turn engage plugs 151, 271 and 307 to 312. The view shows eight fasteners as illustrated by elements 280 to 287 which are used to secure, in combination with eight fasteners (not shown) the superior element to the inferior element comprising the hub. Keeper 260 is fixed to the hub using any suitable means, and a loop 290, to hold wind lines, is secured to central well 263 of keeper 260 by any suitable means. The loop is generally permanently attached to keeper component 260.

Figure 30B:
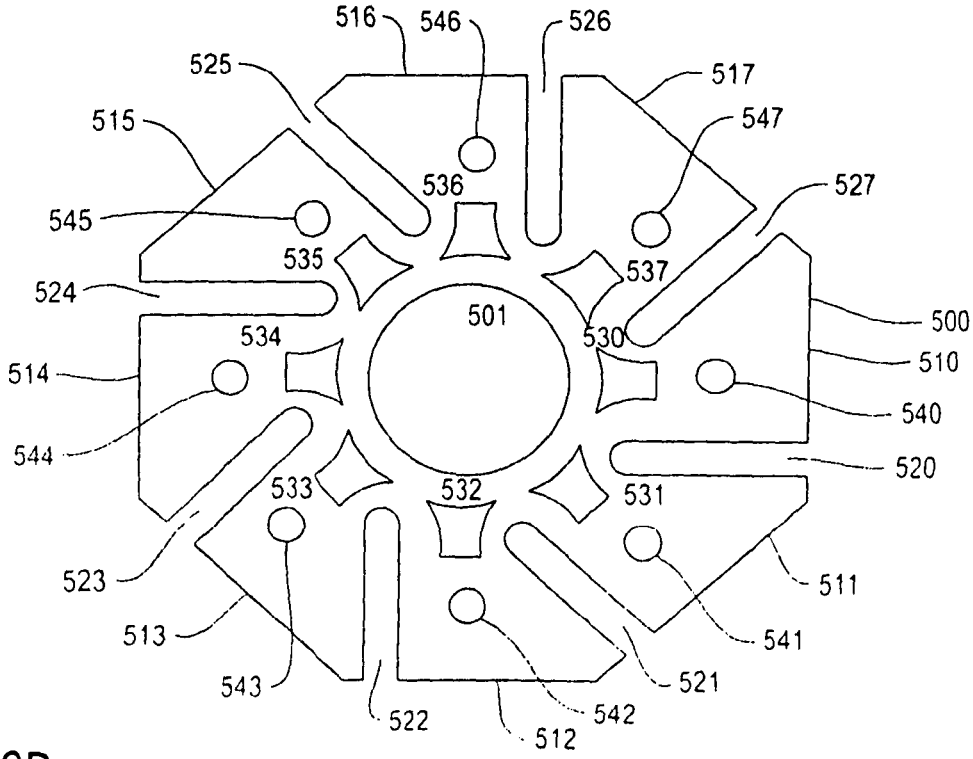
FIG. 30B is a plan view of the top of the improved hub of the present invention with the tubular struts and keeper in place.

FIG. 30B is a plan view of the bottom surface of the assembly depicted in FIG. 29 showing some of the elements detailed in FIG. 29 including the octagonal shaped hub bottom 10 of hub assembly 8 as it is used in combination with tubular struts the comprise the matrix of the deployable structure in the erected state. FIG. 30B includes hub assembly 8 with eight tubular struts 150, 270, 313 to 318 each within a slit as illustrated by elements 160 to 167. Struts 150, 270 and 313 to 318, are engaged to the hub by means of tangs 154 and 300 to 305 which are in turn engaged with plugs 152, 271 and 307 to 312. Hub bottom 10 has a central, threaded opening 250, within which is threadedly engaged the shaft 262 of the keeper 260. Hub bottom 10 has nuts, 230 to 237, which threadedly engage fasteners 280 to 287 (the tip of which are shown protruding through the center of nuts 230 to 237) to secure hub bottom 10 to hub top 20. The protruding tip 313 of hub keeper 260 appears in the opening in the center of the hub.

Figure 31A:
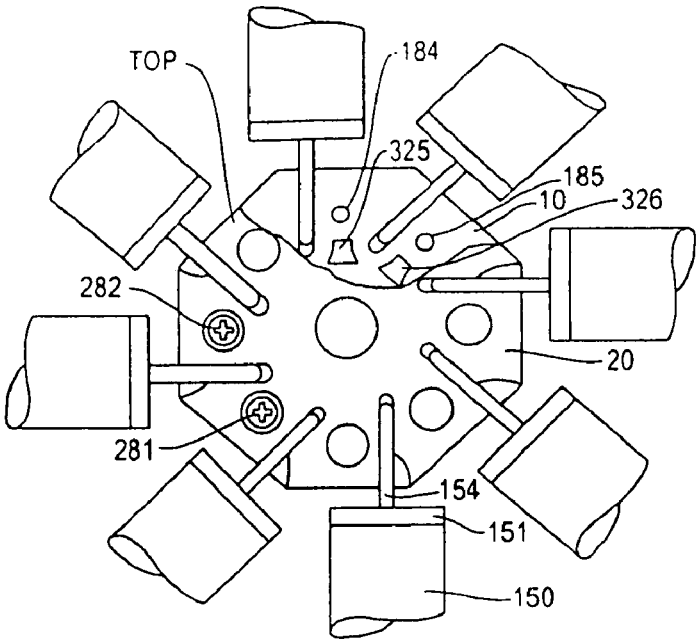
FIG. 31A is a plan view of the bottom of the improved hub with partial cutaway exposing the interior surface of the top of the improved hub of the present invention.
Figure 31B:
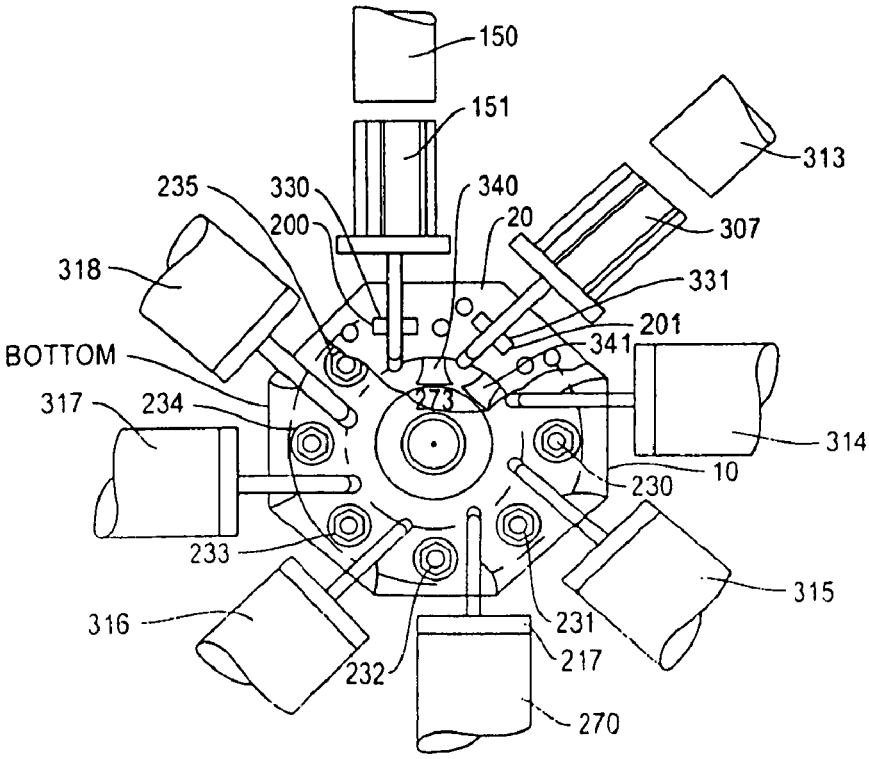
FIG. 31B is a plan view of the top of the improved hub with partial cutaway exposing the interior surface of the bottom of the improved hub of the present invention.

Referring to FIG. 29 and where necessary, FIG. 30A and FIG. 30B, hub 8 comprising the present invention therefore is an octagonal unit made up of two separable sections, hub bottom 10 and a hub top 20 (See also FIG. 31A and FIG. 31B). FIG. 29 specifically depicts the superior side of hub bottom 10 and the inferior side of hub top 20.

Accordingly, hub 8 contains 8 peripheral edges 101 to 108 which are continuously connected, each to the next, around its periphery thus forming 8 vertices each subtending an angle of 45°. Thus for each vertices, as for example between edge 101 and 102, the angle is 45°.

Immediately past the intersection of each of edges 101 through 108 around the periphery of the unit, slits 160 through 167 and 170 to 177 are cut normal to the peripheral edge in question into hub 8 in direct alignment through hub bottom 10 and hub top 20 that comprise hub 8. Each of the aforementioned 8 vertices formed by the intersecting edges 101 through 108 around the periphery subtends an angle of 45°. Accordingly, proceeding in a clockwise manner around the octagonal periphery of the hub with its defined sections, the adjacent slits cut into the hub each form an angle of 45° with the succeeding and preceding edges.

FIG. 31A depicts a plan view of hub assembly 8 showing, in a partial cut-away view, hub top 20 and hub bottom 10. Shown are the struts, 150, 270 and 313 to 318, each connected by way of a plug, 151, 271, 307 to 312, respectively, to a tang, 154, 272, 300 to 305, respectively, which is captured within the hub top 20 by means of a roll pin captured within a groove (not shown). The hub top 20 is secured to hub bottom 10 by means of a fastener, two of which are shown in this representation, 281 and 282. The cut-away portion of the drawing shows two of the eight wells 326 and 327 in hub bottom 10 as well as two of the eight openings 184 and 185 in hub bottom 10.

FIG. 31B depicts a plan view of hub assembly 8 showing, in a partial cut-away view, hub bottom 10 and hub top 20. Shown are struts 150, 270 and 313 to 318, each connected by way of a plug, 151, 271, 307 to 312, respectively, to a tang, 154, 272, 300 to 305, respectively, which is captured within the hub top 20 by means of a roll pin, two of which, 330 and 331, are shown. The roll pins, 330 and 331 are shown, are captured within hub top 20 by means of a groove, grooves 200 and 201 are shown. The hub top 20 is secured to hub bottom 10 by means of fasteners each of which is threadedly secured by a nut. In this view six nuts, 230 to 235, are shown. The cut-away portion of the drawing shows two of the eight wells 340 and 341 in hub top 20 as well as two of the eight openings 210 and 211 in hub top 20.

Figure 32A:
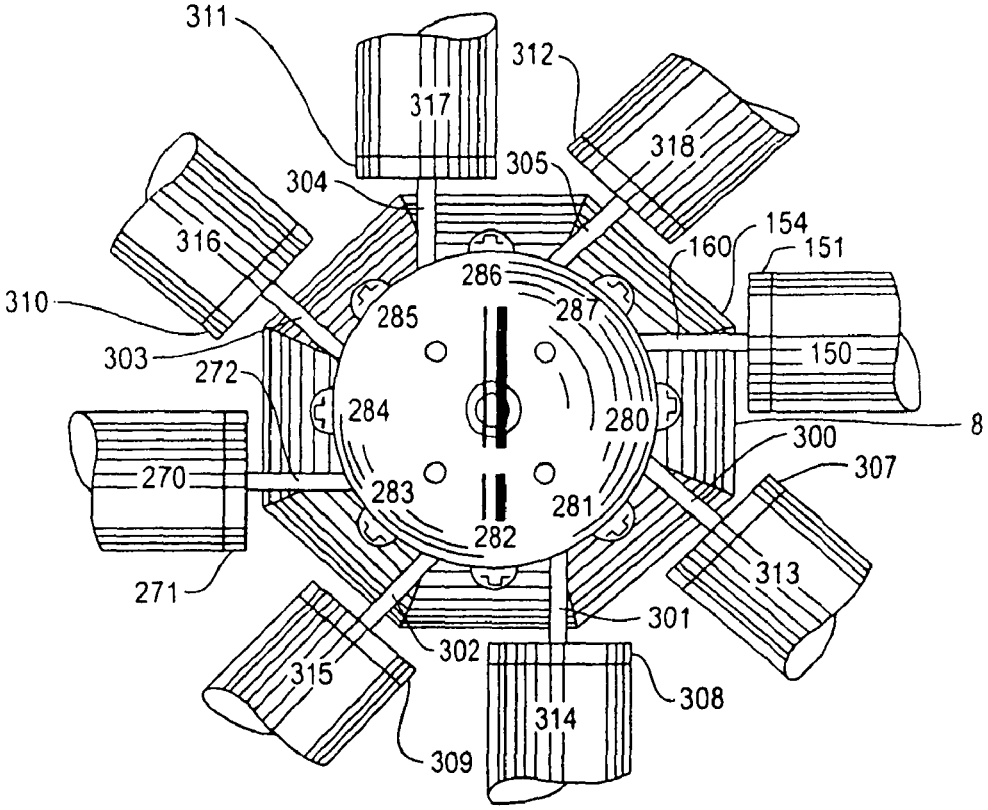
FIG. 32A is a plan view of the exterior surface of the top half of the improved "J" hub of the present invention.

FIG. 32A depicts a plan view of a hub bottom of a second example of the invention. Depicted in FIG. 32A is the hub bottom 400 which has eight edges, 410 to 417 and eight slits, 420 to 427. Perpendicular to each slit is a groove, 430 to 437, for the purpose of capturing the roll pins (not shown) of the tangs (not shown). The hub bottom has eight interior wells, 440 to 447, and eight exterior wells, 450 to 457, to facilitate manufacture and improve the structural properties of the component. Hub bottom 400 has a central opening 401 which is threaded on its interior surface. The central opening is within a boss 402. Hub bottom is also provided with eight openings, 460 to 467, for fasteners (not shown).

Figure 32B:
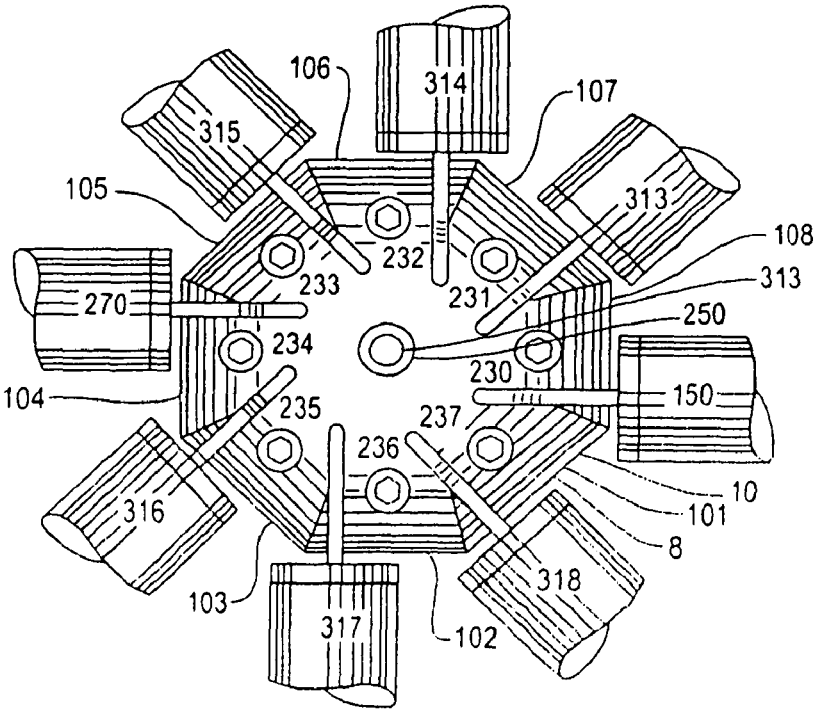
FIG. 32B is a plan view of the exterior surface of the bottom half of the improved hub of the present invention.

FIG. 32B depicts a plan view of a hub top of a second example of the invention. Depicted in FIG. 32B is hub top 500 which has eight edges, 510 to 517, and eight slits, 520 to 527. The hub top has eight wells, 530 to 537, to improve the manufacturability and structural performance of the component, and eight openings, 540 to 547, for fasteners (not shown). The hub top 500 has a central opening, 501 with an interior dimension sized to accept boss 502.

To explicate the spatial relationships of the hub edges and the slits cut therein, reference is made to FIG. 31A, which describes example 1 of the present invention. FIG. 32A, which describes Example 2 of the present invention has analogous relationships. Referring to FIG. 32A, slits 160 and 170 are aligned and positioned normal to edge 106; likewise slits 161 and 171 are positioned normal to edge 107; likewise slits 161 and 172 are positioned normal to edge 108, and so it continues around the periphery of the octagonal hub. However each pair of slits (e.g., 160/170, 161/171 and 162/172) which are normal to their particular edge (106, 107 and 108 respectively) form an angle with the preceding and succeeding slits. Thus, the slits in the hub are all positioned at angle of 45° with respect to one another.

Each segment of hub 8 defines an area formed between each of slits 160 through 167 and 170 to 177 which is an incomplete right triangle. FIG. 31A shows that if a line following each adjacent slit were drawn from the edges of the hub and extended until they intersected, eight right triangles would result. In practice, the actual slits 160 through 167 and 170 to 177 cannot be so extended as the integrity of hub 8 would be destroyed.

Figure 33A:
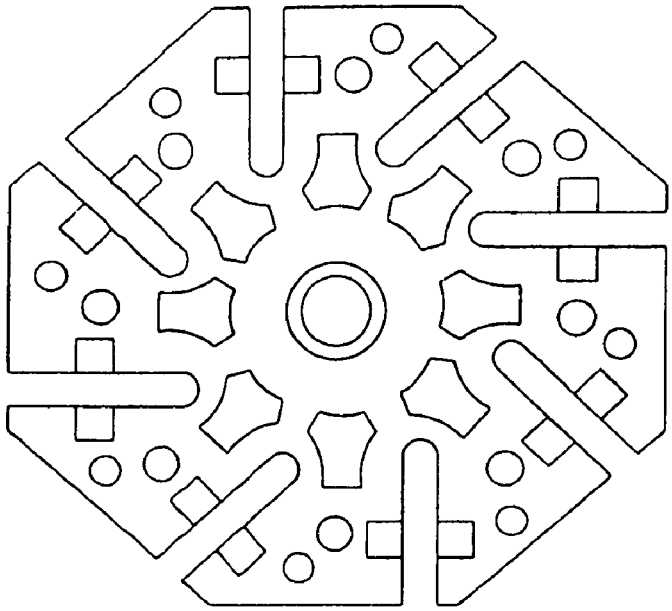
FIG. 33A is a plan view of the interior surface of the bottom half of the improved "M" hub of the present invention.
Figure 33B:
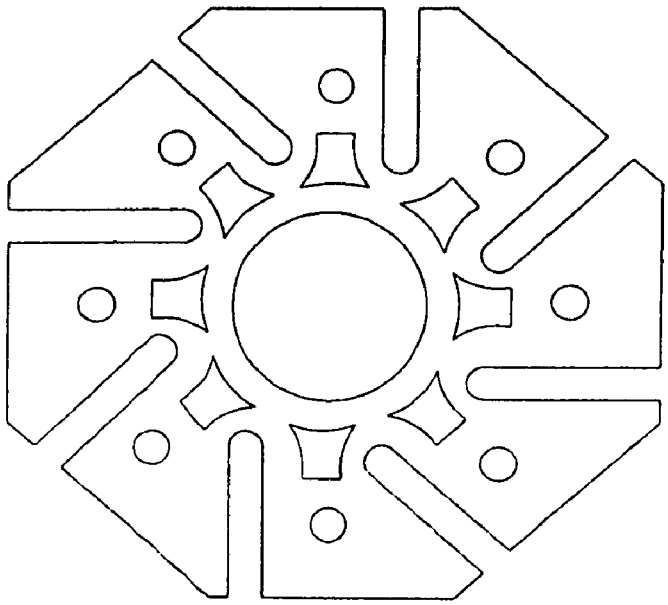
FIG. 33B is a plan view of the interior surface of the top half of the improved hub of the present invention.

FIG. 33A and FIG. 33B depict plan views (not drawn to scale) of the interior surface of the bottom half of the improved "M" hub of the present invention (FIG. 33A) and the interior surface of the top half (FIG. 33A) of the improved "M" hub of the present invention.

Figure 34A:
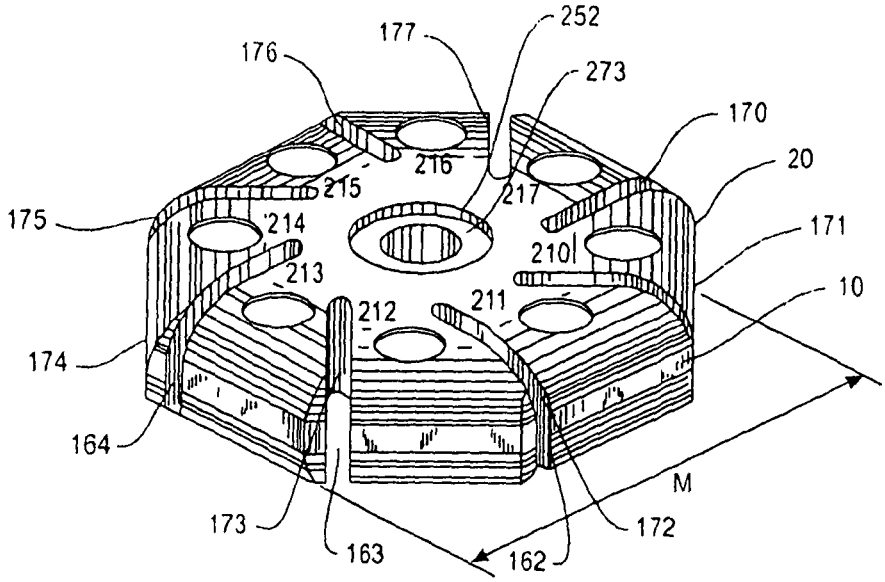
FIGS. 34A and 34B are oblique views of the top section of the "M" hub and the "J" hub showing the relative difference in size (not drawn to scale).
Figure 34B:
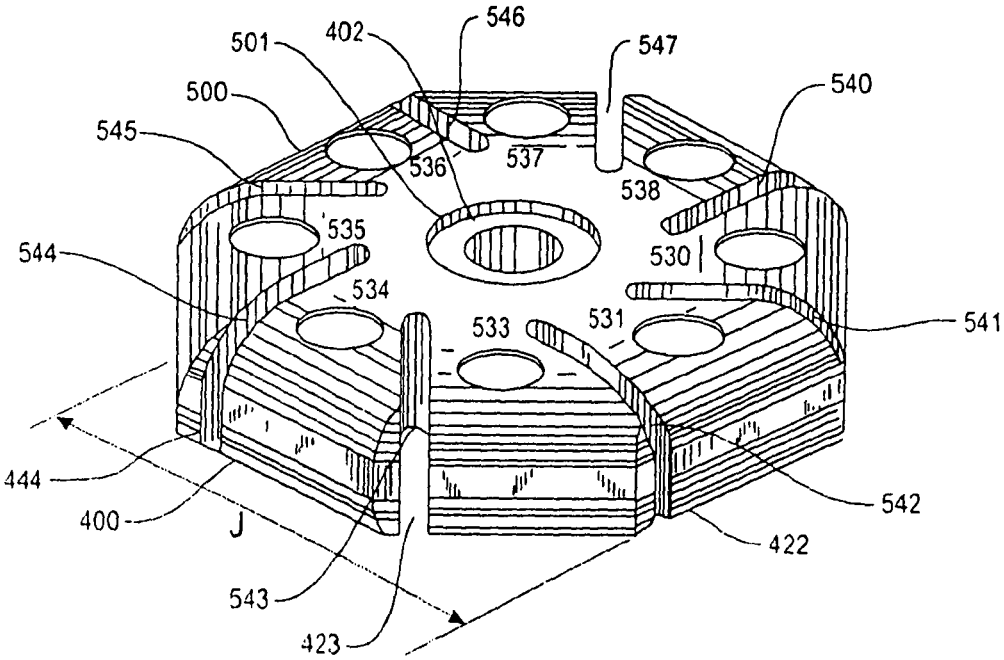

FIG. 34A depicts oblique views of the invention, Example 1 in FIG. 34A and Example 2 in FIG. 34B. FIG. 34A shows the hub top 20 and hub bottom 10 in their assembled orientation. The boss 273 of hub bottom 10 is shown within the central opening 252 of hub top 20. The slits of the hub top 170 to 177, are in registered alignment with those of the hub bottom, 160 to 167. Shown are openings 210 to 217 for fasteners (not shown). FIG. 34B shows hub top 500 and hub bottom 400 in their assembled orientation. Within hub top 500 is central opening 501. Within central opening 501 is boss 402 of hub bottom 400. As in Example 1, the slits of the hub top 540 to 547, and the slits of the hub bottom 420 to 427, are in registered alignment. Shown within hub top 500 are openings 530 to 537 for fasteners (not shown).

Figure 35A:
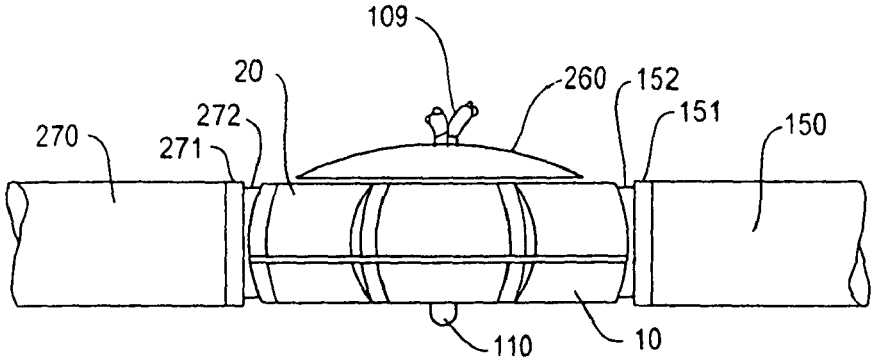
FIGS. 35A and 35B are side views of the improved "J" hub of the present invention.

FIG. 35A depicts a side view of the hub assembly 8, comprised of top 20 and bottom 10, showing only two sets of struts 150 and 270, plugs 151 and 271 and tangs 154 and 272, for clarity. Also shown is loop 109 captured within keeper 260 by knot 110. Keeper 260 is shown in its assembled position threadedly secured to hub bottom 10.

Figure 35B:
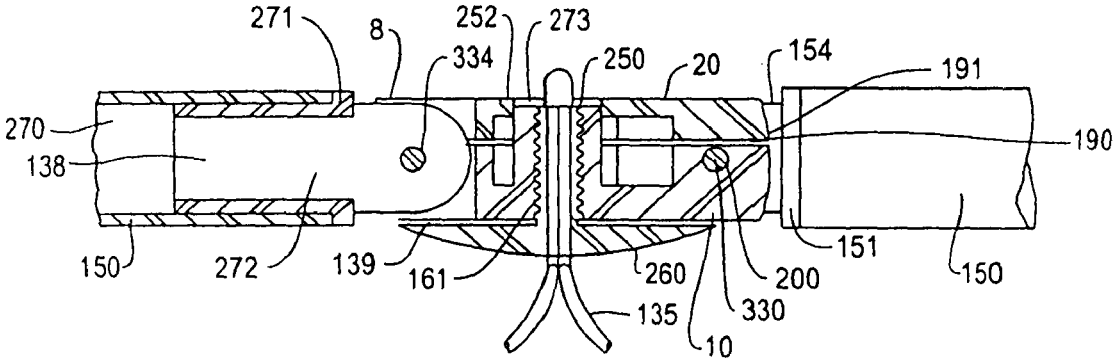

FIG. 35B depicts a side view taken along the line 10-10 of FIG. 5A the octagonal embodiment showing hub assembly 8, comprised of hub top 20 and hub bottom 10. Threadedly secured in hub bottom 10 is keeper 260. For clarity, only two plugs 151 and 271, captured within two struts 150 and 270 to which are secured two tangs 154 and 272 are shown. The tangs are secured to the hub assembly by means of roll pins 330 and 334 which reside in grooves. For clarity only groove 200 is shown. Hub bottom 10 is thicker from its underside to the top surface thereof than the thickness of hub top 20. As depicted also in FIG. 31A and FIG. 31B, at the center of hub bottom 10 there is a boss 273 with a threaded opening 250 extending upwardly from the upper surface of hub bottom 10. Hub top 20 has an opening 252 in the center extending through its thickness which opening has a diameter sufficient to accommodate boss 273. Boss 273 of hub bottom 10 is centered in alignment with opening 252 of hub top 20 and is of sufficient depth so that its terminal portion is flush with the upper surface of hub bottom 10 when the upper flat surface 190 of hub bottom 10 is continuously throughout in contact with the lower flat surface 191 of hub top 20. Keeper component 260 is threadedly secured within threaded opening 250 and serves to secure hub bottom 10 to hub top 20.

Figure 36A:
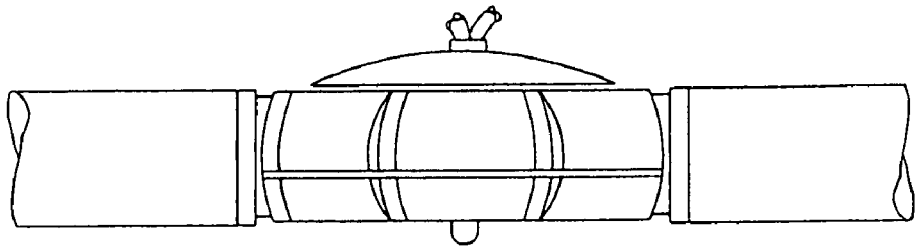
FIGS. 36A and 36B side cutaway cross sectional view of the improved "J" hub of the present invention.
Figure 36B:
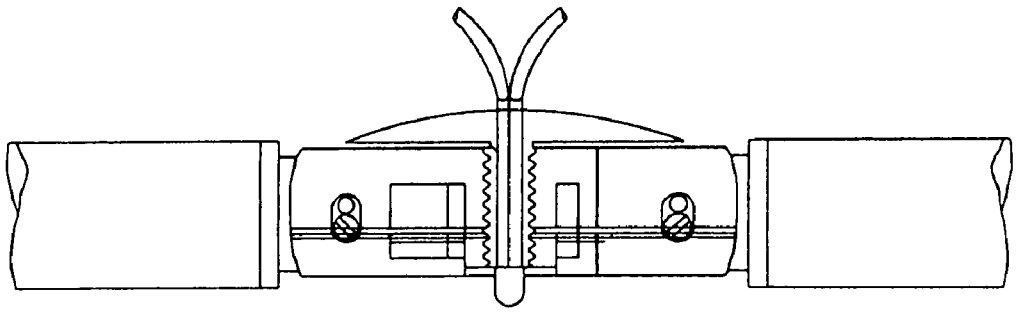

FIG. 36A is a side view of the improved "M" hub of the present invention. FIG. 36B is a cutaway cross sectional view of the improved "M" hub of the present invention.

Figure 37:
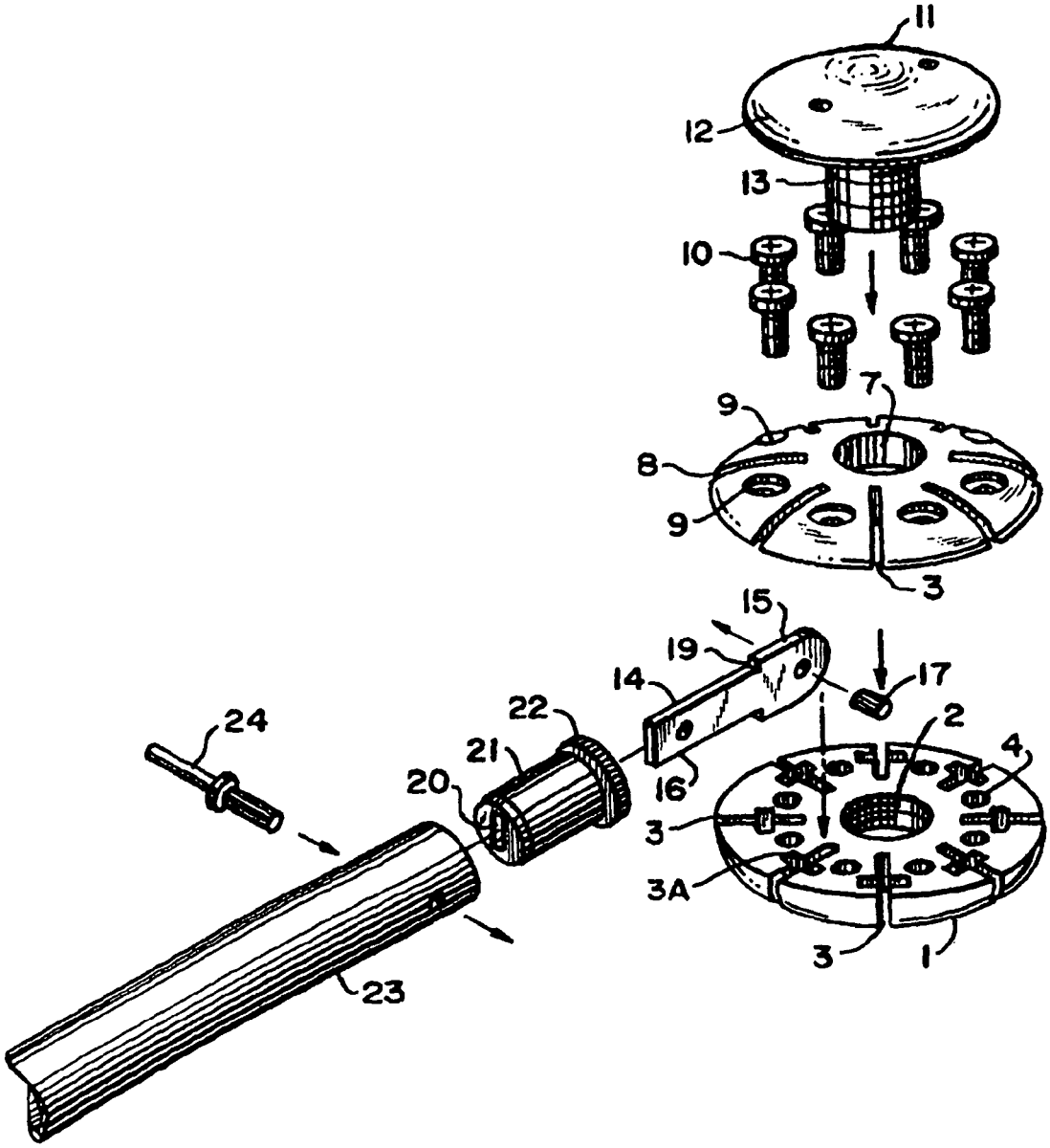
FIG. 37 is an exploded perspective view of the articulating hub assembly components of the present invention.

The components of an optional useful hub assembly used with the quads of the present invention is depicted in FIG. 37. Hub body 1 is a disc like unit having a central opening 2 therethrough and a series of radial slots 3 extending inwardly from the periphery of disc 1 and having a series of openings 4 extending through disc 1 and positioned radially between each of the radial slots 3 and between periphery 5 and central opening 2. A groove 3A is located perpendicular to each of radial slots 3.

Hub cover 6 is similarly formed with central opening 7 and radial slots 8 and openings 9. The hub body 1 and hub cover 6 are assembled contiguously so that central openings 2 and 7, radial slots 3 and 8 and openings 4 and 9 are in registry. Hub cover 6 is secured to hub body 1 via screws 10. Hub cover 6 does not require grooves wherein the roll pins will rest. Keeper 11 is a mushroom shaped element wherein top 12 is contoured to match the contoured slope of the exposed surface of hub cover 6 and the shaft 13 of keeper 11 is threaded to coincide with the thread present in central openings 4 and 9 and possesses the same diameter as those openings to allow it to be threadedly engaged therein.

Figure 38:
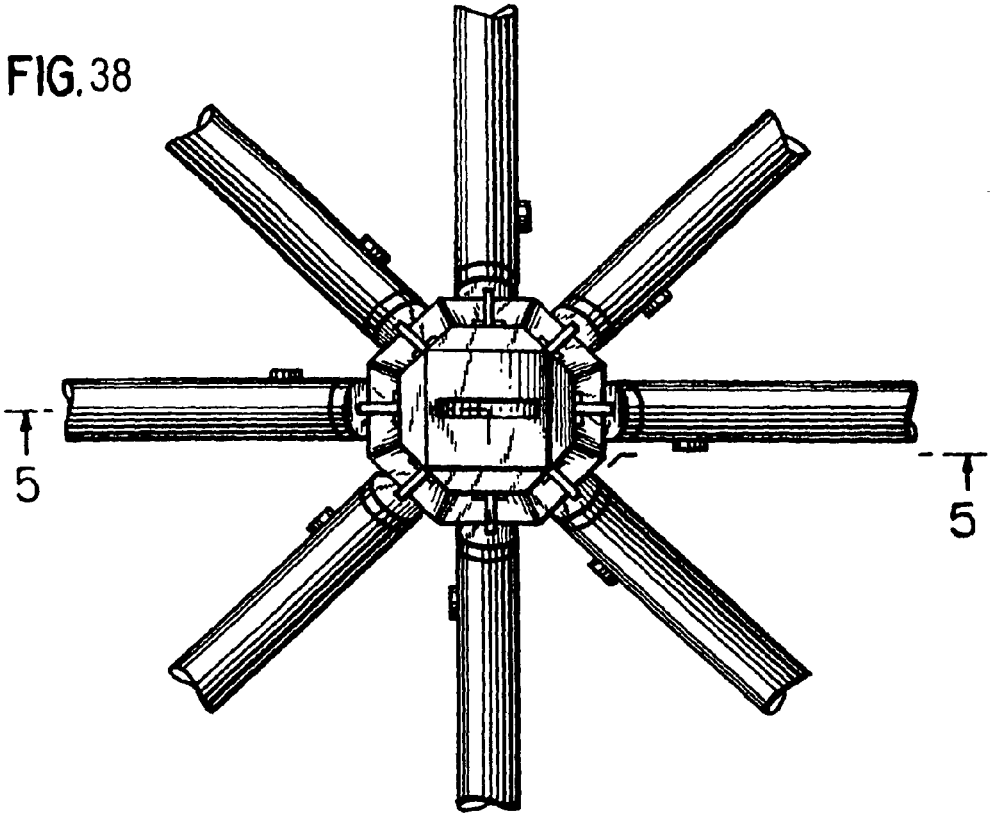
FIG. 38 is a plan view of an alternative embodiment articulating hub assembly.

FIG. 38 depicts a plan view of an octagonal shaped embodiment of the hub assembly of FIG. 37 showing the top of hub cover 6A and rectangular keeper 11A.

Figure 39:
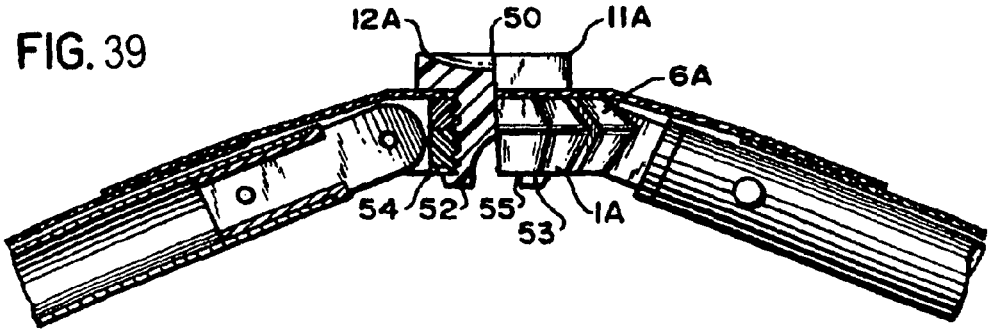
FIG. 39 is a cross sectional view of an alternative embodiment articulating hub assembly taken along the line 5-5 in FIG. 4.

FIG. 39 depicts a side view taken along the line 5-5 of FIG. 38 of the octagonal embodiment showing hub body 1A, hub cover 6A and keeper 11A.

It will be noted in that an alternative embodiment of keeper 11 of FIG. 39 is depicted. The keeper 11A possesses a top 12A which is a rectangular shaped head having a depression head 50 therein. The purpose in having a depression is to enable the construction crew to insert and remove the keeper easily. Any shape keeper will be effectively used.

More particularly, keeper 11A comprises top 12A having a depression area 50 therein and shaft 51 which extends into the flexible end sections 52 and 53 which serve as connectors and which are flexible and capable of splaying and locking into openings 54 and 55 located on the underside of hub body 1A.

In the embodiment depicted in FIG. 39 the keeper secures hub cover and hub body together as a result of the shaft section extending through the central opening in the hub cover and the hub body, with the tip ends of the flexible connectors fixed into openings 54 and 55.

The keeper can also be inserted from the bottom side of the hub body and fixed into hub cover with the fastening connectors. Since the keeper in this instance is a snap mechanism, it can be inserted either from the bottom or the top of the hub assembly.

All the components comprising the deployable shelter described hereinabove are interchangeable. The hub sections are joined together using screws making replacement a simple step. Also the tubes can be individually replaced without having to remove the entire collection of tubes before the individual tube in the collection is replaced such as is the case in the prior art.

The method for erecting the shelter is a multi-step process. The collapsed bundle of hubs and struts, with covers (exterior and interior) attached comprising the present invention as depicted in FIGS. 15 and 16 with the cover not shown, is placed on the ground or some other suitable surface where the structure will be erected. FIG. 16 shows the unit to be erected without the fabric cover. The interior cover of the shelter has a Velcro system for attaching a fabric floor to the sides of the fabric cover to provide a totally enclosed area. FIG. 14 depicts the two end arches. Looking from the top of FIG. 14, the perimeter of the main structure of the shelter has three rows of quads nested adjacent to one another. The bundled structure as described above, with the cover attached to the unit is placed in the center of the floor element. Four personnel are positioned—two on each side, and two at each end of the bundled unit and the apical hub is gripped and then simultaneously lifted up and pulled out until the all of the hubs are in line with one another. The unit will rise and fall freely when fully spread out. The four ingress/egress areas which will become the doorway are marked as "telltale" hubs. Personnel position themselves under these "telltale" hubs and unifiedly lift upward. When the unit has been raised, a pole for lifting the shelter higher is temporarily placed under each of the "telltale" hubs by the doorways. Optionally, when the shelter is at pole height, personnel alternately rebase the pole and move to another set of telltale hubs that are positioned toward the interior of the shelter. With the shelter on poles the personnel push up in unison until the walls and ends come to vertical. Prior to raising the shelter structure, personnel insure that the Velcro used for joining various parts of the shelter are not secured to the sides. Stakes are driven into the ground and tether lines attached to secure the stability of the shelter.

The take down procedure involves removing the stakes and lifting each end and side wall up and swinging it out about one foot. Four or six personnel are used to take down the shelter. If four persons are used, they are located at opposite ends diagonally from each other and the other two are located at the mid-way point of each side of the shelter. Each of the personnel then grip a hub at the lower end of the shelter that that been moved out about one foot as described above. The personnel in unison lift their section up and out and then proceed to bundle the shelter by lifting upward and walking together toward the center of the unit. The hubs and struts of the unit will then take on the appearance as depicted in FIG. 15. The nested unit is then secured with means to keep it secure and then wrapped in protective casing.

Although a preferred embodiment of the present invention and modifications thereof have been described in detail herein, it is to be understood that this invention is not limited to those precise embodiments and modifications, and that other modifications and variations may be affected by one of ordinary skill in the art without departing from the spirit and scope of the invention as defined in the appended claims.

What I claim and desire to protect by Letters Patent is:

1. A collapsible portable self-supporting structure comprising:

a plurality of inter-connected struts connected to a plurality of exterior and interior articulating hub assemblies, said hub assemblies serving as pivotal means allowing said struts, which are secured in said hub assemblies to rotate 180° about a vertical axis on said hub assembly, said struts and said hub assemblies interconnected together forming a square quad, said structure being formed from at least two quads, comprising a first quad designated an A quad and a second quad designated a B quad sharing common exterior and interior hubs joining said first A quad and said second B quad, said "B" quad having a base side, a top side, a first side and a second side, each said side connecting said base side with said top side;

said base side comprising:

a pair of first and second exterior base side hubs aligned evenly in a vertical plane with respect to each other and a pair of first and second interior base side hubs aligned evenly in a vertical plane with respect to each other, said first exterior base side hubs and said first interior base side hubs being in substantial in-line alignment with respect to each other and said second exterior base side hubs and said second interior base side hubs being in substantial in-line alignment with respect to each other; and a first tubular strut connecting said first exterior base side hub with said second interior base side hub;

a second tubular strut connecting said second exterior base side hub with said first interior base side hub;

said first and second tubular struts being adjacent to each other and extending diagonally at said base between said exterior side hubs and said interior side hubs and being joined at a scissor point substantially in the center of the length of each said first and second tubular strut;

said "B" quad having a top side comprising a pair of first and second exterior top side hubs aligned evenly in a vertical plane with respect to each other and a pair of first and second interior top side hubs aligned evenly in a vertical plane with respect to each other, said first exterior top side hubs and said first interior top side hubs being in substantial in-line alignment with each other; and said second exterior top hubs and said second interior top hubs being in substantial in-line alignment with each other; and a third tubular strut connecting said first exterior top side hub with said second interior top side hub;

a fourth tubular strut connecting said second exterior top hub with said first interior top side hub; said third and fourth tubular struts being adjacent to each other and extending diagonally at said top side between said exterior top side hubs and said interior top side hubs and being joined at a scissor point substantially in the center of the length of each said third and fourth tubular strut;

said first side of said B quad comprising a pair of tubular struts adjacent to each other, a first first-side strut extending diagonally between said first exterior base side hub and said first interior top side hub, and a second first side strut extending diagonally between said first interior base side hub and said first exterior top side hub, said first side struts being joined at a scissor point substantially off-center of the length of each said first side strut and said second first side strut;

said second side of said B quad comprising a pair of tubular struts adjacent to each other, a first second-side strut extending diagonally between said second exterior base side hub and said second interior top side hub, and a second side strut extending diagonally between said second interior base side hub and said second exterior top side hub, said second side struts being joined at a scissor point substantially off-center of the length of each said first second side strut and said second side strut;

said "B" quad further having a subassembly contained within the area defined by said top, base and sides, said subassembly having a pair of center hubs comprising an exterior center hub and an interior center hub positioned substantially in-line substantially in the center of said B quad with respect to each other, wherein four sets of two tubular struts each extend from said center hubs to said top and said base hubs:

a) a first center strut connecting said first exterior base hub to said interior center hub and a second center strut connecting said first interior base hub to said exterior center hub, said first and second tubular struts being adjacent to each other and extending diagonally and being joined at a scissor point substantially off-center of the length of said first and said second struts;

b) a third center strut connecting said second exterior base hub to said interior central hub and a fourth center strut connecting said second interior base hub to said exterior central hub, said third and fourth tubular struts being adjacent to each other and extending diagonally and being joined at a scissor point substantially off-center the center of the length of said third and said fourth struts;

c) a fifth center strut connecting said first exterior top side hub to said interior center hub and a sixth center strut connecting said first interior top side hub to said exterior center hub, said fifth and sixth tubular struts being adjacent to each other and extending diagonally and being joined at a scissor point substantially off-center of the length of said fifth and said sixth struts;

d) a seventh center strut connecting said second exterior top side hub to said interior central hub and an eighth center strut connecting said second interior top side hub to said exterior central hub, said seventh and eighth tubular struts being adjacent to each other and extending diagonally and being joined at a scissor point substantially off-center of the length of said seventh and eighth struts; and, said articulating hub assembly having a body selected from the group consisting of:

i.) rigid octagonally-shaped mating top and bottom components, said octagonal shape of said hub body defined by a periphery having eight straight edges at said periphery of said hub body and eight slits, each said slit extending radially inwardly from said periphery through said top and said bottom components from and normal to each said straight edges at said periphery of said hub body, each said slit is located at a vertex formed at intersections of each of said edges around said periphery of said hub body, and consistent with the octagonal configuration of said periphery of said hub body, adjacent slits emanating from each succeeding and preceding slit relative to said slit which is normal to said edge are aligned 45° with respect thereto; and said hub top-component defined by a periphery, an exterior and an interior surface, a central boss receiving opening, a plurality of said radial slits extending through said hub top, and a plurality of openings disposed radially toward the periphery of said hub top component, said openings being arranged to provide a single opening positioned in each of the areas defined in-between two adjacent said slits and arranged to conform to the position of said openings through said hub bottom when the hub top and hub bottom are joined; and said hub bottom-component wherein each of said edges of said periphery is in alignment with said edges of said top component, having an exterior and an interior surface, a boss extending upwardly from said interior surface of said bottom component, a central opening within a said boss and a plurality openings disposed radially toward the periphery of said component, said openings being arranged to provide a single opening positioned in each of the areas defined in-between two adjacent said slits and arranged to conform to the position of said openings through said hub top when said hub top and said hub bottom are joined; and each said slit in said hub bottom component having a discontinuous groove located perpendicular thereto and extending across said slit into each of said areas defined in-between two adjacent said slits;

said hub top component and said hub bottom component being assembled contiguously so that said central openings, said radial slits and said openings extending through said hub top component and said hub bottom component, and into said hub top component and said hub bottom component, are in registry; and a removable fastening means extending through said openings in said hub top component and being secured in said openings in registry therewith in said hub bottom component; and an integrally formed keeper element having a top and a shaft extending downwardly therefrom, wherein said shaft is capable of being inserted into and withdrawn from said central openings through said hub body and said hub cover, and said integrally formed keeper element, has means to secure said hub top component to said hub bottom component; and a plurality of tangs, each tang having a first side and a second side, a tail, and a head section with a roll pin extending from each side, said head section of said tang positioned in one of said radial slits in said hub bottom component and said hub top component in registry therewith, said tang being held in place by said roll pin nested in said discontinuous groove; and a cylindrical plug and a structural element secured to said tang; and ii) a central hub body having a periphery, a central opening therethrough and a plurality of radial slots extending inwardly from said periphery of said hub body, each of said radial slots in said hub body having a discontinuous groove located perpendicular thereto, said hub body also having a series of openings extending through said hub body, said openings being positioned radially between each of said radial slots and between said periphery and said central opening of said hub body;

a hub cover having a periphery, a central opening therethrough, a plurality of radial slots and a series of openings extending through said hub cover, said hub body and said hub cover being assembled contiguously so that said central opening, said radial slots and said openings of said hub cover are in registry with said central opening, said radial slots and said openings of said hub body;

removable fastening means, said removable fastening means extending through said openings in said hub cover and being secured in said openings in said hub body;

an integrally formed keeper element having a top and a shaft extending downwardly therefrom, wherein said shaft is capable of being inserted and withdrawn from said central openings of said hub body and said hub cover, said shaft having means for securing said hub cover to said hub body;

a plurality of tangs, each of said tangs having a first and second sides, said each tang comprising a head section with a roll pin extending from each of said sides, said head section of said tang being positioned in one of said radial slots of said hub body and said hub cover in registry therewith, said tang being held in place by said roll pin nested in said discontinuous groove; and a cylindrical plug having a crown and a structural element secured to said tang.

2. The structure defined in claim 1 wherein said plurality of "B" quads forms a succession of connected quads forming an arched row, said quads forming said arched row extending in arcuate form from a first set of said exterior and interior hubs in a first quad in contact with a planar surface to a second set of exterior and interior hubs in a last quad in said succession of quads, said second set of exterior and interior hubs being in contact with said planar surface, said quads forming said arched row each having a top and a bottom and having exterior and interior hubs positioned at said top and said bottom, which exterior and interior hubs, except for exterior and interior hubs in contact with said planar surface, are shared exterior and interior hubs and function to simultaneously interconnect the top of one quad with the bottom of the next succeeding quad continuing throughout said arched row from said first quad and from said last quad up to a center point of said arched row.

3. The structure defined in claim 2 wherein said plurality of "B" quads has five, seven, nine or eleven "B" quads.

4. The structure defined in claim 3 wherein a plurality of arched rows of quads are interconnected side by side to provide depth to said structure.

5. The structure defined in claim 2 wherein said arched row has an even number of "B" quads, and at least one "A" quad having a first end and a second end, each said end with shared exterior and interior hubs, said "A" quad being located in the center of said arch row and positioned between and connected to said shared hubs of a preceding and a succeeding "B" quad in said arched row, said "A" quad extending in a horizontal plane above and parallel to said planar surface;

said "A" quad, having a base side, a top side, a first side and a second side, each said side connecting said base side with said top side;

said base side of said A quad comprising:

a pair of first and second exterior base side hubs aligned evenly in a vertical plane with respect to each other and a pair of first and second interior base side hubs aligned evenly in a vertical plane with respect to each other, said first exterior base side hubs and said first interior base side hubs being in substantial in-line alignment with respect to each other and said second exterior base side hubs and said second interior base side hubs being in substantial in-line alignment with respect to each other; and a first tubular strut connecting said first exterior base side hub with said second interior base side hub;

a second tubular strut connecting said second exterior base side hub with said first interior base side hub;

said first and second tubular struts being adjacent to each other and extending diagonally at said base between said exterior side hubs and said interior side hubs and being joined at a scissor point substantially in the center of the length of each said first and second tubular strut;

said "A" quad having a top side comprising a pair of first and second exterior top side hubs aligned evenly in a vertical plane with respect to each other and a pair of first and second interior top side hubs aligned evenly in a vertical plane with respect to each other, said first exterior top side hubs and said first interior top side hubs being in substantial in-line alignment with each other; and said second exterior top hubs and said second interior top hubs being in substantial in-line alignment with each other; and a third tubular strut connecting said first exterior top side hub with said second interior top side hub;

a fourth tubular strut connecting said second exterior top hub with said first interior top side hub;

said third and fourth tubular struts being adjacent to each other and extending diagonally at said top side between said exterior top side hubs and said interior top side hubs and being joined at a scissor point substantially in the center of the length of each said third and fourth tubular strut;

said first side of said quad comprising a pair of tubular struts adjacent to each other, a first first-side strut extending diagonally between said first exterior base side hub and said first interior top side hub, and a second first side strut extending diagonally between said first interior base side hub and said first exterior top side hub, said first side struts being joined at a scissor point substantially in the center of the length of each said first side strut and said second first side strut;

said second side of said quad comprising a pair of tubular struts adjacent to each other, a first second-side strut extending diagonally between said second exterior base side hub and said second interior top side hub, and a second side strut extending diagonally between said second interior base side hub and said second exterior top side hub, said second side hubs being joined at a scissor point substantially in the center of the length of each said first second side strut and said second side strut;

said "A" quad further having a subassembly contained within the area defined by said top, base and sides, said subassembly having a pair of center hubs comprising an exterior center hub and an interior center hub positioned substantially in-line substantially in the center of said quad with respect to each other, wherein four sets of two tubular struts each extend from said center hubs to said top and said base hubs:

a) a first center strut connecting said first exterior base hub to said interior center hub and a second center strut connecting said first interior base hub to said exterior center hub, said first and second tubular struts being adjacent to each other and extending diagonally and being joined at a scissor point substantially in the center of the length of said first and said second struts;

b) a third center strut connecting said second exterior base hub to said interior central hub and a fourth center strut connecting said second interior base hub to said exterior central hub, said third and fourth tubular struts being adjacent to each other and extending diagonally and being joined at a scissor point substantially in the center of the length of said third and said fourth struts;

c) a fifth center strut connecting said first exterior top side hub to said interior center hub and a sixth center strut connecting said first interior top side hub to said exterior center hub, said fifth and sixth tubular struts being adjacent to each other and extending diagonally and being joined at a scissor point substantially in the center of the length of said fifth and said sixth struts;

d) a seventh center strut connecting said second exterior top side hub to said interior central hub and an eighth center strut connecting said second interior top side hub to said exterior central hub, said seventh and eighth tubular struts being adjacent to each other and extending diagonally and being joined at a scissor point substantially in the center of the length of said seventh and eighth struts.

6. The structure defined in claim 2 wherein said arched row has an even number of "B" quads, and two "A" quads each said "A" quad having a first end and a second end, and having exterior and interior hubs at said first end being in contact with said planar surface, and exterior and interior hubs at said second end being shared hubs with an adjacent "B" quad, said "A" quad extending in a vertical plane at each said end of said arch and normal to said planar surface;

said structure comprising an "A" quad having a base side, a top side, a first side and a second side, each said side connecting said base side with said top side;

said base side of said A Quad comprising:

a pair of first and second exterior base side hubs aligned evenly in a vertical plane with respect to each other and a pair of first and second interior base side hubs aligned evenly in a vertical plane with respect to each other, said first exterior base side hubs and said first interior base side hubs being in substantial in-line alignment with respect to each other and said second exterior base side hubs and said second interior base side hubs being in substantial in-line alignment with respect to each other; and a first tubular strut connecting said first exterior base side hub with said second interior base side hub;

a second tubular strut connecting said second exterior base side hub with said first interior base side hub;

said first and second tubular struts being adjacent to each other and extending diagonally at said base between said exterior side hubs and said interior side hubs and being joined at a scissor point substantially in the center of the length of each said first and second tubular strut;

said "A" quad having a said top side comprising a pair of first and second exterior top side hubs aligned evenly in a vertical plane with respect to each other and a pair of first and second interior top side hubs aligned evenly in a vertical plane with respect to each other, said first exterior top side hubs and said first interior top side hubs being in substantial in-line alignment with each other; and said second exterior top hubs and said second interior top hubs being in substantial in-line alignment with each other; and a third tubular strut connecting said first exterior top side hub with said second interior top side hub;

a fourth tubular strut connecting said second exterior top hub with said first interior top side hub;

said third and fourth tubular struts being adjacent to each other and extending diagonally at said top side between said exterior top side hubs and said interior top side hubs and being joined at a scissor point substantially in the center of the length of each said third and fourth tubular strut;

a said first side of said quad comprising a pair of tubular struts adjacent to each other, a first first-side strut extending diagonally between said first exterior base side hub and said first interior top side hub, and a second first side strut extending diagonally between said first interior base side hub and said first exterior top side hub, said first side struts being joined at a scissor point substantially in the center of the length of each said first side strut and said second first side strut;

a said second side of said quad comprising a pair of tubular struts adjacent to each other, a first second-side strut extending diagonally between said second exterior base side hub and said second interior top side hub, and a second side strut extending diagonally between said second interior base side hub and said second exterior top side hub, said second side hubs being joined at a scissor point substantially in the center of the length of each said first second side strut and said second side strut;

said "A" quad further having a subassembly contained within the area defined by said top, base and sides, said subassembly having a pair of center hubs comprising an exterior center hub and an interior center hub positioned substantially in-line substantially in the center of said quad with respect to each other, wherein four sets of two tubular struts each extend from said center hubs to said top and said base hubs:

a) a first center strut connecting said first exterior base hub to said interior center hub and a second center strut connecting said first interior base hub to said exterior center hub, said first and second tubular struts being adjacent to each other and extending diagonally and being joined at a scissor point substantially in the center of the length of said first and said second struts;

b) a third center strut connecting said second exterior base hub to said interior central hub and a fourth center strut connecting said second interior base hub to said exterior central hub, said third and fourth tubular struts being adjacent to each other and extending diagonally and being joined at a scissor point substantially in the center of the length of said third and said fourth struts;

c) a fifth center strut connecting said first exterior top side hub to said interior center hub hub, said fifth and sixth tubular struts being adjacent to each other and extending diagonally and being joined at a scissor point substantially in the center of the length of said fifth and said sixth struts;

d) a seventh center strut connecting said second exterior top side hub to said interior central hub and an eighth center strut connecting said second interior top side hub to said exterior central hub, said seventh and eighth tubular struts being adjacent to each other and extending diagonally and being joined at a scissor point substantially in the center of the length of said seventh and eighth struts.

7. The structure defined in claim 6 having said two "A" quads in contact with said planar surface and in addition at least one "A" quad having first and second ends each with exterior and interior side shared hubs, which "A" quad is located in the center of said arched row positioned in between and connected to said shared exterior and interior hubs of a preceding and a succeeding "B" quad forming a part of said arched row, said "A" quad extending in a horizontal plane above and parallel to said planar surface, said horizontal "A" quad providing length to said structure;

said top of each vertically positioned "A" quad having a a pair of first and second exterior top side hubs aligned evenly in a vertical plane with respect to each other and a pair of first and second interior top-side hubs aligned evenly in a vertical plane with respect to each other, the first quad of said vertical "A" quads forms the first quad of said arch row and is connected via shared exterior and interior hubs to a first in sequence of said "B" quads in said arched row, and said second quad of said vertical "A" quads forms the last quad of said arch row and is connected via exterior and interior shared hubs in a last in sequence of said "B" quads in said arched row, each said "A" quad extending upright from said planar surface and normal thereto;

said two vertical "A" quads providing length to said structure.

8. The structure defined in claim 3 which contains a riser and a floating hub assembly, said floating hub assembly comprising a base element, which when said structure is erected rests on a shared interior articulating hub assembly, a connecting rod extending from said base vertically through an exterior shared articulating hub assembly connecting two quads, and a head top element, said head top element extends above the erected structure and is adjacent to and in line with said riser which is atop a centerpoint of the structure, wherein said top of said riser is above said top element of said floating hub assembly, said riser and connecting rod with said head top create an slope above said structure which when fabric cover is attached to said structure, a tight downwardly sloped surface from said riser the highest point past said floating hub assemblies allowing rain, ice and snow to slide off the top of said shelter assembly and down the fabric covered sides thereof.

9. The structure defined in claim 6 wherein the sequence of quads defining the arch row is ABBA.

10. The structure defined in claim 7 wherein the sequence of quads defining the arch row is ABABA and said articulating hub assembly is said ii) central hub assembly.

11. The structure defined in claim 10 wherein said structure contains a riser extending above said "A" quad located in the center of said arched row, said riser extending vertically upward from a central exterior hub in a subassembly in said "A" quad, said structure also containing a pair of floating hub assemblies positioned in line, on each side of, and adjacent to said riser, said floating hub assemblies each comprising a base resting on a shared interior articulating hub at each end of said "A" quad, a connecting rod extending from said base vertically through an exterior articulating shared hub at each end of said "A" quad, to a head top element extending above the top of said structure, the top of said riser being higher than the top of said head top elements of said pair of floating hub assemblies, such that when an exterior cover is secured to said structure, there is a smooth downward transition from the top of said riser past each said floating hub assembly onto each of the sides of said structure.

12. The structure defined in claim 7 wherein the sequence of quads defining the arch row is ABBABBA.

13. The structure defined in claim 5 wherein the sequence of quads defining the arch row is BBBABBB and said articulating hub assembly is said i) octagonal hub assembly.

14. The structure defined in claim 5 wherein the sequence of quads defining the arch row is BBABB and said articulating hub assembly is said i) octagonal hub assembly.

15. The structure defined in claim 1 wherein the sequence of quads defining the arch row is BB.

16. The structure defined in claim 5 wherein the sequence of quads defining the arch row is BAB.

17. The structure defined in claim 6 wherein the sequence of quads defining the arch row is ABBBBA and said articulating hub assembly is said ii) central hub assembly.

18. The structure defined in claim 12 wherein and said articulating hub assembly is said ii) central hub assembly.

19. The structure defined in claim 14 wherein said articulating hub assembly is said i) octagonal hub assembly.

20. The structure defined in claim 2 wherein the sequence of quads defining the arch row is BBBBBBB and said articulating hub assembly is said i) octagonal hub assembly.

21. The structure defined in claim 4 which contains a plurality of floating hub assemblies each having a base, a connecting rod extending through an articulating hub and a head top element extending above the top of said structure, the number of floating hub assembly being determined using the math formula $F=2(A-1)$ wherein F is the total number of floating hub assemblies installed and A is the number of arches.

22. The structure defined in claim 5 wherein said structure contains a riser extending above said "A" quad, said riser extending vertically upward from a central sub-assembly exterior hub in said "A" quad, which when a fabric covers said shelter a peak is formed as a result of the riser which allows snow and rain to slide down the sloped covered surface formed as a result of said riser.

23. The structure defined in claim 19 wherein said structure contains a riser extending above said horizontal "A" quad having a first and second end, said riser extending vertically upward from a central exterior hub in a subassembly in said "A" quad, and said structure contains a pair of floating hub assemblies positioned in-line on each side of and adjacent said riser, said floating hub assemblies each comprising a hub base resting on a shared interior articulating hub assembly at each end of said "A" quad, a connecting rod extending from said base vertically through an exterior articulating shared hub at each end of said "A" quad, to a head top element extending above the top of said structure, the top of said riser being higher than the top of said head top elements of said pair of floating hub assemblies, such that when an exterior cover is secured to said structure, there is a smooth downward transition from the top of said riser past each said floating hub assembly onto each of the sides of said structure.

24. The structure defined in claim 13 wherein said structure contains a riser extending above said horizontal "A" quad having a first and second end, said riser extending vertically upward from a central exterior hub in a subassembly in said "A" quad, and said structure contains a pair of floating hub assemblies positioned in-line on each side of and adjacent said riser, said floating hub assemblies each comprising a base resting on an shared interior articulating hub assembly at each end of said "A" quad, a connecting rod extending from said base vertically through an exterior articulating shared hub at each end of said "A" quad, to a head top element extending above the top of said structure, the top of said riser being higher than the top of said head top elements of said pair of floating hub assemblies, such that when an exterior cover is secured to said structure, there is a smooth downward transition from the top of said riser past each said floating hub assembly onto each of the sides of said structure.

25. The structure defined in claim 10 wherein said structure contains a riser extending above said horizontal "A" quad having a first and second end, said riser extending vertically upward from a central exterior hub in a subassembly in said "A" quad, and said structure contains a pair of floating hub assemblies positioned in-line on each side of and adjacent said riser, said floating hub assemblies each comprising a base resting on an shared interior articulating hub assembly at each end of said "A" quad, a connecting rod extending from said base vertically through an exterior articulating shared hub at each end of said "A" quad, to a head top element extending above the top of said structure, the top of said riser being higher than the top of said head top elements of said pair of floating hub assemblies, such that when an exterior cover is secured to said structure, there is a smooth downward transition from the top of said riser past each said floating hub assembly onto each of the sides of said structure.

26. The structure defined in claim 20 wherein a riser extends vertically upward from a sub-assembly central exterior hub such that when an exterior cover is secured to said structure, there is a smooth downward transition from the top of said riser onto the sides of said structure on each side of said riser.

27. The structure defined in claim 14 wherein a riser extends vertically upward from a sub-assembly central exterior hub such that when an exterior cover is secured to said structure, there is a smooth downward transition from the top of said riser onto the sides of said structure on each side of said riser.

28. The structure defined in claim 1 in which a pair of "B" quads, wherein said quads are arranged to form an inverted "V" structure wherein struts from respective two sets of said base hubs and from said two central hubs are connected to a single set of top first and second, exterior and interior hubs, said top forming an elevated vertex above a horizontal plane.

29. The structure defined in claim 4 which is a three dimensional structure having a plurality of identical matched arched rows of "B" quads connected to one another side to side.

30. The structure defined in claim 5 which has a BAB configuration, wherein said first and second, exterior and interior top side hubs from the first B quad also serve respectively as the first and second, exterior and interior base side hubs of said A quad, and wherein said first and second, exterior and interior top side hubs from said A quad also serve respectively as the first and second, exterior and interior top side hubs of said second B quad.

31. The structure defined in claim 7 which is a three dimensional structure having a plurality of identical matched "A" and "B" quads alongside with said struts connected to said hubs located along at least one of the sides of said " " and "B" quads.

32. The structure defined in claim 2 which has a BBBB configuration, which is arranged in a quasi-arcuate elevated form, wherein intermediate BB quads are interconnected as top to base to top, wherein said first and second, exterior and interior top side hubs from the first B quad also serve respectively as first and second, exterior and interior base side hubs of the following second B quad, and wherein said first and second, exterior and interior top side hubs from said following second B quad also serve respectively as the first and second, exterior and interior base side hubs of said third B quad, and wherein said first and second, exterior and interior top side hubs from a following third B quad also serve respectively as the first and second, exterior and interior top side hubs of said fourth B quad.

33. The structure defined in claim 32 which is a three dimensional structure having a plurality of identical matched "B" quads alongside with said struts connected to said hubs located along at least one of the sides of said BBBB quads.

34. The structure defined in claim 5 which has a BBABB configuration, which is arranged in a quasi-arcuate elevated form, wherein intermediate BAB quads are interconnected as top to base to top, wherein said first and second, exterior and interior top side hubs from the first B quad also serve respectively as first and second, exterior and interior base side hubs of the following second B quad, and wherein said first and second, exterior and interior top side hubs from said following second B quad also serve respectively as the first and second, exterior and interior base side hubs of said third B quad, and wherein said first and second, exterior and interior top side hubs from a following third B quad also serve respectively as the first and second, exterior and interior top side hubs of said fourth B quad.

35. The structure defined in claim 34 which is a three dimensional structure having a plurality of identical matched "A" quads and "B" quads alongside with said struts connected to said shared hubs located along at least one of the sides of said quads forming said arch row.

36. The structure defined in claim 7 which has a ABBBBA configuration, which is arranged in a quasi-arcuate elevated form, wherein intermediate BB quads are interconnected as top to base to top to base, wherein said first and second, exterior and interior top side hubs from the first B quad also serve respectively as first and second, exterior and interior base side hubs of the following second B quad, and wherein said first and second, exterior and interior top side hubs from said following second B quad also serve respectively as the first and second, exterior and interior base side hubs of said third B quad, and wherein said first and second, exterior and interior top side hubs from a following third B quad also serve respectively as the first and second, exterior and interior top side hubs of said fourth B quad, said "A" quads connected at each end to a "B" quad and vertical to said planar surface and an "A" quad separates and is connected to "B" quads at each end thereof, said "A" quad being horizontal and parallel to said planar surface.

37. The structure defined in claim 36 which is a three dimensional structure having a plurality of identical matched "A" and "B" winds alongside with said struts connected to said hubs located along at least one of the sides of said "A" and "B" quads.

38. The structure defined in claim 7 which has an ABBA-BBA configuration, which is arranged in a quasi-arcuate elevated form, wherein intermediate BB quads are interconnected as top to base to top, wherein said first and second, exterior and interior top side hubs from the first B quad also serve respectively as first and second, exterior and interior base side hubs of the following second B quad, and wherein said first and second, exterior and interior top side hubs from said following second B quad also serve respectively as the first and second, exterior and interior base side hubs of said third B quad, and wherein said first and second, exterior and interior top side hubs from a following third B quad also serve respectively as the first and second, exterior and interior top side hubs of said fourth B quad said "A" quads connected at each end to a "B" quad and vertical to said planar surface and an "A" quad separates and is connected to "B" quads at each end thereof, said "A" quad being horizontal and parallel to said planar surface.

39. The structure defined in claim 38 which is a three dimensional structure having a plurality of identical matched "A" and "B" quads alongside with said struts connected to said hubs located along at least one of the sides of said "A" and "B" quads.

40. The structure defined in claim 5 which has a BBBA-BBB configuration, which is arranged in a quasi-arcuate elevated form, wherein intermediate "B" quads are interconnected as top to base to top, wherein said first and second, exterior and interior top side hubs from the first B quad also serve respectively as first and second, exterior and interior base side hubs of the following second B quad, and wherein said first and second, exterior and interior top side hubs from said following second B quad also serve respectively as the first and second, exterior and interior base side hubs of said third B quad, and wherein said first and second, exterior and interior top side hubs from a following third B quad also serve respectively as the first and second, exterior and interior top side hubs of said fourth B quad.

41. The structure defined in claim 2 which has a BBBBBBB configuration, which is arranged in a quasi-arcuate elevated form, wherein intermediate BB quads are interconnected as top to base to top, wherein said first and second, exterior and interior top side hubs from the first B quad also serve respectively as first and second, exterior and interior base side hubs of the following second B quad, and wherein said first and second, exterior and interior top side hubs from said following second B quad also serve respectively as the first and second, exterior and interior base side hubs of said third B quad, and wherein said first and second, exterior and interior top side hubs from a following third B quad also serve respectively as the first and second, exterior and interior top side hubs of said fourth B quad.

42. The structure defined in claim 32 which contains a riser extending above each intermediate "B" quad of the four "B" quads forming said arch row, and a floating hub assembly positioned between the two said risers and in the center of said shelter, said floating hub assembly comprising a base resting on an shared interior articulating hub assembly at each end where the second and third quads join, a connecting rod extending from said base vertically through an exterior articulating shared hub at an end of said "A" quad, to a head top element extending above the top of said structure, the top of said floating hub assembly being higher than the top of said risers, such that when an exterior cover is secured to said structure, there is a smooth downward transition from the top of said floating hub assembly past each said riser onto each of the sides of said structure.

43. The structure defined in claim 30 wherein said structure contains a riser extending above said horizontal "A" quad having a first and second end, said riser extending vertically upward from a central exterior hub in a subassembly in said "A" quad, and said structure contains a pair of floating hub assemblies positioned in-line on each side of and adjacent said riser, said floating hub assemblies each comprising a base resting on an shared interior articulating hub assembly at each end of said "A" quad, a connecting rod extending from said base vertically through an exterior articulating shared hub at each end of said "A" quad, to a head top element extending above the top of said structure, the top of said riser being higher than the top of said head top elements of said pair of floating hub assemblies, such that when an exterior cover is secured to said structure, there is a smooth downward transition from the top of said riser past each said floating hub assembly onto each of the sides of said structure and said articulating hub is said ii.) octagonal hub.

44. The structure defined in claim 34 wherein said structure contains a riser extending above said horizontal "A" quad having a first and second end, said riser extending vertically upward from a central exterior hub in a subassembly in said "A" quad, and said structure contains a pair of floating hub assemblies positioned in-line on each side of and adjacent said riser, said floating hub assemblies each comprising a base resting on an shared interior articulating hub assembly at each end of said "A" quad, a connecting rod extending from said base vertically through an exterior articulating shared hub at each end of said "A" quad, to a head top element extending above the top of said structure, the top of said riser being higher than the top of said head top elements of said pair of floating hub assemblies, such that when an exterior cover is secured to said structure, there is a smooth downward transition from the top of said riser past each said floating hub assembly onto each of the sides of said structure and said articulating hub is said ii.) octagonal hub.

45. The structure defined in claim 36 which contains a riser extending above each intermediate "B" quad of "B" quads forming said arch row, and a floating hub assembly positioned between the two said risers and in the center of said structure, said floating hub assembly comprising a base resting on an shared interior articulating hub assembly at each end where the second and third quads join, a connecting rod extending from said base vertically through an exterior articulating shared hub at the end of said "A" quad, to a head top element extending above the top of said structure, the top of said floating hub assembly being higher than the top of said risers, such that when an exterior cover is secured to said structure, there is a smooth downward transition from the top of said floating hub assembly past each said riser onto each of the sides of said structure, and said articulating hub is said ii) octagonal hub.

46. The structure defined in claim 38 wherein said structure contains a riser extending above said horizontal "A" quad having a first and second end, said riser extending vertically upward from a central exterior hub in a subassembly in said "A" quad, and said structure contains a pair of floating hub assemblies positioned in-line on each side of and adjacent said riser, said floating hub assemblies each comprising a hub base resting on a shared interior articulating hub assembly at each end of said "A" quad, a connecting rod extending from said base vertically through an exterior articulating shared hub at each end of said "A" quad, to a head top element extending above the top of said structure, the top of said riser being higher than the top of said head top elements of said pair of floating hub assemblies, such that when an exterior cover is secured to said structure, there is a smooth downward transition from the top of said riser past each said floating hub assembly onto each of the sides of said structure, and said articulating hub is said i.) central hub.

47. The structure defined in claim 38 wherein said structure contains a riser extending above said horizontal "A" quad having a first and second end, said riser extending vertically upward from a central exterior hub in a subassembly in said "A" quad, and said structure contains a pair of floating hub assemblies positioned in-line on each side of and adjacent said riser, said floating hub assemblies each comprising a hub base resting on a shared interior articulating hub assembly at each end of said "A" quad, a connecting rod extending from said base vertically through an exterior articulating shared hub at each end of said "A" quad, to a head top element extending above the top of said structure, the top of said riser being higher than the top of said head top elements of said pair of floating hub assemblies, such that when an exterior cover is secured to said structure, there is a smooth downward transition from the top of said riser past each said floating hub assembly onto each of the sides of said structure, and said articulating hub is said ii.) octagonal hub.

48. The structure defined in claim 1 wherein angles measured from an apex to shared hubs of a quad range between 25.7° to 90°.

49. The structure defined in claim 42 which contains a riser extending above each intermediate "B" quad of "B" quads forming said arch row, and a floating hub assembly positioned between the two said risers and in the center of said structure, said floating hub assembly comprising a base resting on an shared interior articulating hub assembly at each end where the second and third quads join, a connecting rod extending from said base vertically through an exterior articulating shared hub at the end of said "A" quad, to a head top element extending above the top of said structure, the top of said floating hub assembly being higher than the top of said risers, such that when an exterior cover is secured to said structure, there is a smooth downward transition from the top of said floating hub assembly past each said riser onto each of the sides of said structure, and said articulating hub is said ii) octagonal hub.

50. The structure defined in claim 1 wherein to calculate the width and interior height desired in said shelter, a method using a given strut length L, which is the base of an isosceles triangle, and a given vertex angle θ, determined by dividing the number of B Quads into 180, the sum of the angles of a triangle totaling 180, and as a result of obtaining the side and the vertex angle, there is enough information to calculate the legs of the isosceles triangle which is a one component of the width comprising half an arc and the interior height.

* * * * *

UNITED STATES PATENT AND TRADEMARK OFFICE

CERTIFICATE OF CORRECTION

PATENT NO. : 8,082,938 B2
APPLICATION NO. : 12/322062
DATED : December 27, 2011
INVENTOR(S) : A. Jon Prusmack It is certified that error appears in the above-identified patent and that said Letters Patent is hereby corrected as shown below:

IN THE DRAWINGS:

Sheet 3, Figure 3, in a space adjacent to the depicted upper quad, between reference numerals 300 and 306, insert an --A--; in a space adjacent to the depicted lower quad, between reference numerals "306" and "313", insert a --B--; with respect to the proximal strut extending between reference numerals "308" and "303", delete reference numeral "367" and insert therefor: reference numeral --399--; with respect to the distal strut extending between elements "309" and "302", delete reference numeral "367" and insert therefor: reference numeral --398--;

Sheet 31, Figure 26, insert reference number --2606-- adjacent the quad base located between quad bases 2605 and 2607;

Sheet 33, Figure 29, insert reference numeral --154-- and a lead line extending therefrom to the tang element between reference numerals "159" and "153."

Sheet 34, Figure 30A, extend a lead line from reference numeral "402" to the boss element surrounding opening "400."

Sheet 36, Figure 32A, extend a lead line from reference numeral "154" to tang element, which extends from strut "150" within slit "160."

Sheet 41, Figure 37, insert reference numeral --6-- and a lead line therefrom extending to the hub cover element positioned between keeper "11" and hub body "1."

IN THE SPECIFICATION:

Column 19, line 5, delete "366, 367" and substitute therefor: --398, 399--; line 6, delete "366" and insert therefor: --399--; line 8, delete "367" and insert therefor: --398--.

Signed and Sealed this
Second Day of October, 2012

David J. Kappos

David J. Kappos
*Director of the United States Patent and Trademark Office*

Column 21, line 21, delete “310” and insert therefor: --311--.

Column 28, line 20, delete “six” and insert therefor: --four--; line 22, delete “a single” and insert therefor: --three--; same line, delete “Quad” and insert therefor: --Quads--; same line, delete (BBBABBB) and insert therefor: --(ABBABBA)--; line 67, delete “thenb” and insert therefor: --then--.

Column 32, lines 1 and 34, at each occurrence, delete “30A” and insert therefor: --32A--; lines 17, 22 and 35, at each occurrence, delete “30B” and insert therefor: --32B--.

Column 33, lines 15, 16, 37, 39, at each occurrence, delete “32A” and insert therefor: --30A--; lines 27 and 28, at each occurrence, delete “32B” and insert therefor: --30B--.